US006050120A

United States Patent [19]

Daehn et al.

[11] Patent Number: 6,050,120

[45] Date of Patent: Apr. 18, 2000

[54] HYBRID MATCHED TOOL-ELECTROMAGNETIC FORMING APPARATUS

[75] Inventors: Glenn S. Daehn; Vincent J. Vohnout, both of Columbus, Ohio; Lawrence DuBois, Bloomfield Township, Mich.

[73] Assignee: The Ohio State University, Columbus, Ohio

[21] Appl. No.: 09/135,082

[22] Filed: Aug. 17, 1998

[51] Int. Cl.[7] ..... B21D 1/06; B26D 26/14

[52] U.S. Cl. ..... 72/57; 72/54; 72/430; 72/707

[58] Field of Search ..... 72/54, 56, 57, 72/60, 430, 707

[56] References Cited

U.S. PATENT DOCUMENTS

| | | | |
|---|---|---|---|
| 3,372,566 | 3/1968 | Schenk et al. | 72/56 |
| 3,394,569 | 7/1968 | Smith | 72/56 |
| 3,975,936 | 8/1976 | Baldwin et al. | 72/38 |
| 3,992,773 | 11/1976 | Duffner et al. | 29/628 |
| 3,998,081 | 12/1976 | Hansen et al. | 72/56 |
| 4,026,628 | 5/1977 | Duffner et al. | 339/177 |
| 4,049,937 | 9/1977 | Khimenko et al. | 219/7.5 |
| 4,067,216 | 1/1978 | Khimenko et al. | 72/56 |
| 4,135,379 | 1/1979 | Hansen et al. | 72/56 |
| 4,143,532 | 3/1979 | Khimenko et al. | 72/56 |
| 4,148,091 | 4/1979 | Hansen et al. | 361/156 |
| 4,151,640 | 5/1979 | McDermott et al. | 29/605 |
| 4,169,364 | 10/1979 | Khimenko et al. | 72/56 |
| 4,361,020 | 11/1982 | Hirota et al. | 72/57 |

(List continued on next page.)

FOREIGN PATENT DOCUMENTS

| | | | |
|---|---|---|---|
| 590043 | 1/1978 | U.S.S.R. | 72/56 |

OTHER PUBLICATIONS

Yoshikazu et al., "Application of Electromagnetic Metal Forming Equipment to Various Industries and Its Development for Mass Application", pp. 5.4.1–5.4.45.

Moon, F.C., Magneto–Solid Mechanics, (1984).

ASTME, High Velocity Forming of Metals, revised edition (1968).

Michael M. Plum, "Electromagnetic Forming", Forming Processes for Sheet, Strip, and Plate, pp. 645–652.

Belyy, I.V., et al., Electromagnetic Metal Forming Handbook, Khar'kov State University, Khar'kov, USSR (1997).

Michael C. Noland, Designing For The High–Velocity Metalworking Processes, Design Guide, pp. 164–182, 1967.

Fenton, G. et al., Modeling of Electromagnetically Formed Sheet Metal, (1996).

Daehn, et al., "High–Velocity Metal Forming—An Old Technology Addresses New Problems", pp. ????.

Balanethiram et al., "Enhanced Formability Of Interstitial Free Iron At High Strain Rates", Formability of Fe, vol. 27, pp. 1783–1788, 1992.

Gourdin, "Analysis and assessment of electromagnetic ring expansion as a high–strain–rate test", J. Appl. Phys. vol. 65, No. 2, pp. 411–422, 1989.

Balanethiram et al., "Hyperplasticity: Increased Forming Limits At High Workpiece Velocity", Forming Limits, vol. 30, pp. 515–520, 1991.

Hu et al., "Effect Of Velocity On Flow Localization In Tension", Acta metall. mater. vol. 00, No. 0 pp. 1–13, 1995.

Altynova et al., "Increased Ductility In High Velocity Electromagnetic Ring Expansion", pp. 1–32.

*Primary Examiner*—David Jones

*Attorney, Agent, or Firm*—Standley & Gilcrest LLP

[57] ABSTRACT

The present invention relates to molds and mold portions that comprise or have integrated therewith a resinous material and comprise at least one electromagnetic actuator imbedded in the resinous material, so as to be capable of further forming the at least one precursor area of the work piece. The resin is used to locate the coil, and clamps or other restraints preferably are used to keep the weaker electrically insulating resin out of a state of large tensile stress or strain, which may cause it to fracture. Preferably, the resinous material comprises metallic flakes imbedded therein.

8 Claims, 33 Drawing Sheets

U.S. PATENT DOCUMENTS

| | | | |
|---|---|---|---|
| 4,531,393 | 7/1985 | Weir | 72/56 |
| 4,619,127 | 10/1986 | Sano et al. | 72/56 |
| 4,748,837 | 6/1988 | Kurosawa et al. | 72/57 |
| 4,947,667 | 8/1990 | Gunkel et al. | 72/56 |
| 4,962,656 | 10/1990 | Kunerth et al. | 72/56 |
| 4,986,102 | 1/1991 | Hendrickson et al. | 72/56 |
| 5,046,345 | 9/1991 | Zieve | 72/56 |
| 5,331,832 | 7/1994 | Cherian et al. | 72/56 |
| 5,353,617 | 10/1994 | Cherian et al. | 72/56 |
| 5,405,574 | 4/1995 | Chelluri et al. | 419/47 |
| 5,442,846 | 8/1995 | Snaper | 29/419 |
| 5,457,977 | 10/1995 | Wilson | 72/56 |
| 5,471,865 | 12/1995 | Michalewski et al. | 72/430 |
| 5,829,137 | 11/1998 | Grassi | 72/56 |
| 5,832,766 | 11/1998 | Hartman et al. | 72/62 |
| 5,860,306 | 1/1999 | Daehn et al. | 72/56 |

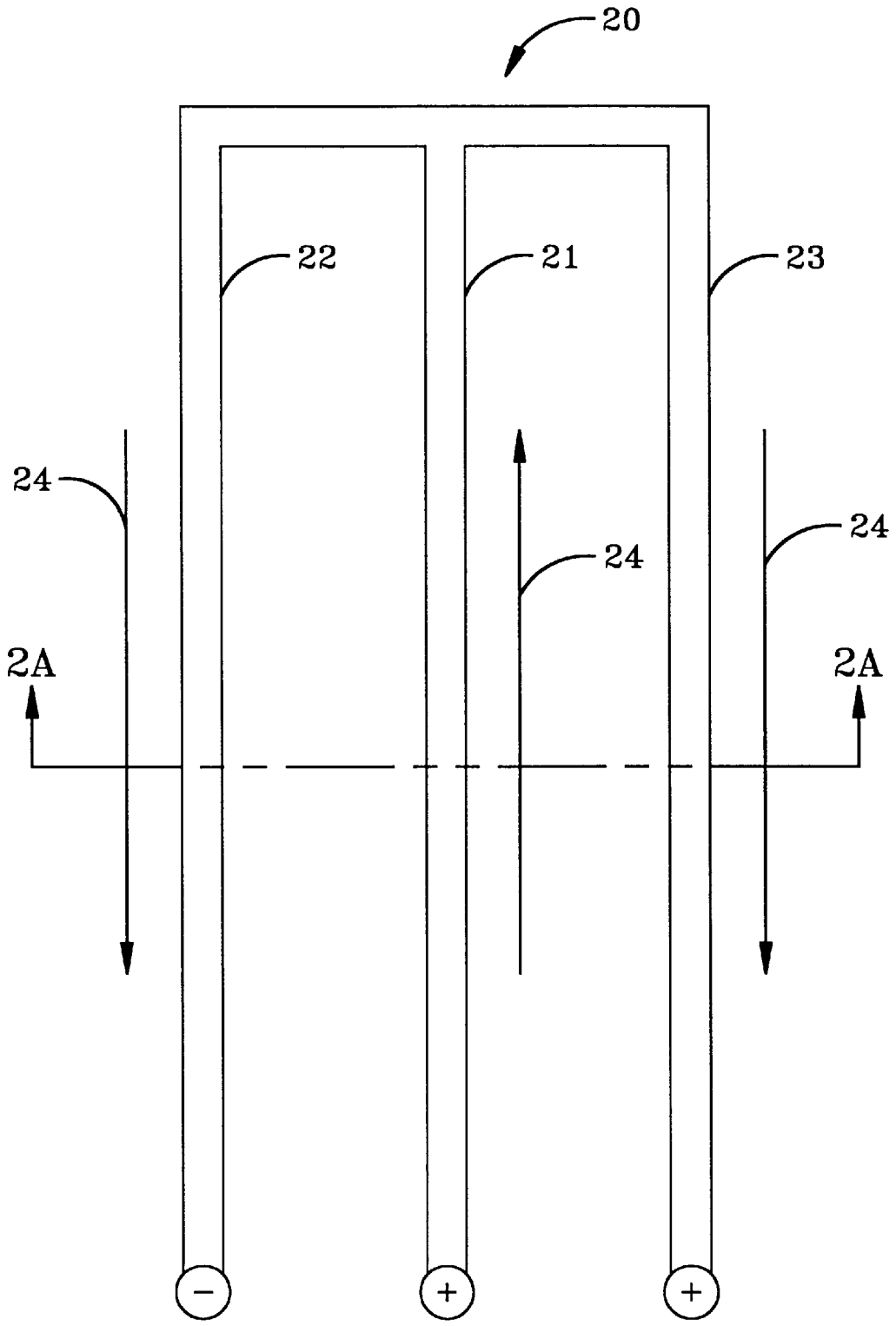
FIG−2

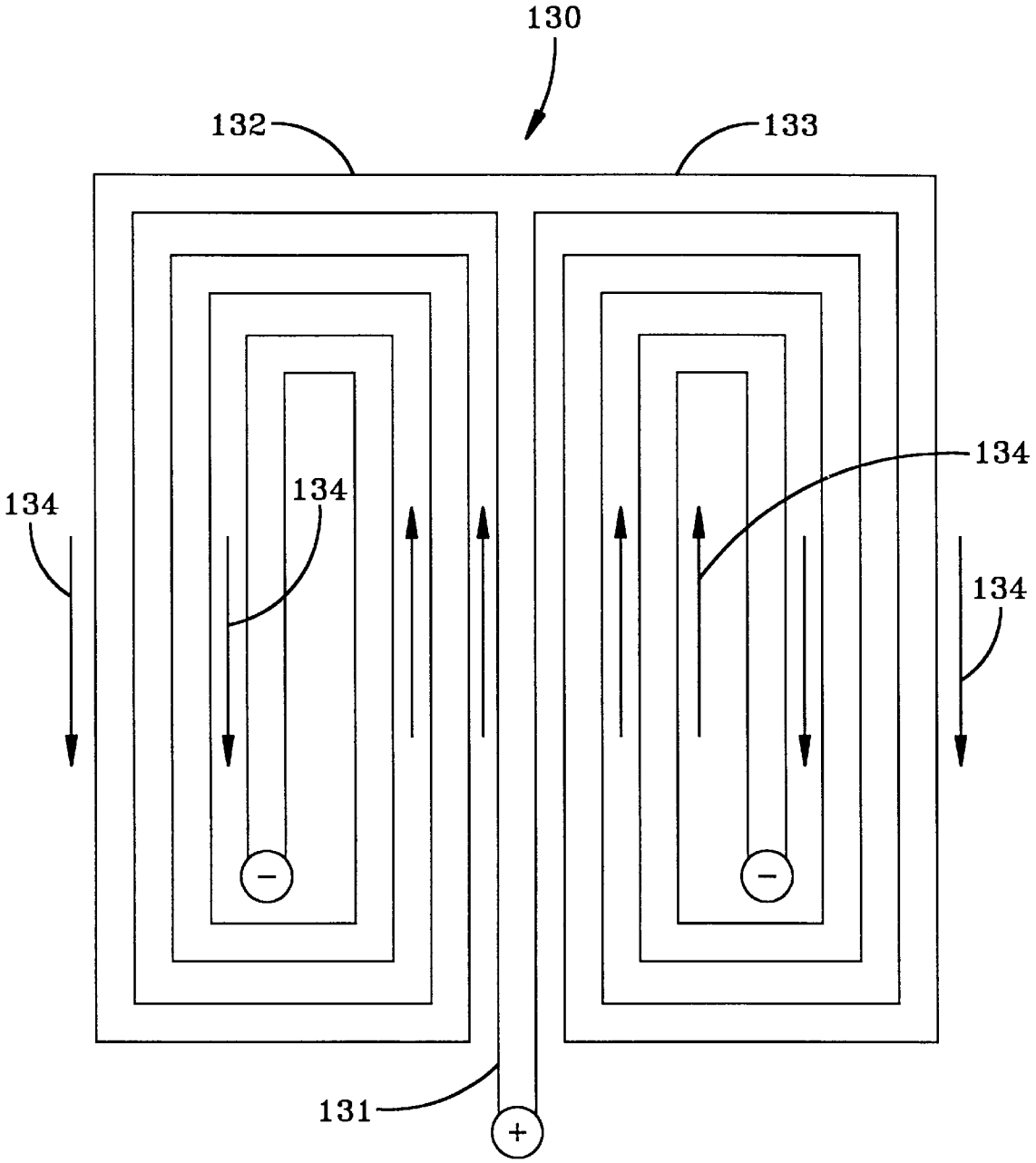
FIG−3B

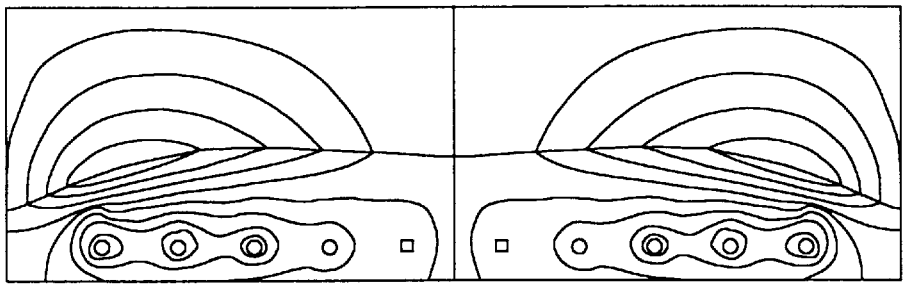
90 MICROSECONDS
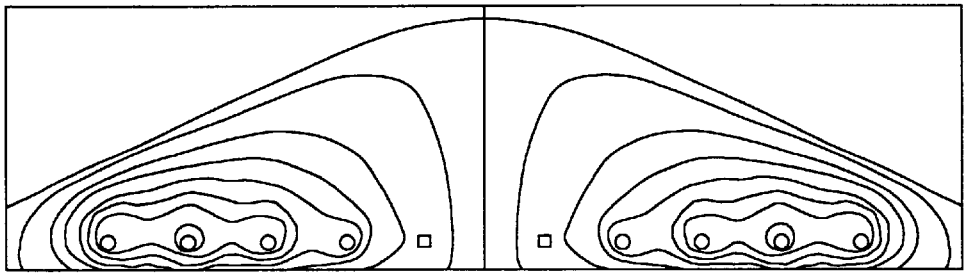
300 MICROSECONDS
FIG-7

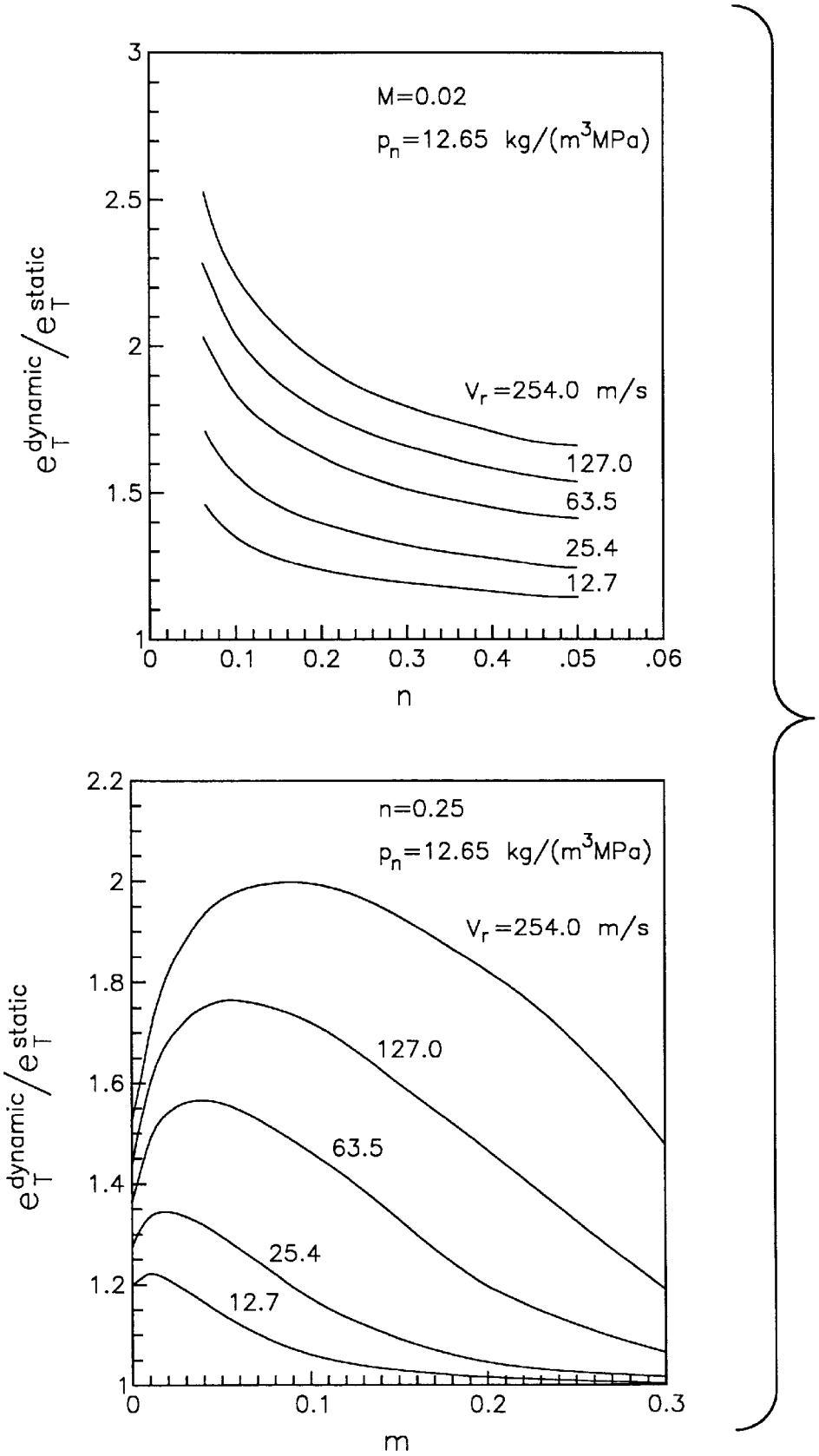
FIG−18

HYBRID MATCHED TOOL-ELECTROMAGNETIC FORMING APPARATUS

RELATED APPLICATION DATA

None.

TECHNICAL FIELD OF THE INVENTION

This invention relates to a hybrid matched tool-electromagnetic forming apparatus incorporating electromagnetic actuator coils, methods of forming metal using same, and metal articles made therefrom. This invention has a variety of applications including forming large sheets of conductive metal, such as that which may be used in automobile manufacture.

BACKGROUND OF THE INVENTION

Electromagnetic forming is a method of forming sheet metal or thin walled tubes that is based on placing a work-coil in close proximity to the metal to be formed and running a brief, high intensity current pulse through the coil. If the metal to be formed is sufficiently conductive the change in magnetic field produced by the coil will develop eddy currents in the work piece. These currents also have associated with them a magnetic field that is repulsive to that of the coil. This natural electromagnetic repulsion is capable of producing very large pressures that can accelerate the work piece at high velocities (typically 1–200 meters/second). This acceleration is produced without making physical contact to the work piece. The electrical current pulse is usually generated by the discharge of a capacitor bank. This field has been developed by many individuals and companies and is widely used for the forming and assembly of tubular and sheet work pieces. Several excellent reviews of the field are available, including Moon, F. C., *Magneto-Solid Mechanics,* ASTME, High Velocity Forming of Metals, revised edition (1968); Plum, M. M., *Electromagnetic Forming,* Metals Handbook, Maxwell Laboratories, Inc., pp. 644–653; and Belyy, I. V., Fertik, S. M. and Khimenko, L. T., Electromagnetic Metal Forming Handbook, Khar'kov State University, Khar'kov, USSR (1977) (Translation from Russian by M. M. Altoynova 1996), all of which are hereby incorporated herein by reference. Examples of prior art patents involving electromagnetic forming include U.S. Pat. No. 4,947,667 to Gunkel et al., U.S. Pat. No. 4,531,393 to Weir et al., U.S. Pat. No. 5,353,617 to Cherian et al., U.S. Pat. No. 3,998,081 to Hansen et al., U.S. Pat. No. 5,331,832 to Cherian et al., U.S. Pat. No. 5,457,977 to Wilson, U.S. Pat. No. 4,619,127 to Sano et al., U.S. Pat. No. 4,473,862 to Hill, U.S. Pat. No. 4,151,640 to McDermott et al. and U.S. Pat. No. 5,016,457 to Richardson et al., all of which are hereby incorporated herein by reference.

Electromagnetic forming can be carried out on a wide range of materials and geometries within some fundamental constraints. First, the material must be sufficiently electrically conductive to exclude the electromagnetic field of the work-coil. The physics of this interaction have been well characterized.

It is an object of the present invention to provide apparatus and methods that take advantage of such actuators and to use them in conjunction with, mold and tool bodies.

Although not limited in their application to the automobile industry, many of the problems solved and advantages achieved with the apparatus and methods of the present invention can be appreciated by reference to the problems faced in the forming of sheet metals in that industry.

The automotive industry is currently interested in producing automobile body parts from aluminum alloys. The weight saving of up to 50% of the body-in white and its attendant gains in fuel efficiency are largely responsible for this interest. Additionally, the superior recycle characteristic of aluminum is recognized as becoming of increasing importance as the total life cycle cost of automobiles becomes an issue. [DuBois 1996, Henry 1995].

The press forming of aluminum alloys have problems in comparison to steel principally due to very low strain rate hardening, low r (strain ratio) value and high galling tendency. In particular the lack of strain rate hardening behavior in aluminum alloys at room temperature is troublesome since this is the characteristic that allows post uniform plastic strain in a sheet metal. All good draw quality sheet steels have enhanced strain rate sensitivity which is identifiable by a long arching stress-strain curve. The press forming handicap of aluminum alloys, measured by the lack of strain rate sensitivity, is shown by the direct comparison of the stress-strain curves for typical auto body steel and aluminum sheet FIG. 10 which was adapted from an Aluminum Association report [Al Assoc., 1996].

Despite the press working "fussiness" of aluminum, car builders are currently using aluminum for selected body panels such as hoods outer door skins and trunk lids. These are parts that are geometrically simple and can be stretch-draw formed with conventional matched tools. However, the propensity of aluminum alloys to neck and tear at relatively low strain levels, makes many of the more geometrically complex body parts extremely difficult or impossible to produce in aluminum with conventional matched tools. A side-by-side comparison of two automobile door-inner panels from the same stamping die was conducted to manifest the material characteristics shown in FIG. 10. A fully formed panel of specified production steel sheet that was produced after set-up trials indicated satisfactory tool performance. A second panel of 6111-T4 aluminum of the same gauge as the steel was processed directly after the steel panel. The aluminum panel showed wrinkling and large splits that occurred within the first 25% of the tool stroke, which was not unexpected.

Fluid pressure forming methods such as Verson-Wheelon, ABB or Hydroform can extend the formable geometry for aluminum sheet somewhat but at the cost of long cycle time leading to unacceptably low production rates. Fluid pressure methods have high capital equipment costs compared to conventional press machines due principally to the high static operating pressures.

Several aluminum alloy exhibit superplastic creep behavior which can be utilized to produce very complex sheet part geometries. Current superplastic forming methods also suffer from inherently long cycle times in addition to requiring high temperatures and specialized alloys. Control of superplastic forming is inherently more complex in that it requires the explicit control of worksheet temperature and forming gas pressure during the forming cycle. The capital costs equipment costs are also significantly greater than the conventional [Laycock, 1982].

A compromise solution might be to change the part designs to shapes which can be produced in aluminum using current production methods. Another solution would be a new sheet forming method which could overcome the formability short-comings of aluminum alloys while maintaining acceptable production rates (150–300 parts/hr. for large body panels). Such a processes would be less restrictive for the automobile designers and thus more appealing to the industry. In addition, this improved forming performance must be attainable with capital equipment and tooling expenditures which will maintain competitive production part costs. To this end, it would be an added advantage if this new method could actually provide a reduction in tooling costs compared to current practice. Such a cost reduction may be attainable if, for instance, the new method required only a single part-surface tool instead of a precisely matched pair. Single-sided form tools, currently used in the fluid forming processes need fewer trials and subsequent geometry alterations before producing good parts. Another highly beneficial attribute of the new process would be implementation using the installed press machines that are currently used by the industry for conventional sheet metal stamping.

Hypothetically, a method that would completely fulfill the performance criteria listed above might be designed using a "clean sheet" approach. However it is quite likely that many of the attributes of current processes would be re-invented. Most complex technologies emerge in a evolutionary manner, incrementally with occasional forward leaps. Therefore, an examination of existing methods for evidence of partial solutions to the total problem is appropriate.

It is therefore an object of the present invention to produce hybrid apparatus and methods that go further toward meeting the ideal performance goals than the prior art devices and methods.

The existing processes of interest as components of a combined hybrid method are; conventional matched tools, fluid pressure processes and the high velocity, impulse power processes. The common characteristic that these methods share is a general insensitivity to alloy type or inherent restriction of forming rate. Superplastic forming has been omitted under this same rational, although near term developments in superplastic forming may indeed increase its viability as a production method for aluminum auto body panels. Each of the included methods have a significant track record in some production niche and have attributes which are partial solutions to the overall problem of production stamping of aluminum alloy sheet. In the interest of clarity, the characteristics of these methods are briefly described below. If more detailed information on these constituent methods is desired, the reader is referred to any good text or handbook of industrial metal forming practice [e.g. Lange, 1985, Lascoe,1988].

Matched Tools

The use of matched tools is the most common method of producing sheet metal parts in the auto industry. If aluminum parts for the body-in-white could be produced in matched tooling, with the same level of development effort as steel parts, the auto industry would look no further. Any other potential benefits of a new method would, unfortunately, be ignored in favor of the more familiar method.

In matched tool forming a flat sheet blank is pressed into the desired shape between a male and female set of form tools. The female tool, usually referred to as the die, carries, in essence, the outside shape of the part. Similarly, the male tool, referred to as the punch, carries the inside shape of the part. In addition to the punch and die, virtually all matched tool sets have a third component called the blank holder which holds the blank in position against the die face and assist forming by controlling sheet draw-in.

The matched tool forming method is essentially a position control process. When the tool halves are closed on the sheet blank to a predetermined shut height, the part is fully formed. Since forces need not be directly controlled, the press machines and controls required for this process can be very simple in their fundamental design. The most commonly used press machines are mechanical, based on some variation of the simple slider-crank mechanism. Hydraulic presses, which can provide independent control of speed and position of the tool halves during the forming stroke which can benefit forming. However, the tool set must still be brought to the same closed position for the part to be fully formed.

Sheet forming with matched tooling is the process that the industry has a great deal of accumulated knowledge about. Essentially, the entire installed press machine population of the industry is optimally designed for the matched tool method.

The cost of producing matched tools is highest of the tool costs of the conventional processes of interest here. Tooling for other sheet forming methods such as fluid pressure forming, can be significantly less expensive and produced in less time since only one form surface is required. However fluid pressure methods has not displaced conventional matched tool forming to any significant extent. The reason is simply that tooling cost are not the principle driving force in auto body part production.

Fluid Pressure Forming

The fluid pressure processes used past and present have demonstrated certain of the desired traits of the process of the present invention. Principle among these traits is an extended forming capability as measured by Limit Draw Ratio (LDR). Further, the extended LDR is applicable to many of the hard-to-form alloys. [Yossifon and Tirosh, 1990, Nakamura and Nakagawa, 1987].

Fluid pressure sheet forming is a force control process as opposed to position control required for matched tool method. In fluid pressure forming, the blank sheet is forced over a male punch tool or into a female die by the pressure action of a fluid (usually oil or water). Since the pressurized fluid replaces the action of one of the tool halves of the matched tool method, fluid pressure forming has also been called "universal die" forming. Fluid pressure forming has been most successfully applied to smaller parts using large, expensive, slow, specialized press machines. Fluid pressure sheet forming machines are structurally heavier than matched tool (conventional) press machines for a given size of part. The larger machine structure is a direct consequence of the very high static pressure required to forming small inside (free) corner radii. The high pressure is applied over the entire plan area of the part, generating very large structural loads in the machine frame. These high loads are quite disproportional to the level of plastic work done to the part. In order to reduce the high peak pressures, it is common to employ auxiliary forming tool sections. The auxiliary tool sections are placed in partially formed part to act as pressure concentrators at the sharper part features. Since the machine must go through another cycle, this use of auxiliary tool sections approaches the cost of a full secondary operation.

High Velocity Forming

High velocity sheet forming, also referred to as "high energy rate" forming is not well known outside of the aerospace industry. However, this forming technology has been in commercial use, in some form, for close to a century [Ezra, 1973]. The first applications were the forming of large domes from plate using chemical explosives. Later, electromagnetic pulses and submerged electric arc (electro-discharge, electro-hydraulic) discharges were employed to generate very high power events which resulted in producing the very high deformation rates characteristic of these processes. The deformation velocities generated in the electromagnetic and electrohydraulic processes are lower than the velocities achievable with explosives but are still 100 to 1000 times greater than the deformation rates of the quasi static processes like matched tool or fluid pressure forming (~0.1 vs. 100 m/s). Such high deformation rates are known to significantly extend the deformation capacity of many metals[Wood 1963, Orava 1967]. FIG. 11 summarizes the results of some early experiments in high velocity forming of sheet metals. Note that FIG. 11 reports average strain rather than maximum strain at failure which has become the more accepted figure of merit since the introduction of Forming Limit Diagrams (FLD). FIG. 12 shows the results of more recent experiments in high velocity forming of aluminum alloys presented in FLD data format. It should be noted that the data of FIG. 11 is for unconstrained "free" dome tests while certain high velocity data in FIG. 12 could be confounded by an ironing effect due to impact with a covering conical die cap. The ironing effect compliments the primary hyper-plastic effect of inertial stabilization of necking.

Hyper-plasticity under free flow conditions has been chiefly attributed to suppression of local necking due to material inertia rather that changes in the constitutive behavior of the material. Although, much higher than conventional sheet forming rates, the velocities of these "high rate" processes generate strain rates that are generally lower than rates associated with changes in constitutive behavior ($10^2$–$10^3$ Vs $10^4$ $sec^{-1}$) [Follansbee and Kocks 1988.] Results of analytic and numerical simulations indicates that the inertia of material mass itself resists the high velocity changes inherent in the formation of local necking regions at high deformation rates [Fyfe and Rajendran 1980, Banerjee 1984, Fressengeas and Molinari 1985, Han and Tvergaard 1994, Hu and Daehn 1995]. Many of the commercial metals including aluminum alloys have demonstrated increases in ductility of 100% or more in comparison to the elongation obtained at low, quasi-static rates [Wood 1963, Balanethiram and Daehn 1992] The extended ductility is available over a broad range of work piece velocities which are specifically material dependent but generally lie between 50 and 300 m/sec. The upper deformation velocity limit for a material is dependent on specimen geometry, and boundary conditions which determine whether or not plastic deformation front "wave" propagation effects can become significant [von Karman and Duwez, 1950]. Except for cases of essentially simultaneous, uniform deformation such as in the electromagnetic expansion of thin rings, "wave" fronts will be present.

The high velocity processes were extensively investigated during the twenty year period from approximately 1955 to 1975. By 1962, a bibliography containing hundreds of abstracts was published by the USAF [Strohecher, 1962]. In 1968, a textbook summarizing all the then current methods was publish by the American Society of Tool and Manufacturing Engineers [Bruno, 1968]. Texts covering specific methods were published by other authors [Rienhart, 1963, Ezra, 1973]. Interest in high velocity metal forming was principally centered in the aerospace industry and directed by military and space craft applications. Explosive forming of large radar domes and missile nose caps proved to be superior in part quality and cost when compared to welded fabrications [Areojet General 1961]. This success led to application to smaller parts and eventually to the development of several machine based systems. These systems attempted to capitalize on the hyperplasticity and complex shape forming characteristics of the various processes for higher volume applications. Machine systems based on chemical explosives, electro-hydraulic and electromagnetic pulse were developed. The most widely used during the late sixties and early seventies was the electro-hydraulic method. However to date, only the electromagnetic pulse method has gained significant acceptance outside the aerospace industry.

Since the electromagnetic pulse and to a lesser extent, electro-hydraulic methods have the greatest potential of meeting the requirements, such as cycle time, of automotive type of manufacturing, only these two high velocity forming methods will be discussed further.

Electromagnetic

Electromagnetic sheet forming, also known as magnetic pulse forming, is based on the repulsive force generated by the opposing magnetic fields in adjacent conductors. The primary field is developed by the rapid discharge of a capacitor bank through the "driver coil" conductor and the opposing field results from the eddy current induced in the "work piece" conductor. Therefore, a fundamental requirement for this type of electric pulse energy is that the work piece must be an electrical conductor. The efficiency of electromagnetic forming is directly related to the resistance of the work piece material. Materials which are poor conductors can only be effectively formed with electromagnetic energy if a auxiliary driver plate of high conductivity is used to push the work piece.

Electromagnetic forming of axisymmetric parts, using either compression or expansion solenoid type forming coil is, to date, the most widely used of the electric pulse energy methods. The common application is for the swaging of tubular components onto coaxial mating parts for assembly. Not as common is the forming of shallow shells from flat sheets using flat spiral coils. FIG. 13 shows schematics of the general classes of electromagnetic forming coils and work pieces. Note that axisymmetric or tube compression forming onto a male form tool is also possible.

Electromagnetic pulse forming is currently used in the automotive industry most commonly for crimping and swaging operations on tubular type parts. One high production example of the industrial application of electromagnetic pulse forming is the pressure tight crimping of canister type oil filter assemblies.

Electromagnetic forming can be performed under low efficiency conditions without coils. In this case the work piece itself forms part of the direct current path closing the circuit on the charge source. For this reason it could also be called "direct" electromagnetic forming. If the part pre-form is such that the current flow is parallel to itself, the driving form pressure can be contained completely within the part. If the initial part geometry does not permit a parallel current flow, then an insulated "reaction" blocks of highly conductive material must be placed close to the part area to be formed, opposite to the direction of desired deformation. An opposing eddy current will be induced in the reaction block which can generate the desired repulsive magnetic forming pressure on the part. This condition is the inverse of more conventional electromagnetic forming where the induced eddy current is in the work piece. In general, part geometries will allow only a single current loop path. Therefore, such "direct" forming will tend to have rather low electromagnetic force efficiency compared to separate multi-turn coils which can generate greater force per ampere on the work piece.

Electro -Hydraulic

Submerged electric arc discharge has been commonly referred to in the literature as electro-hydraulic forming. The essential characteristics of this class of electric pulse power forming is the rapid discharge of kilo-joule levels of electric energy across a pair of electrodes submerged in a suitable fluid. The resulting arc vaporizes the nearby fluid, generating a small zone of plasma with of temperature in the thousands of degrees Kelvin and correspondingly high pressure. The rapid expansion of the plasma kernel transfers energy through the fluid to the work piece by a pressure shock wave followed by the momentum of the fluid displaced by the expanding gas bubble. The gas bubble actually expands and contracts several times before it dissipates in a manner analogous to the ring-down of the current through the coil in electromagnetic forming. The majority of the deformation work is done by the first expansion just as it is mostly accomplished by the first half pulse of current in the electromagnetic case.

The initiation of the arc can be assisted by the use of a small diameter "bridge" wire placed between the electrodes. It has been demonstrated that the use of a bridge wire provides for more consistent results by producing a more repeatable arc event in position and strength. However, the use of a bridge wire also makes the process more difficult to automate. Both variations have been used in commercial electro-hydraulic forming machines. FIG. 14 is a design schematic of a electro-hydraulic forming system. The pressure shock wave carries about half the energy from the discharge. The other half of the discharge energy is carried by the kinetic energy of the moving fluid surrounding the plasma bubble. However, the fluid kinetic energy is shown to provide the majority of the usable deformation energy [Caggiano et al 1963, Ezra,1973]. Although, the pressure shock can be directed by reflectors to focus on the work piece, the energy of the fluid momentum can not be easily directed and much is dissipated against the containment structure. One disadvantage of EH forming is that its energy efficiency is much lower than EM, due in part to the basic spherical nature of the pressure wave front, which is less efficient than a plane wave in most applications. The efficiency of electro-hydraulic forming is dependent on several system parameters and is generally given as 5–10% for most applications with a maximum of 15%.[Bruno, 1968].

An allied method, similar to electro-hydraulic should be briefly described here for completeness. This method, termed Shock Tube Hydraulic, the deformation energy is transferred to the work piece by the action of pressure shock and fluid momentum as in electro-hydraulic. The difference lies in the manner in which the pressure shock wave is generated and the proportion of the total energy contained in fluid momentum. In Shock Tube Hydraulic, the shock wave is generated by the rapid repulsion of a conducting driver plate with one side in contact with the working fluid, from a fixed coil conductor carrying the discharge current. A tube surrounding the driver plate and coaxial with its velocity serves to direct the fluid energy to a specific area. A schematic of one possible design of a shock tube assembly is shown in FIG. 15. FIG. 15 shows coil 160, driver plate 161, bellows 162, vacuum chamber 163, guide tube 164, die surface 165 and metal sheet 166. The basic effectiveness of this method has been demonstrated by the hydrodynamic equivalent method of a drop hammer on a water column. The use of a shock tube generated pressure pulse was also shown to be more than twice as energy efficient as compared to electro-hydraulic forming methods [Vafiadakis et al 1965]. It is not known whether the electromagnetic version of the shock tube hydraulic presented here has been reduced to practice to date.

Electro-hydraulic systems were investigated by several of the US. auto makers, but considered to be too slow for even limited production on the smaller parts that the machines of that time could handle. Further, there were process control problems with these machines which further reduced the attractiveness to highly cost competitive, high volume industries.

During the 1960's, a decade before the Oil Crisis, there was not a strong interest in fuel savings from the weight reduction available with aluminum auto bodies. Without a serious need for the improved forming of aluminum alloy sheet or the general extended plasticity provided by the high velocity methods, the auto industry of the sixties had no inclination to seek solutions to the short comings of the high velocity forming processes in wide spread use by aircraft manufacturers.

The aerospace industry continues to utilize all of the high velocity forming methods to some extent, including electro-hydraulic. However, in recent years the electro-hydraulic process has been largely supplanted by improved fluid pressure forming systems. This is due, in part, to the fact that the size capacity of most electro-hydraulic machines were similar to the new fluid pressure forming systems. Further, the tooling for a quasi-static pressure process is lighter and often less expensive since it does not need to withstand the shock loading inherent in the electro-hydraulic process. The newer fluid pressure forming systems have increased peak pressure and reduced cycle time while improving the process repeatability by computerized pressure profile control. In contrast, there has not been any further improvements to the electro-hydraulic machines since the early 1970's. Consequently, electro-hydraulic forming is used in new applications by aerospace fabricators principally for parts which require higher peak forming pressures than the quasi-static fluid forming systems can generate. [Rorh Corp.]

The high velocity methods of sheet forming are the least common of the methods described herein. Table 1.1 is therefore provided as a summary of the past applications of these methods to forming of sheet metal stampings.

TABLE 1.1

Matrix of electrically driven, high velocity forming processes and sheet metal part type

| | Part Type* | | | |
|---|---|---|---|---|
| Process | Shallow Pan | Deep Draw | Drape Form | Tube Form |
| EM electro-magnetic coils good conductor work pieces | -commonly done -male or female tools non-conducting best -repeatability good -medium-high production | -not done muti-shots difficult due to rapid decrease in energy transfer with sheet deform. | -uncommon to-date -male tools conductors OK -repeatability OK -medium production | -very common male or female tools low conducting best repeatability good -assembly operations -high production |
| CEM coil-less electro-magnetic good conductor work pieces | -new, promising -male or female tools non-conducting best -medium-high production | -new, not practical muti-shots difficult due to rapid decrease in energy transfer with sheet deform. | -new, not practical muti-shots difficult due to rapid decrease in energy transfer with sheet deform. | -new, patents awarded -male or female tools -assembly operations -high production |
| EH electro-hydraulic no con- | commonly done -male or female tools conducting OK | -less common -female tools, con- | not practical | -most common -female tools only |

TABLE 1.1-continued

Matrix of electrically driven, high velocity forming processes and sheet metal part type

| Process | Part Type* Shallow Pan | Deep Draw | Drape Form | Tube Form |
|---|---|---|---|---|
| ductivity restrictions on work | -repeatability problem -medium production | ducting OK -repeatability problem -low production multi-shots | | conducting OK -repeatability OK -low to medium production to-date |
| EHS electromagnetic hydraulic shock tube no conductivity restrictions on work | -possible -male or female tools conducting OK -repeatability OK -medium production | -possible -female tools, conducting OK -low production multi-shots | not practical | -possible -female tools conducting OK -repeatability OK -medium production |

*Part type descriptions: (informal)

Shallow Pan: Parts principally stretch-formed with mostly bosses and narrow beads having depths up to approximately 15× sheet thickness Deep Draw: Parts whose depth to breath ratio and geometry require sheet to be pulled in to limit plastic strains.

Drape Form: Similar to Shallow Pan type parts but can be deeper if sides have sufficiently open angle. Completely ballistic, no blank restraint Tube Form: Parts formed by expansion or compression of simple tube section pre-forms, usually axisymmetric. Includes clinching assembly of multiple components Accordingly, it is an object of the present invention to provide improved apparatus and methods for the forming of metal work pieces, such as auto body size parts of aluminum alloy sheet. It is another object of the present invention to provide improvement in metal forming as measured, for instance, by the extent to which the new method increases the geometric forming limits of aluminum alloys in comparison to those obtainable using the prevalent commercial method of matched tool forming.

The potential advantages and disadvantages of each variation of the methods of the present invention is briefly discussed herein, along with the rational for proceeding with the MT-EM methods of the present invention.

In view of the following disclosure, other advantages of the invention, and the solution to other problems using the invention, may become apparent to one of ordinary skill in the art.

SUMMARY OF THE INVENTION

The present invention includes several variations of the apparatus of the present invention, methods of its use, and metal pieces formed using the inventive apparatus and method. Each aspect and feature of the apparatus of the present invention may be used independently of other features and aspects, as will be apparent. Also, the many embodiments of the apparatus of the present invention may be used to practice any of the variations of the methods of the present invention.

General Mechanical Mold with Integral Electromagnetic Forming Apparatus

The present invention includes an apparatus for forming a metal work piece into a target shape, the apparatus comprising: (a) a male mold portion having a mold side and a back side; (b) a female mold portion having a mold side and a back side; the mold side of male mold portion and the mold side of female mold portion adapted to mate incompletely so as to deform a work piece disposed therebetween into a precursor shape, so as to leave at least one precursor area of the work piece to be further or finally formed; (c) at least one of the mold portions comprising at least one electromagnetic actuator so as to be capable of further forming the at least one precursor area. The invention additionally may comprise: (d) a current power source adapted to produce a current pulse through the at least one electromagnetic actuator, so as to produce a magnetic field in the at least one precursor area so as to deform the at least one precursor area into a target shape.

The apparatus may be such that the at least one actuator comprises an electromagnetic actuator comprising a central current conduit, the central current conduit adapted to conduct a current pulse in a first current direction and having first and second sides, and a third side perpendicular to a direction between the first and second sides, the central current conduit divided into at least two return current conduits, at least one of the at least two return current conduits extending along a first and second side of the central current conduit and adapted to conduct the current pulse in a second direction to an electrical ground. Preferably, the magnetic field is stronger in the center portion of the at least one precursor area than in the side portions of the at least one precursor area.

The apparatus of the present invention may be such that the central current conduit and the at least two return current conduits have at least one of the following characteristics: (1) the central current conduit and the at least two return current conduits are substantially coplanar, (2) the at least two return current conduits form substantially planar coils, (3) the central current conduit and the at least two return current conduits are linear and substantially coplanar, (4) the central current conduit and the at least two return current conduits are linear, substantially coplanar and parallel, and (5) the central current conduit and the at least two return current conduits are curvilinear and substantially parallel.

The central current conduit and the at least two return current conduits may form a substantially symmetrical work force area, or they may form an asymmetrical work force area.

The central current conduit and the at least two return current conduits also may form an elongate work force area having a longitudinal axis extending substantially parallel to the central current conduit.

Electromagnetic Forming Coil Imbedded In Resinous Material

The mold or mold portion(s) may comprise or have integrated therewith a resinous material and comprise at least one electromagnetic actuator imbedded in the resinous material, so as to be capable of further forming the at least one precursor area of the work piece. The resin is used to locate the coil, and clamps or other restraints preferably are used to keep the weaker electrically insulating resin out of a state of large tensile stress or strain, which may cause it to fracture. Preferably, the resinous material comprises metallic flakes imbedded therein. Typically, as a macroscopic property, the resin with metallic flakes should be electrically insulating, although the flake may provide local electrical conductivity.

The electromagnetic actuators of the present invention that are used in conjunction with a mold body of die typically will be both non-planar and non-axisymmetric, and are preferably dimensionally stable. Actuators of this type are particularly adapted for use along the back side of the male portions of mold bodies or die that are adapted to mechanically form the metal work piece into a precursor shape, followed by further electromagnetic forming ultimately to reach a final, complex target shape. These actuators may be hand-made, cast or machined from a block of metal, and may even be made through use of appropriate etching or milling equipment, such as laser etching equipment, that may be microprocessor controlled. Such a coil can be numerically cut from a billet, thus allowing non-specialists to produce coils. Coils may be made by hand-fabrication methods, such as by bending and brazing bars. For instance, the preferred coil material is Glidcop, an oxide dispersion strengthened copper. Glidcop is commercially available from ITT Industries.

It is also preferred that the electromagnetic actuator(s) comprise(s) opposing members, with one or more restraints across the opposing members adapted to resist movement of the opposing members when the electromagnetic actuator is supplied with current. Such restraints may be in the form of a clamp or equivalent mechanical arrangement adapted to restrict movement of the actuator members with respect to one another.

General Mechanical Mold with "Cassetted" Integral Electromagnetic Forming Apparatus Another aspect of the present invention is embodied in an apparatus for forming a metal work piece into a target shape, the apparatus comprising: (a) a male mold portion having a mold side and a back side; (b) a female mold portion having a mold side and a back side; at least one of the mold side of male mold portion and the mold side of female mold portion comprising a removable portion and adapted to mate incompletely so as to deform a work piece disposed therebetween into a precursor shape, so as to leave at least one precursor area of the work piece to be finally formed; (c) the removable portion comprising at least one electromagnetic actuator, the removable portion disposed so as to be capable of further forming the at least one precursor area. The invention additionally may comprise: (d) a current power source adapted to produce a current pulse through the at least one electromagnetic actuator, so as to produce a magnetic field in the at least one precursor area so as to deform the at least one precursor area into a target shape.

The removable portion may be used to be replaced by another removable portion that it has undergone a routine or unexpected repair operation (i.e., repair is one reason for using such cassettes), or to vary the force profile or coil arrangement where the coil cassettes are different. Thus, the apparatus may also include a secondary removable portion adapted to replace one of the at least one removable portion, the secondary removable portion comprising at least one electromagnetic actuator such that the secondary removable portion varies from the removable portion it replaces with respect to the force profile produced thereby and/or number or type of actuators or their geometry. This feature of the present invention can thus be used in restriking the same part in steps involving different EM forming steps using different actuator cassettes.

In such apparatus the male mold portion and the female mold portion may be a resinous material, preferably with metallic flakes imbedded therein, as described above. The removable portion(s) themselves may comprise such a resinous material wherein the electromagnetic actuator(s) is/are imbedded therein.

It is also preferred that the electromagnetic actuator(s) have reinforcing restraints, typically placed across opposing portions of the coil or otherwise, to resist the strain when they are supplied with current. Such restraints may be one or more clamps, typically insulated.

The present invention may use any electromagnetic actuator known in the art, or those of the types disclosed in U.S. patent application Ser. No. 08/825,777, now U.S. Pat. No. 5,860,306 which is hereby incorporated herein by reference.

Some of the important features of the present invention are that the coil generally conforms to the precursor or pre-form shape of the work piece, and creates a field to form the work piece to a subsequent precursor shape or final shape, as the case may be. Generally, the precursor shape(s) may be such that it/they is/are fabricable by traditional mechanical means, whereas the final shape (or, in some instances, subsequent precursor shapes leading ultimately to a final shape) typically can only be fabricated by the methods of the present invention.

The coil may be wound in the traditional way or it may be cut from a block of metal that may even form part of the mold body or be integrated onto the mold body; or it may be assembled from individual parts.

One of the key features of the preferred electromagnetic actuator coils used in the present invention is the splitting, and/or direction reversal, of the electrical current pulse one or more times to balance the work-coil or forming actuator. While the prior art was based on the use of concentric, unidirectional coils, the present invention makes possible the production of electromagnetic actuators that may be tailored to a wide variety of geometries, including elongated shapes. The principal benefit of such pulse splitting (and/or direction reversal) is that the actuator may produce a work-force distribution in the work-force area (that area served by the actuator) that concentrated or otherwise arranged about the center (for actuators of relatively equilateral geometry such as multi-coil or polygonal geometries) or about its longitudinal axis for elongate actuators. The actuators of the present invention do not have the disadvantages associated with prior art actuators such as discontinuous work-force distributions, such as those brought about by concentric, unidirectional coils of the prior art.

Generally speaking, the magnetic field produced by actuators of the preferred electromagnetic actuator coils is relatively stronger in the relative center portion of the work-force area than in the relative side portions of the work-force area. In this regard, reference to "relative center" and "relative sides" is intended in a general sense, intending to refer to the magnetic field produced by actuators of the present invention, whether the actuator has one or several degrees of symmetry. The central current conduit and the at least two return current conduits may form a substantially symmetrical or asymmetrical work-force area, although the size and shape of the work-force area may be determined according to the desires of the operator and the requirements of the work piece to be formed, as shown by the examples provided herein.

In broadest terms, the apparatus of one embodiment of the present invention includes an apparatus for forming a metal work piece, which comprises: (a) an electromagnetic actuator comprising a central current conduit, the central current conduit adapted to conduct a current pulse, and adapted to divide the current pulse so as to provide a divided current pulse, and a return current conduit adapted to conduct the divided current pulse to an electrical ground; and (b) a current power source adapted to produce a current pulse through the electromagnetic actuator so as to produce a magnetic field.

The cross-section of the current conduit used in the electromagnetic actuator coils may be of any geometrical shape, as exemplified in the accompanying figures and description. The invention is thus not limited to any particular geometrical shape of the cross-section, and may be selected from any desired shape such as flat, round, square or other polygonal or irregular shapes.

The apparatus of the present invention may also have a central current conduit and at least two return current conduits which have at least one of the following characteristics: (1) the central current conduit and the at least two return current conduits are substantially co-planar, (2) the at least two return current conduits form substantially planar coils, (3) the central current conduit and the at least two return current conduits are linear and substantially co-planar, (4) the central current conduit and the at least two return current conduits are linear, substantially co-planar and parallel, and (5) the central current conduit and the at least two return current conduits are curvilinear and substantially parallel. The central current conduit and the at least two return current conduits may form an elongate work-force area having a longitudinal axis extending substantially parallel to the central current conduit.

As one alternative, the central current conduit may also be adapted to divide the current pulse by being in the form of a mold body defining a mold shape against which the metal work piece is deformed. Such mold body may be in the form of mated male and female mold body portions.

The actuators of the present invention may have the central current conduit and the at least two return current conduits that form either a substantially symmetrical work-force area or an asymmetrical work-force area.

The power source may be selected from any power source capable of providing a current pulse of sufficient strength and duration to induce a work-force appropriate to form the work piece into the desired shape. Such parameters are well known to those skilled in the art. Examples include current pulses in the range of 5KA-100KA amps for times in the range of 1–100 milliseconds. For instance, the current power source may be in the form of a charged capacitor bank.

The apparatus of the present invention may also have a work piece holder to hold the work piece during forming. Such a work piece holder may be in the form of a female mold body or a male mold body defining a mold shape against which the metal work piece is deformed. The apparatus may also have a work piece holder which comprises a first half adapted to fit along a third side of the actuator (where the return conduits are on respective first and second sides) so as to hold the metal work piece between the actuator and the first half, and a second half adapted to fit along a fourth side of the actuator opposite the third side.

Any of the actuators of the present invention described herein may also be used with an apparatus for forming a metal work piece into a target shape, the apparatus comprising: (a) an male mold portion having a mold side and a back side; (b) a female mold portion having a mold side and a back side; the mold side of the male mold portion and the mold side of the female mold portion adapted to mate incompletely so as to deform a work piece disposed therebetween so as to form the work piece into a precursor shape, leaving at least one precursor area of the work piece to be finally formed; (c) at least one electromagnetic actuator disposed on one of the mold portions and opposite the at least one precursor area; and (d) a current power source adapted to produce a current pulse through the at least one electromagnetic actuator, so as to produce a magnetic field in the at least one precursor area so as to deform the at least one precursor area into a target shape.

Any of the actuators described herein may be used with the methods of the present invention.

Method Of Forming A Metal Work Piece

The present invention includes methods of forming a metal work piece.

General Incomplete Mechanical Forming+Electromagnetic Forming

One method of the present invention involves a partial mechanical forming followed by electromagnetic forming. This method involves the forming of a metal work piece into a target shape, the method comprising the steps: (a) obtaining a metal work piece, the work piece having an original shape; (b) disposing the metal work piece in a mold comprising an electronic actuator, the mold comprising: (i) an male mold portion having a mold side and a back side; (ii) a female mold portion having a mold side and a back side; the mold side of the male mold portion and the mold side of the female mold portion adapted to mate incompletely so as to deform a work piece disposed therebetween so as to form the work piece into a precursor shape, leaving at least one precursor area of the work piece to be finally formed so as to complete the target shape; (iii) at least one of the mold portions comprising at least one electromagnetic actuator so as to be capable of further forming the at least one precursor area; and (iv) a current power source adapted to produce a current pulse through the at least one electromagnetic actuator, so as to produce a magnetic field in the at least one precursor area so as to deform the at least one precursor area into a target shape; (c) closing the mold sides upon the metal work piece so as to form the work piece into the precursor shape; and (d) causing a current pulse to pass through the actuator, sufficient to produce a magnetic field of sufficient strength to deform the metal work piece from the precursor shape to the target shape.

First Incomplete Mechanical Forming, Followed by Further Mechanical+Electromagnetic Forming Another variation of the present invention involves the initial mechanical forming, followed by further mechanical and electromagnetic forming. Such a method in broad terms may be described as a method of forming a metal work piece into a target shape, the method comprising the steps: (a) obtaining a metal work piece, the work piece having an original shape; (b) disposing the metal work piece in a mold comprising an electronic actuator, the mold comprising: (i) a male mold portion having a mold side and a back side; (ii) a female mold portion having a mold side and a back side; the mold side of the male mold portion and the mold side of the female mold portion adapted to mate incompletely so as to deform a work piece disposed therebetween so as to form the work piece into a precursor shape, leaving at least one precursor area of the work piece to be finally formed so as to complete the target shape; (iii) at least one of the mold portions comprising at least one electromagnetic actuator so as to be capable of further forming the at least one precursor area; and (iv) a current power source adapted to produce a current pulse through the at least one electromagnetic actuator, so as to produce a magnetic field in the at least one precursor area so as to deform the at least one precursor area into a target shape; (c) contacting the mold sides upon the metal work piece so as to form the work piece into a first precursor shape; (d) contacting the mold sides upon the metal work piece so as to form the work piece from the first precursor shape to a second precursor shape; and (e) causing a current pulse to pass through the actuator, sufficient to produce a magnetic field of sufficient strength to deform the metal work piece from the second precursor shape to the target shape.

First Incomplete Mechanical Forming+Electromagnetic Forming, Followed by Further Mechanical+Electromagnetic Forming Yet another variation of the present invention involves the initial partial mechanical forming and electromagnetic forming, followed by further mechanical and electromagnetic forming. This method may be described as a method of forming a metal work piece into a target shape, the method comprising the steps: (a) obtaining a metal work piece, the work piece having an original shape; (b) disposing the metal work piece in a mold comprising an electronic actuator, the mold comprising: (i) a male mold portion having a mold side and a back side; (ii) a female mold portion having a mold side and a back side; the mold side of the male mold portion and the mold side of the female mold portion adapted to mate incompletely so as to deform a work piece disposed therebetween so as to form the work piece into a precursor shape, leaving at least one precursor area of the work piece to be finally formed so as to complete the target shape; (iii) at least one of the mold portions comprising at least one electromagnetic actuator so as to be capable of further forming the at least one precursor area; and (iv) a current power source adapted to produce a current pulse through the at least one electromagnetic actuator, so as to produce a magnetic field in the at least one precursor area so as to deform the at least one precursor area into a target shape; (c) contacting the mold sides upon the metal work piece and causing a current pulse to pass through the actuator, sufficient to produce a magnetic field of sufficient strength to deform the metal work piece, so as to form the work piece into a first precursor shape; and (d) contacting the mold sides upon the metal work piece and causing a current pulse to pass through the actuator, sufficient to produce a magnetic field of sufficient strength to deform the metal work piece, so as to form the work piece from the first precursor shape to the target shape.

With respect to the methods of the present invention, typically the work piece will have a shape designed specifically for additional electromagnetic forming in subsequent steps. The precursor form may be created by any traditional mechanical forming, such as during this closing action of a mold or tool/die combination. The precursor form or shape may be flat or a specially designed shape for the desired purpose and application of the present invention.

General Simultaneous Mechanical Forming+Electromagnetic Forming, Preferably Pulsed The present invention includes a method of forming a metal work piece into a target shape, said method comprising the steps: (a) obtaining a metal work piece, said work piece having an original shape; and (b) forming said metal work piece by mechanical action while simultaneously subjecting said work piece to electromagnetic forming, so as to deform said metal work piece from said original shape to said target shape.

The present invention also includes a method of forming a metal work piece into a target shape, the method comprising the steps: (a) obtaining a metal work piece, the work piece having an original shape; (b) disposing the metal work piece in a mold comprising a electronic actuator, the mold comprising: (i) a male mold portion having a mold side and a back side; (ii) a female mold portion having a mold side and a back side; the mold side of the male mold portion and the mold side of the female mold portion adapted to mate so as to deform a work piece disposed therebetween; (iii) at least one of the mold portions comprising at least one electromagnetic actuator; and (iv) a current power source adapted to produce a current pulse through the at least one electromagnetic actuator, so as to produce a magnetic field so as to be capable of deforming the work piece; (c) closing the mold sides upon the metal work piece while causing at least one current pulse to pass through the actuator, so as to deform the metal work piece from the original shape to the target shape. Preferably, the at least one current pulse comprises a series of current pulses. It should be noted that this type of pulse-forming can be used with both incompletely mated mold or tool/die combinations, and with mold or tool/die combinations that achieve a complete desired shape such that the pulse forming can be used to augment mechanical forming to a complete or final desired shape.

It should be noted that there generally are two purposes for the EM pulsing: (1) to obtain formability in excess of what is obtainable using traditional forming alone and (2) to alter the strain distribution in such a way that parts that are impossible to fabricate become fabricable. In this pulse method of the present invention, one of the principal advantages is that friction is periodically broken or reduced and this can dramatically alter the strain distribution.

One of the central features of the methods of the present invention is that by using traditional quasi-static deformation one can make a number of metal pre-shapes but forming limits impose constraints on the shapes fabricable. By including a second high velocity forming operation, one can dramatically extend the family of shapes fabricable. In addition to forming with matched tools and electromagnetic impulse, one can use quasi-static fluid pressure forming with a fluid shock wave. The use of hydro-forming with electro-hydraulic forming is one such way of doing this. Other variants of this and details of how this may be implemented would be obvious to one skilled in the metal forming arts, in light of the present disclosure.

It will be understood from the examples of the present invention given below that the actuator coils of the present invention may be of any geometry generally described herein. Accordingly, the actuator coils of the present invention may be of any regular or irregular geometry, such as forming such shapes as circular, ovoid, polygonal spirals. In accordance with the present invention, the actuator coils of the present invention may also be in the form that includes branching of multiple coils, as shown in the examples.

BRIEF DESCRIPTION OF THE DRAWINGS

FIG. 2 is a plan view of an actuator coil that may be used in accordance with one embodiment of the present invention.

FIGS. 3 and 3B are plan views of another actuator that may be used in accordance with one embodiment of the present invention.

FIG. 7 is a computer-generated simulation of a sheet forming problem.

FIG. 18 shows a graphic representation of a one dimensional model illustrating the basic effect of mass inertia on the extended ductility at high deformation velocities.

DETAILED DESCRIPTION OF THE PREFERRED EMBODIMENTS

Figure 1:
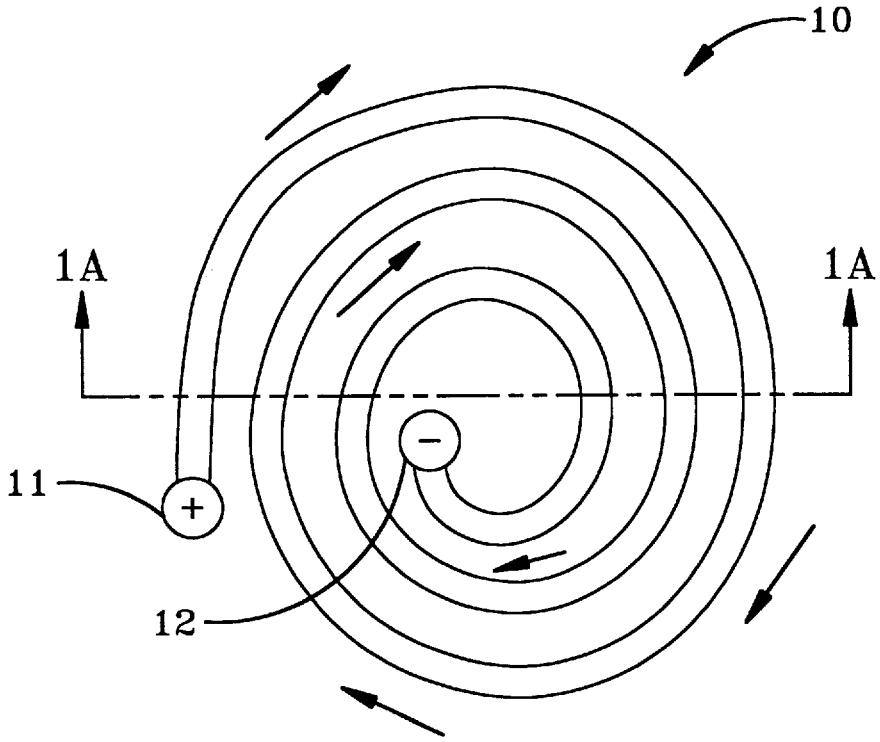
FIG-1 PRIOR ART
FIG. 1 is the plan view of an actuator coil in accordance with the prior art that may be used in accordance with one embodiment of the present invention.

In accordance with the foregoing summary, the following presents several examples of actuators of various geometries which are considered to be the best modes of the invention for the embodiments they represent.

Actuators That May be Used in Accordance with the Present Invention

Three example applications of the electromagnetic forming actuator have been built and tested for experimental purposes.

FIG. 2 shows a plan view of an actuator in accordance with one embodiment of the present invention.

FIG. 2 shows schematically the primary or simplest geometry for an actuator 20 of the present invention, consisting of three straight prismatic bar conductors of the same cross section, i.e., 0.375 by 0.750 inch. FIG. 2 shows central conduit 21 which is split to form return conduits 22 and 23 substantially parallel thereto. The conduits 21, 22 and 23 are mounted co-planar on the 0.375 inch sides and parallel on the 0.750 inch sides with a 0.375 inch separation between conductors. The structural and electrical connection is made at one end of the assembly by a through bolt using separation spacers of the same bar stock (not shown). The other end of the assembly is connected by right angle conductor pieces, to the double buss bar of the capacitor bank (not shown). The longer center conduit 21 is connected to the positive buss and the two shorter return conduits 22 and 23 are connected to the negative buss. Current direction is indicated by arrows 24 and the polarity indicated by the plus (+) and minus (−) signs. The total assembly length is approximately twenty (20) inches. The central twelve inches of the actuator is surrounded on three sides by a aluminum support channel (not shown) which reacts to the repulsive forces generated between the conducting bars of the actuator. The support channel is insulated from the actuator by 0.125 inch thick polycarbonate sheet. The top side of the actuator is flush with the top of the support channel assembly and covered by a 0.010 inch thick sheet of Mylar to insulate the actuator assembly from the work piece sheet which is placed atop the assembly. In this embodiment, the form tool for the test is then positioned on the test sheet centrally over the actuator assembly and weighted down with several heavy, one inch thick rubber pads prior to discharging the capacitor bank. It is also possible to incorporate such an actuator into a mold body by using a central conduit and a single return conduit in the form of a conductive body that surrounds the central conduit on two or three adjacent sides, leaving a side to face the work force area. In such an embodiment, the current pulse is "split" by being diffused into the mass of the single return conduit in at least two divergent directions, ultimately returning to the negative bus.

Figure 2A:
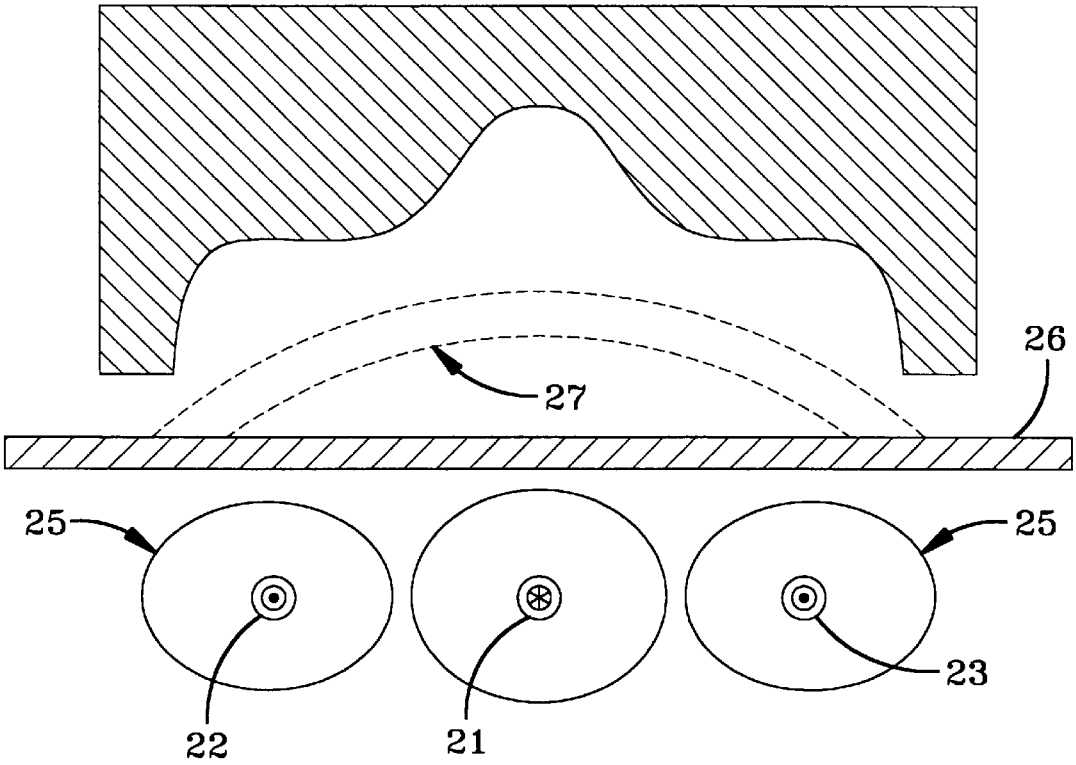
FIG. 2A is a cross-section of the actuator coil of FIG. 2 shown juxtaposed with a work piece and a forming die, that may be used in accordance with one embodiment of the present invention.

FIG. 2A shows a cross-sectional view of the actuator 20 taken along line 2A—2A of FIG. 2. FIG. 2A shows a cross section of central conduit 21 and return conduits 22 and 23. FIG. 2A also shows a general indication of the magnetic force distribution as indicated by magnetic force lines 25. FIG. 2A shows that the maximum displacement would not be effected in a work piece 26 as reflected by the magnetic force lines 25 when attempting to deform the work piece 26 as indicated by dotted lines 27. FIG. 2 also shows die 28 against which the work piece 26 may be formed (as may be the case with any of the embodiments of the present invention shown in the drawings).

An alternative embodiment, a coil assembly similar in construction to that of FIG. 2 is constructed, except that its working length is forty inches, has a face width of 1.5 inches and is curved in a plane perpendicular to the working face, to form a 120 degree included angle with a six inch radius at the angle apex. The coil is mounted in a plywood housing consisting of a sandwich of four thicknesses of 0.75 inch (nominal) finish grade interior plywood which is contoured to match the coils curvature. The coil is supported by the two center sheets of plywood which also react the primary pressure pulse generated by the coil. The two outer plywood sheets extend up along the sides of the outer coil conductors to react the separation forces between the three coil conductor and are contoured to be approximately flush with the working face of the coil assembly. The plywood sheets held together by several through bolts which also provide clamping pressure to secure the coil assembly in the channel formed by the shorter center sheets and longer outer sheets of plywood. The form tool is clamped in a similar way in a plywood laminate assembly which forms a conjugate to the coil holder. The coil holder and tool holder are held together during forming by four threaded tie rods, nuts and simple, straight angle iron tie brackets. The assembled coil half and tool half form a rectangular plywood block approximately 24 by 36 inches and 3 inches thick. This experimental electromagnetic forming tool accepts a 40 inch long aluminum strip up to 6 inches wide and forms it into a 120 degree angle bracket with an integral stiffening rib along the center. The center rib has a cross-sectional shape defined by the form tool mounted in the upper plywood housing. Both stretch ribs (outside of the bracket) and compression ribs (inside of the bracket) can be formed by selecting the proper plywood halves to mount the coil and the form tool.

Figure 3:
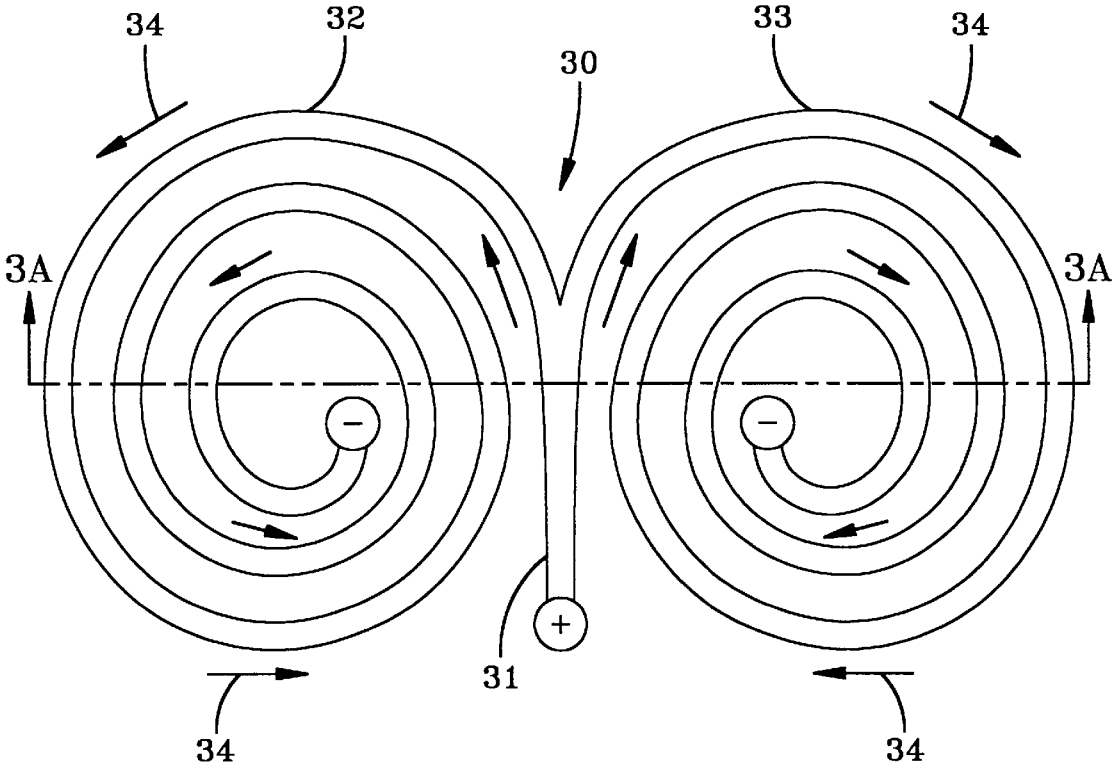

FIG. 3 shows actuator coil 30 which has central conduit 31 which splits into two return conduits 32 and 33 which form inward turning coils. These coils may be co-planar with the return conduit and preferably are co-planar with the exception that the straight portions extending from the interior of each coil toward the negative (–) pole are shown as extending below the plane of the coils of the return conduits 32 and 33. The conduit 31 is connected to the positive bus and the return conduits 32 and 33 are connected to the negative bus. Current direction is indicated by arrows 34.

Figure 1A:
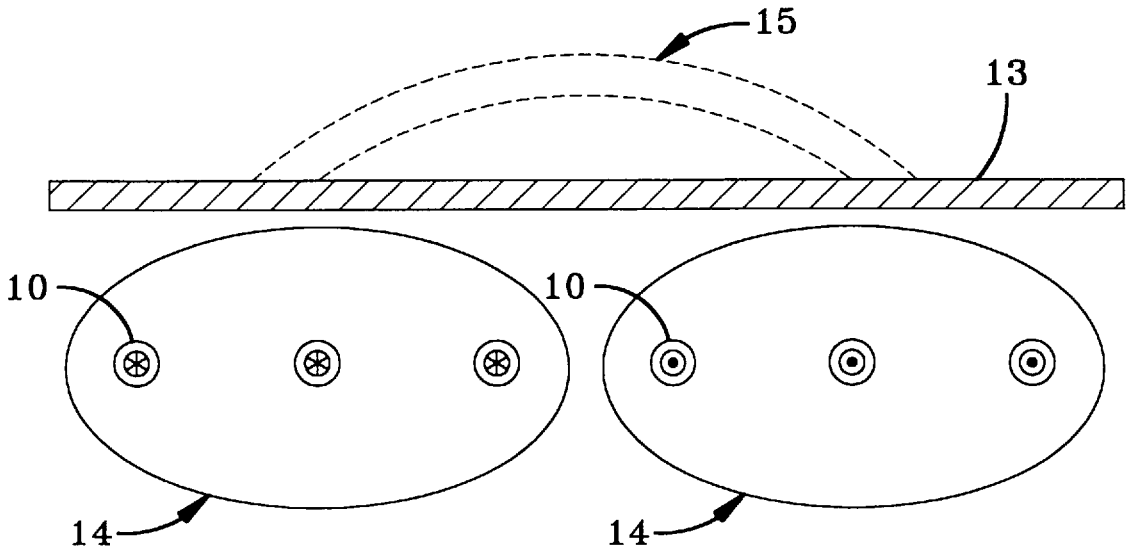
FIG-1A PRIOR ART
FIG. 1A is a cross-section elevation of an actuator coil shown in FIG. 1 shown juxtaposed with a work piece, in accordance with the prior art.
Figure 3A:
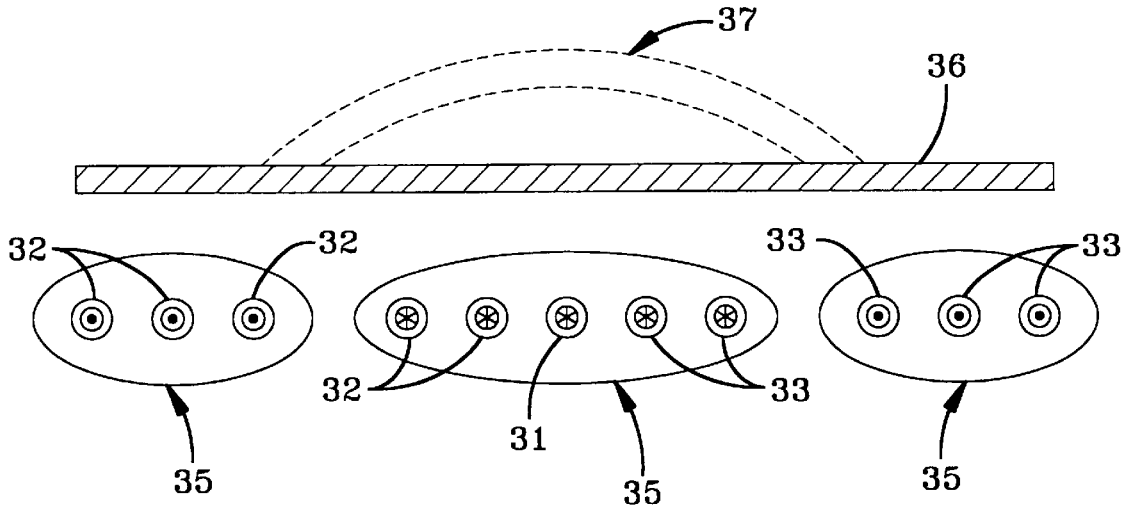
FIG. 3A is a cross-section of the actuator coil in accordance with FIG. 3 shown juxtaposed with a work piece.

FIG. 3A shows a cross section taken along 3A—3A of FIG. 3. This Figure shows central conduit 31 and portions of return conduits 32 and 33. The magnetic field produced in the work-force area is indicated by general magnetic field lines 35. FIG. 3A shows that the maximum displacement would be effected in a work piece 36 when attempting to deform the work piece 36 as indicated by dotted lines 37. As in FIG. 1A and 2A, FIG. 3A indicates the direction of current flow by a single dot to indicate current flow out of the plane of the paper as presented to the reader while an asterisk design (*) indicates current flow into the plane of the drawing as viewed by the reader. Also, the work force area is that area generally perpendicular to the plane defined by the dotted lines and above (or below, as the case may be) the actuator indicated by the position of the work pieces in these Figures.

Figure 4:
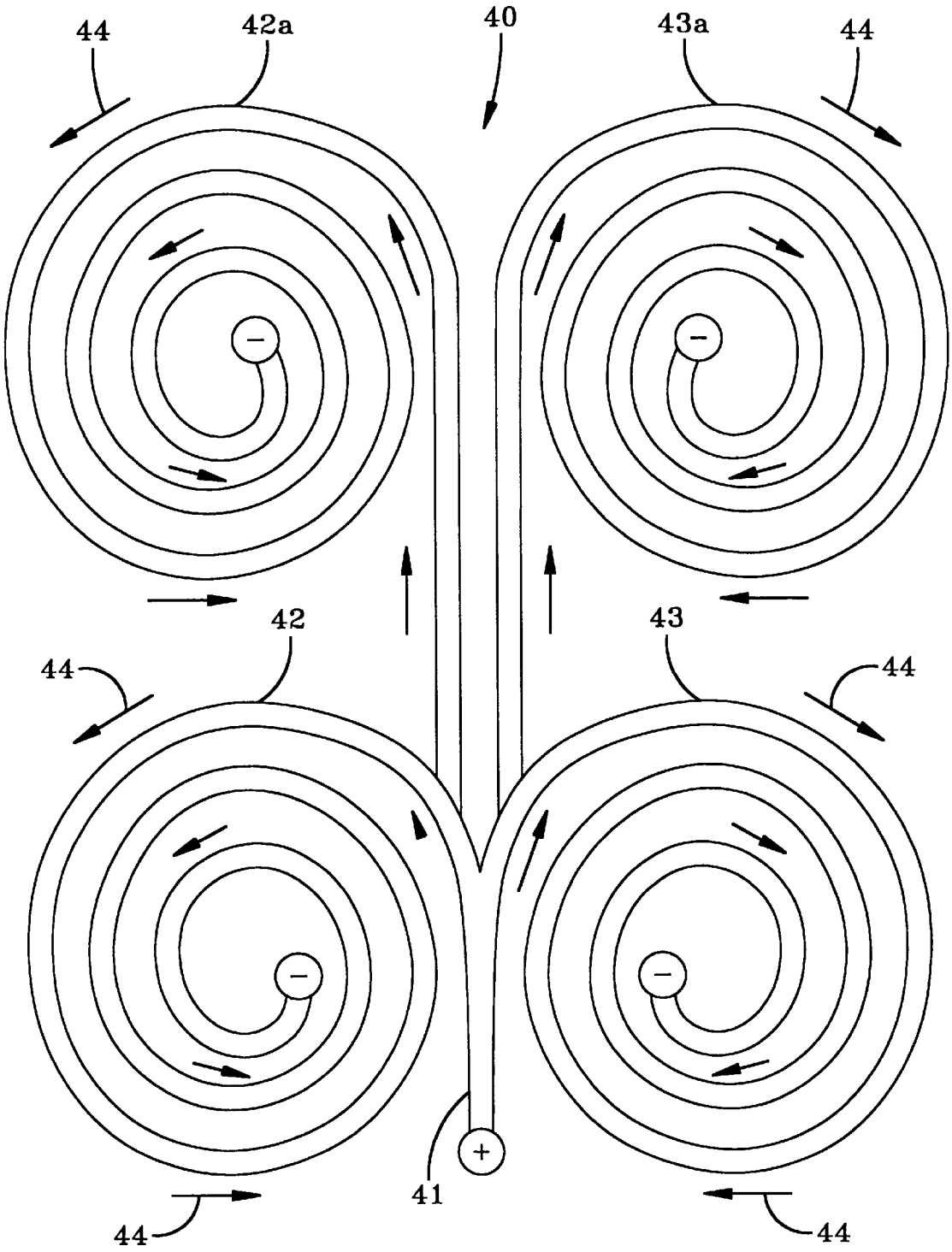
FIGS. 4 and 4A are plan views of yet another actuator coil that may be used in accordance with one embodiment of the present invention.
Figure 4A:
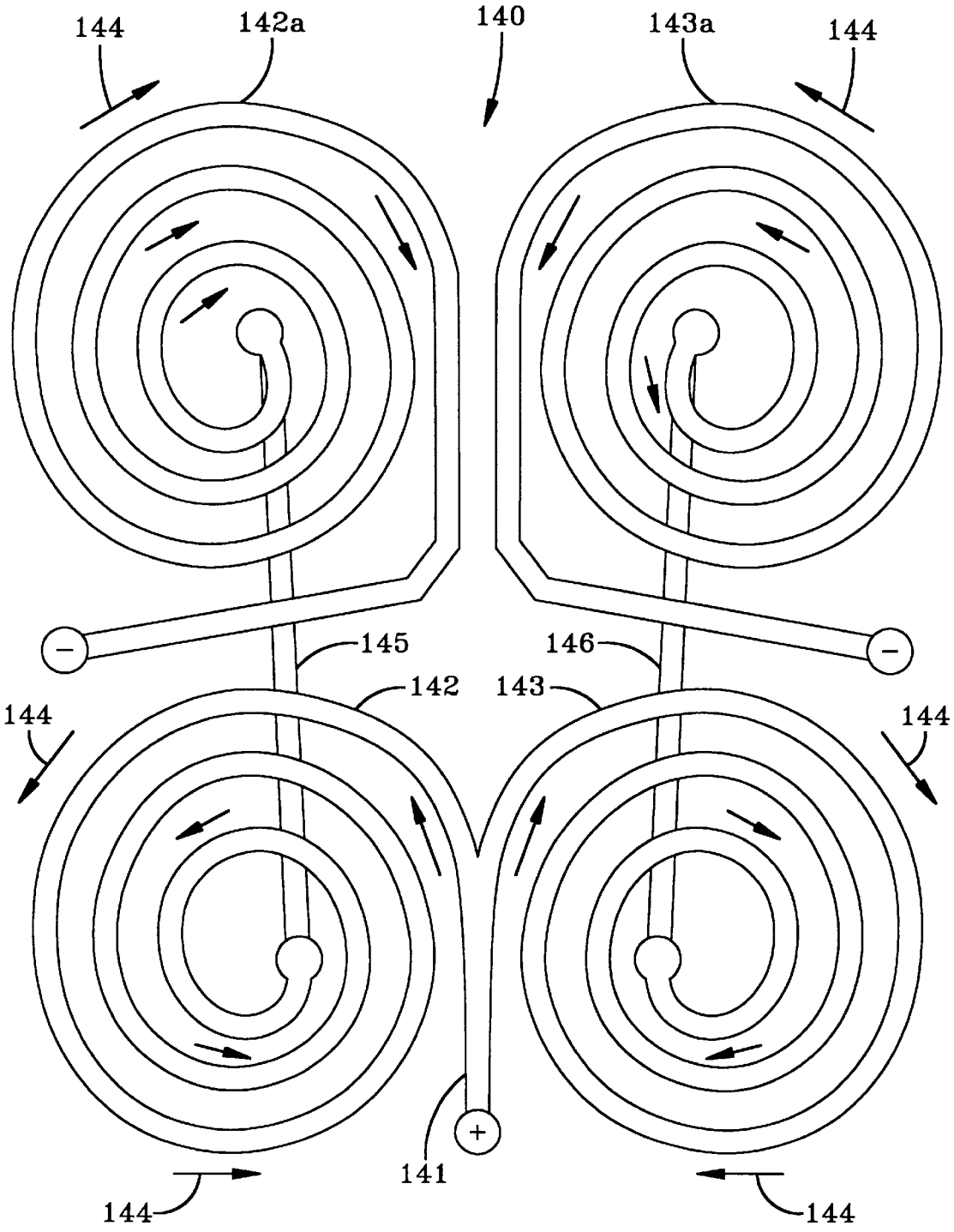

FIG. 4 shows yet another alternative embodiment of a geometry of an actuator coil in accordance with the present invention. FIG. 4 shows an actuator coil 40 comprising central conduit 41 which is split twice to form return conduit coils 42, 43, 42*a* and 43*a*. In this embodiment all four return coils are shown as being co-planar with the straight portions extending toward the negative bus from the interior of each coil extending below the plane of the four return coils. Such an embodiment gives a greater work force area but maintains the maximum displacement through the center of the work force area similar to the field shown in FIG. 3A as described above.

Figure 5:
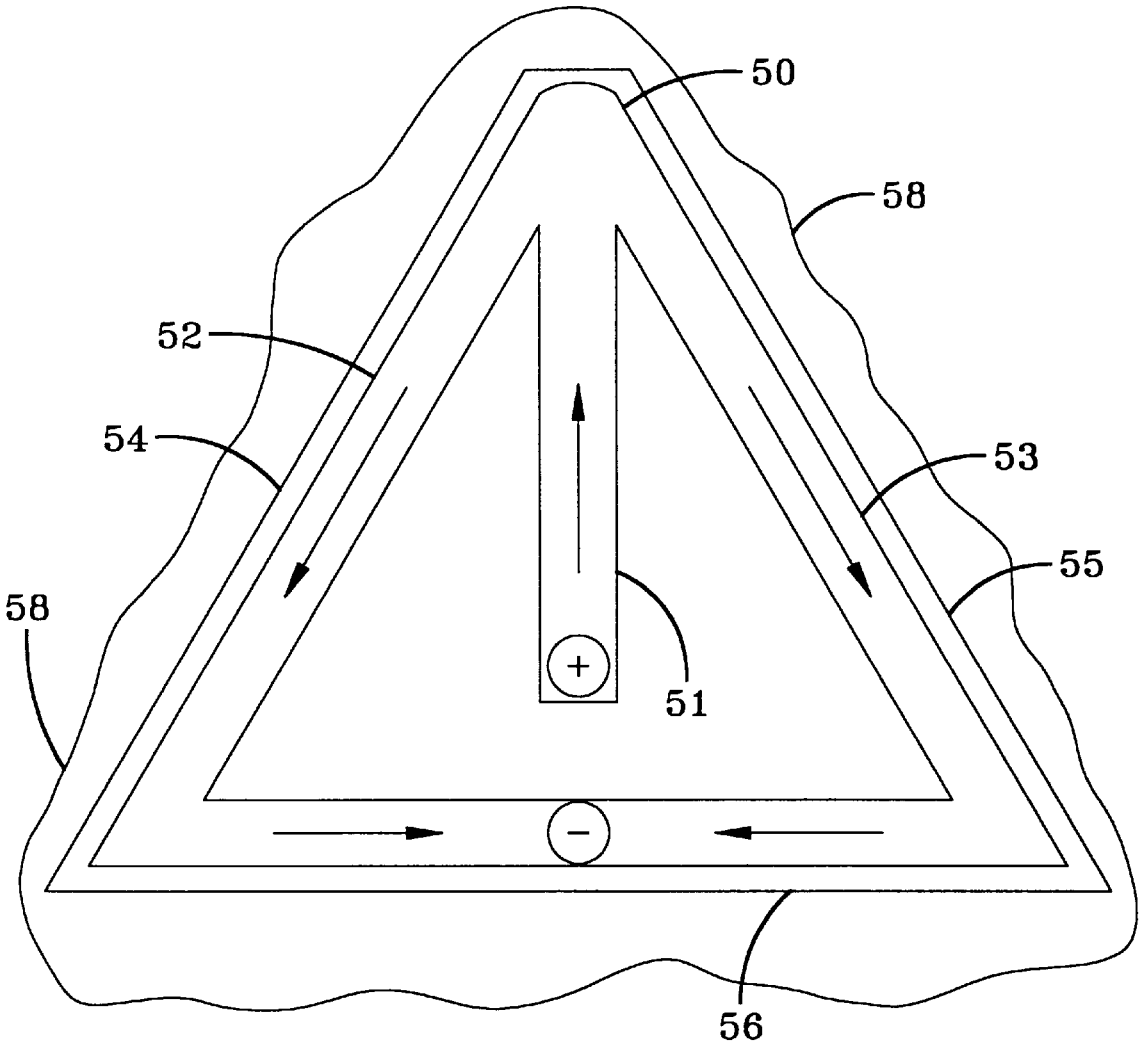
FIGS. 5 and 5A are plan views of yet another actuator that may be used in accordance with one embodiment of the present invention.
Figure 5A:
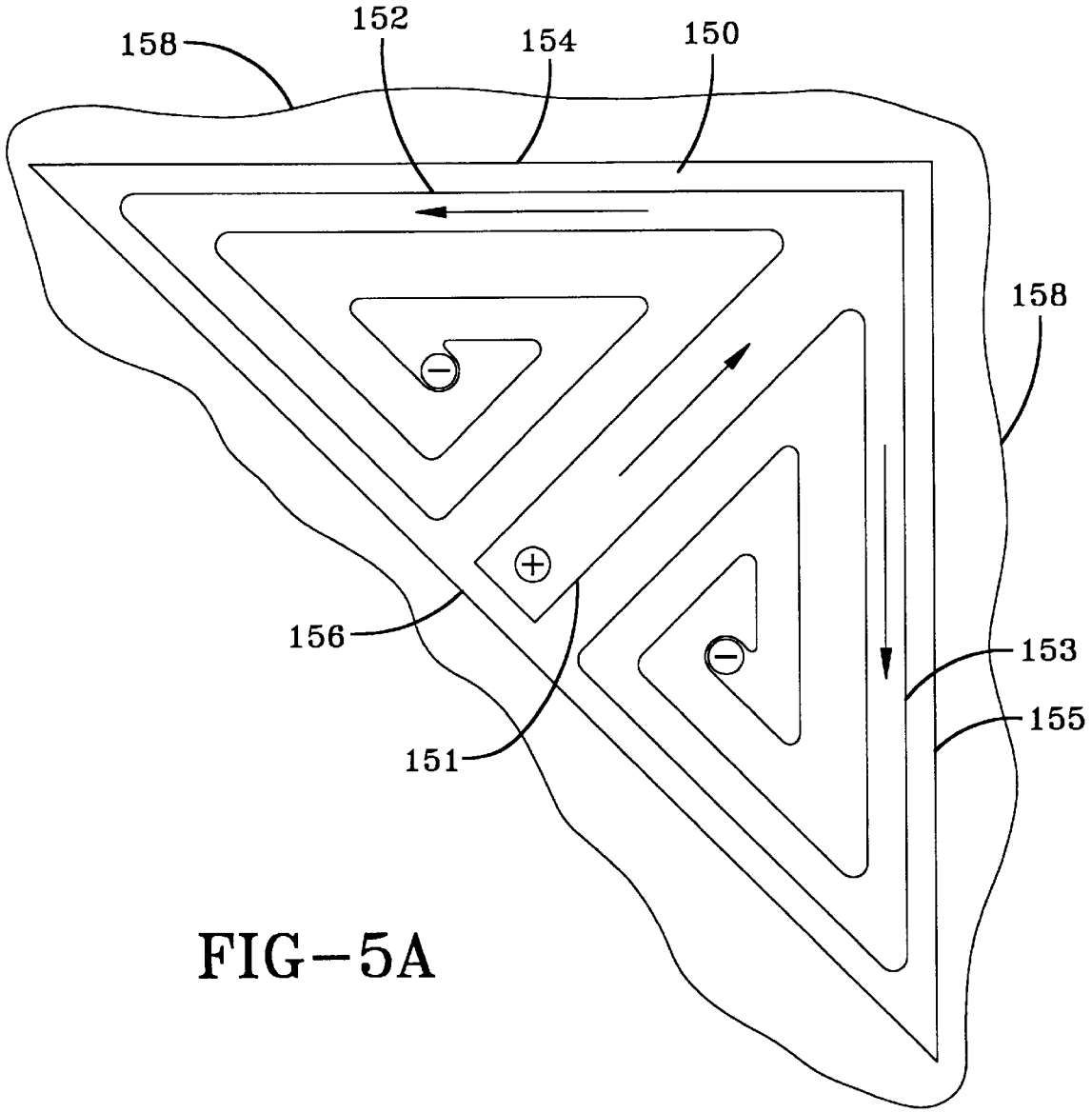

Yet another coil follows the fundamental principle of the present invention, that of splitting the pulse current in order to generate a magnetic field having a central high flux area. Such a coil is shown in plan view in FIG. 5. In this embodiment, the work piece is to be formed so as to have an asymmetric bulge, 1.5 inches high and having an approximately isosceles triangular plan with two 6 inch edges 54 and 55 and one 7 inch edge 56. The coil for this shape was constrained to lie entirely within the plan view of the bulge. The coil 50 was cut in one piece from a 0.375 inch thick copper plate. The central conduit 51 of the coil is about 0.500 inch wide and bisected the angle between the 6.0 inch edges 52 and 53 starting at the 7.0 inch edge. Just short of the apex the conductor branched forming separate legs running parallel to each 6.0 inch plan edge. At the 7.0 inch plan edge the return conduits 52 and 53 turn back toward the central conduit along a line parallel to the 7.0 inch edge. The legs approach the within 0.375 inch of the central conduit 51 and then turn parallel to it. Each return conduit essentially forms a 270 degree coil within itself maintaining a 0.375 spacing from the outer loop.

The input and output leads are brazed at the ends of the branch legs and start of the central leg and are perpendicular to the plane of the coil. The coil was imbedded into a 3.0 inch thick layered plywood base 58 such that the face of the coil was flush with the top plywood sheet surface and the brazed lead bars extended from the bottom. Four straight legs supported the coil-base assembly at the proper height above the buss bars to allow unstrained connection of the lead bars to the busses with bolted angle bracket connectors. A female form tool (not shown) was positioned and secured by two tie rods running through the assembly outside of the test blank nesting area. The tie rods also provided the work piece clamping force required to restrain sheet draw-in and flange wrinkling.

Figure 6:
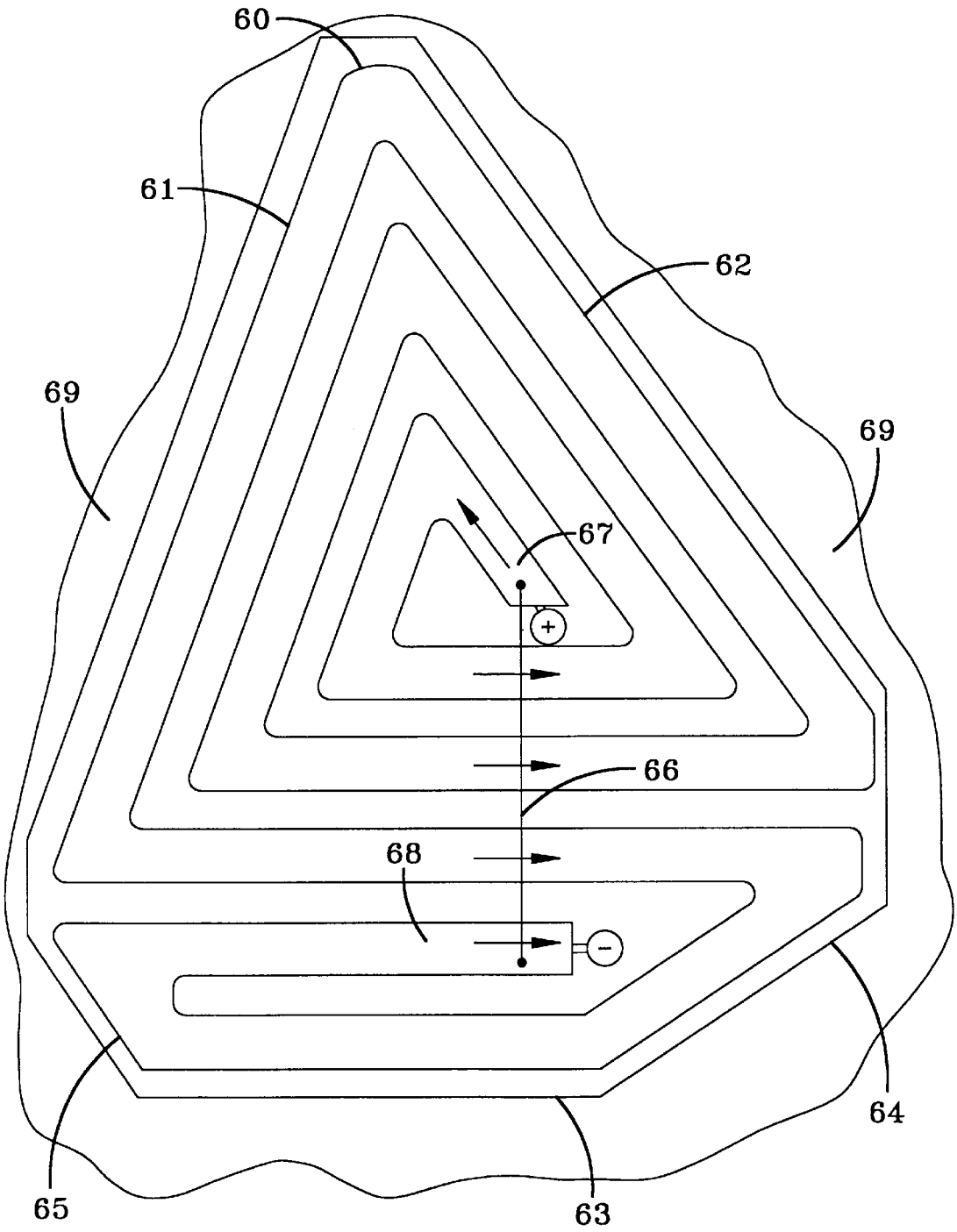
FIG. 6 is a plan view of yet another actuator coil that may be used in accordance with one embodiment of the present invention.

FIG. 6 shows still another coil 60 following another fundamental principle of the present invention, that of reversing the direction of the pulse current in the plane of the actuator coil in order to generate a magnetic field having a central high flux area. The piece to be formed by this actuator coil was to have an asymmetric bulge, 1.5 inches high and having an approximately equilateral triangular plan with 6 inch edges 61 and 62, with one side further bordering upon the longest side of a trapezoidal shape having a long side of about 6 inches, a shorter opposing side 63 of about 4 inches and lateral sides 64 and 65 of about 2 inches. The coil was constrained to lie entirely within the plan view of the bulge. The coil was cut in one piece from a 0.375 inch thick copper plate. As can be appreciated from FIG. 6, this coil provides that the pulse (indicated by the directional arrows) running through those portions of the coil intersecting a line 66 between the input lead 67 and the output lead 68 are substantially parallel, causing there to be generated a magnetic field having a high flux in this central area (i.e., one that is substantially uninterrupted by zones having little or no flux).

The input and output leads are brazed at the ends of the branch legs and start of the central leg and are perpendicular to the plane of the coil. The coil was imbedded into a 3.0 inch thick layered plywood base 69 (as may any actuator coil of the present invention) such that the face of the coil was flush with the top plywood sheet surface and the brazed lead bars extended from the bottom. Four straight legs supported the coil-base assembly at the proper height above the buss bars to allow unstrained connection of the lead bars to the busses with bolted angle bracket connectors. A female form tool (not shown) was positioned and secured by two tie rods running through the assemble outside of the test blank nesting area. The tie rods also provided the work piece clamping force required to restrain sheet draw-in and flange wrinkling.

To illustrate the advantages of the present invention over the prior art, the stresses in electromagnetic forming and the velocity vs. Time profiles have been accurately predicted for expanding ring experiments using solenoid coils. Computer codes that can model more complex two dimensional problems are also available. CALE, a "C" language based code, originally developed at Lawrence Livermore National Laboratory as an astrophysics code, is now being used to model these forming processes and the subsequent material response. FIG. 7 shows an example of a CALE simulation of a sheet forming problem. A flat spiral coil is used to form a clamped metal sheet. The irregular lines indicate lines of magnetic flux around the current-carrying elements (shown in cross section) in the simulation. Two views from the simulation are shown as they would be at 90 and 300 microseconds. It is observed that the deformation begins at the edges of the sheet and progresses towards the center. The predicted time-profile of the deformation agrees with the profile obtained with a high speed camera in a real experiment reported by others under similar conditions. CALE accurately simulates the trajectory and profile of the deforming sheet metal work piece.

Figure 8:
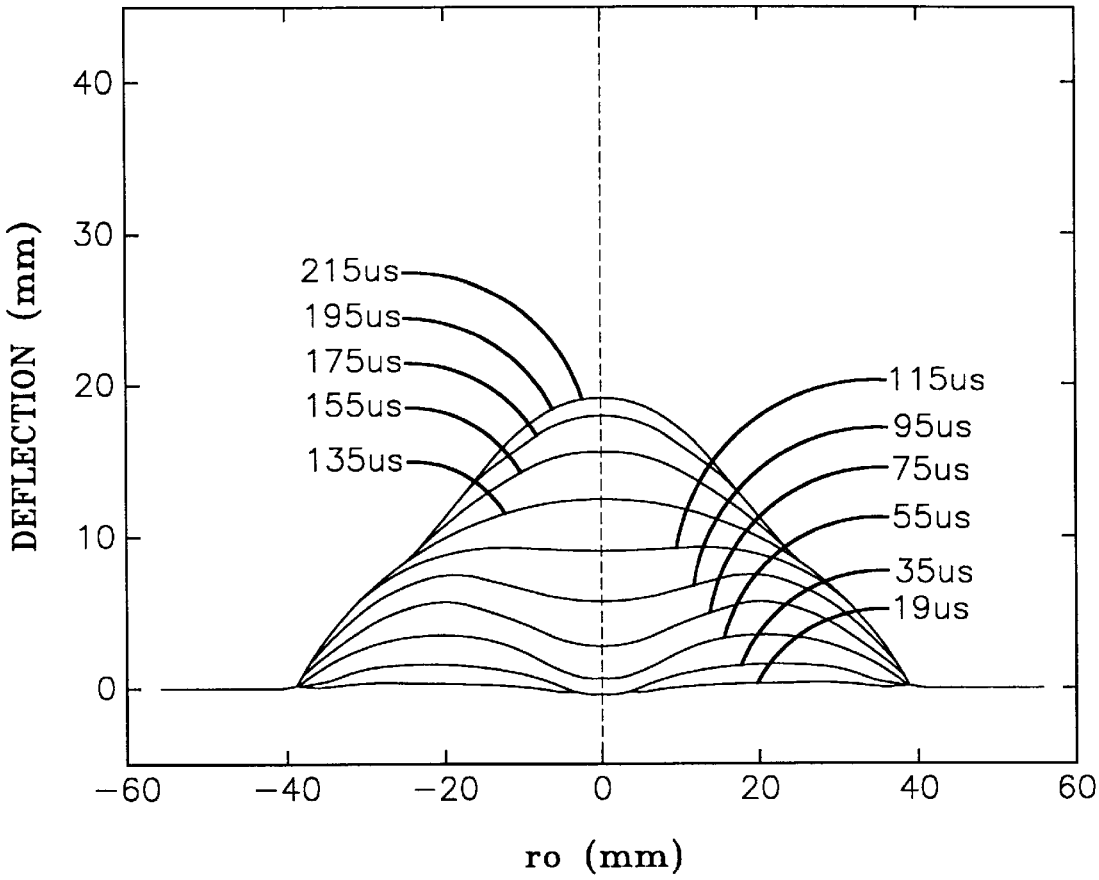
FIG. 8 shows a profile of a deforming sheet metal work piece.

FIG. 8 shows a profile of the sheet through the deformation process simulated in FIG. 7.

Though there are no fundamental limitations to the size of the parts that can be made by electromagnetic forming in accordance with the present invention, larger parts require more energy which translates into larger capacitor banks and higher initial capital expenditure. As a result, hybrid forming processes are also being considered where electromagnetic and electrohydraulic forming may be used in such a hybrid process. Accordingly, the present invention may also be used in a matched tool set with electromagnetic coils built into sharp corners and other difficult-to-form contours, to form such parts. The matched tools would form the parts of the work piece which can be easily formed at low velocities using mechanical energy from the press. This semi-formed work piece would then be subjected to high rate forming with the electromagnetic coils to complete the forming operation. A schematic of such a process is shown in FIG. 9.

Figure 9:
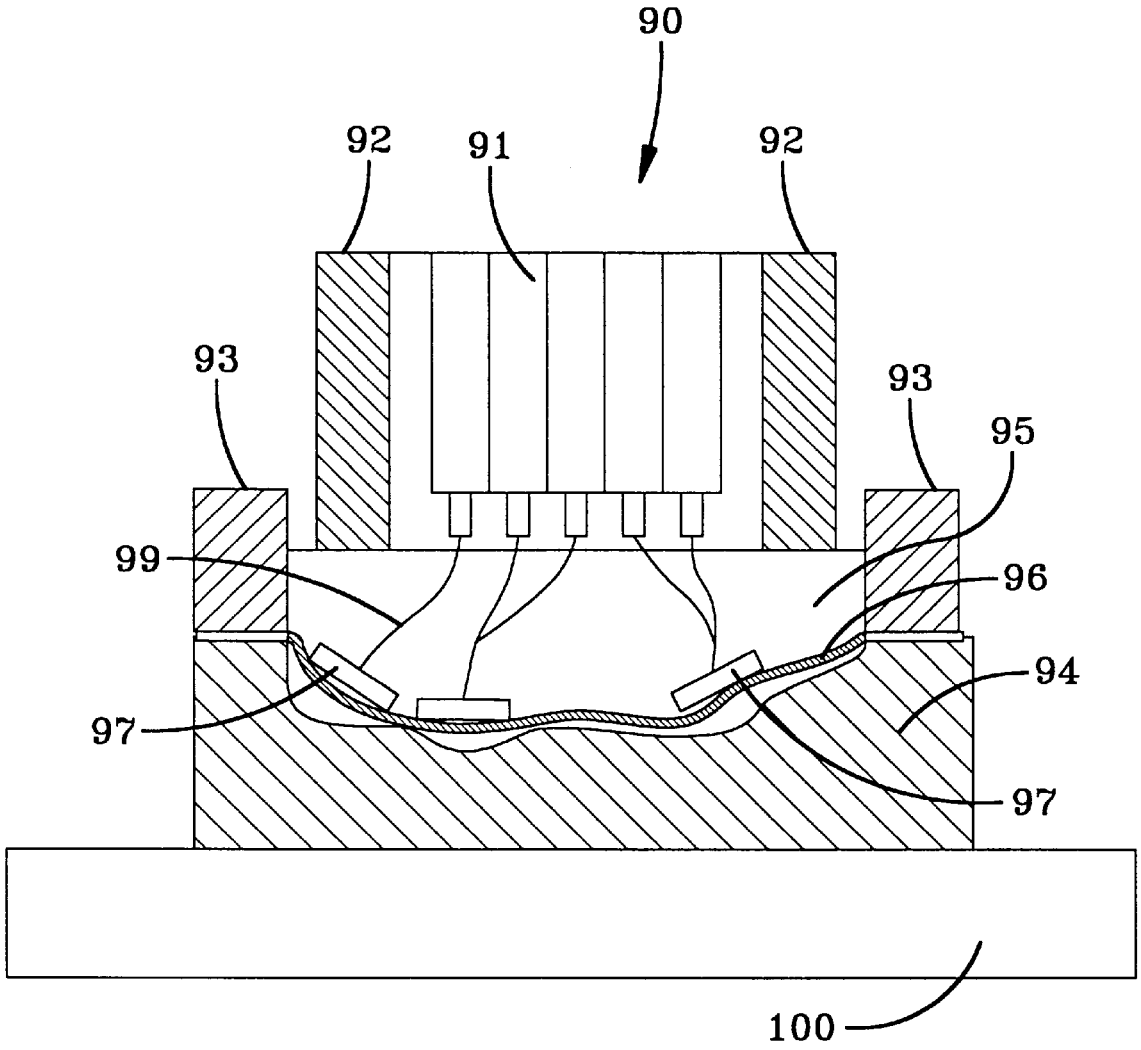
FIG. 9 shows a schematic of a hybrid matched tool-electromagnetic forming apparatus in accordance with one embodiment of the present invention.
Figure 10:
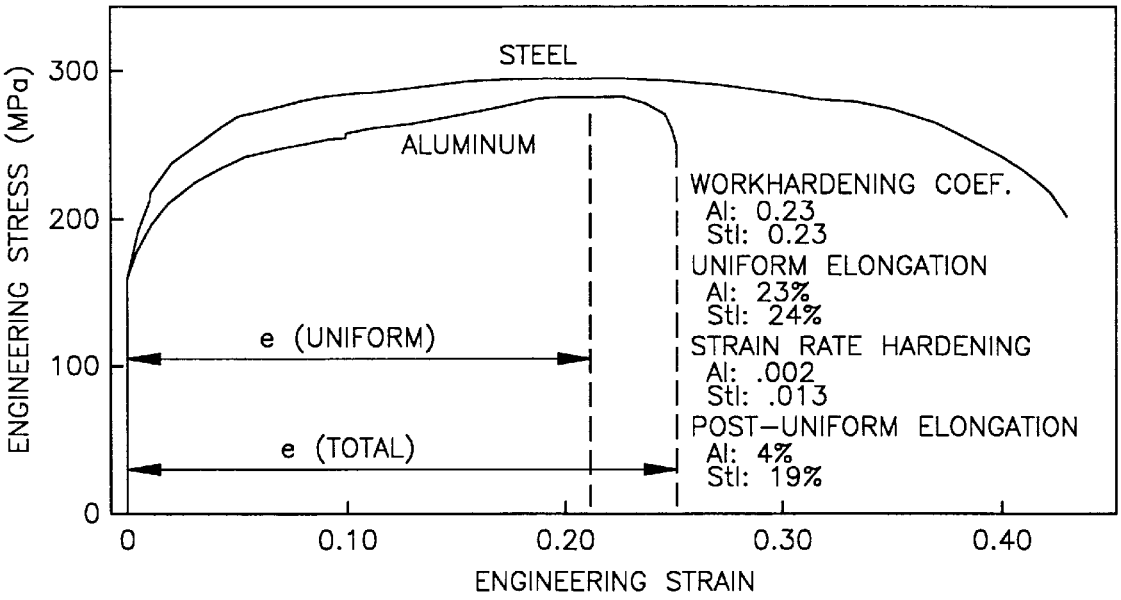
FIG. 10 shows a typical stress-strain curves for steel and aluminum auto body sheet.
Figure 11:
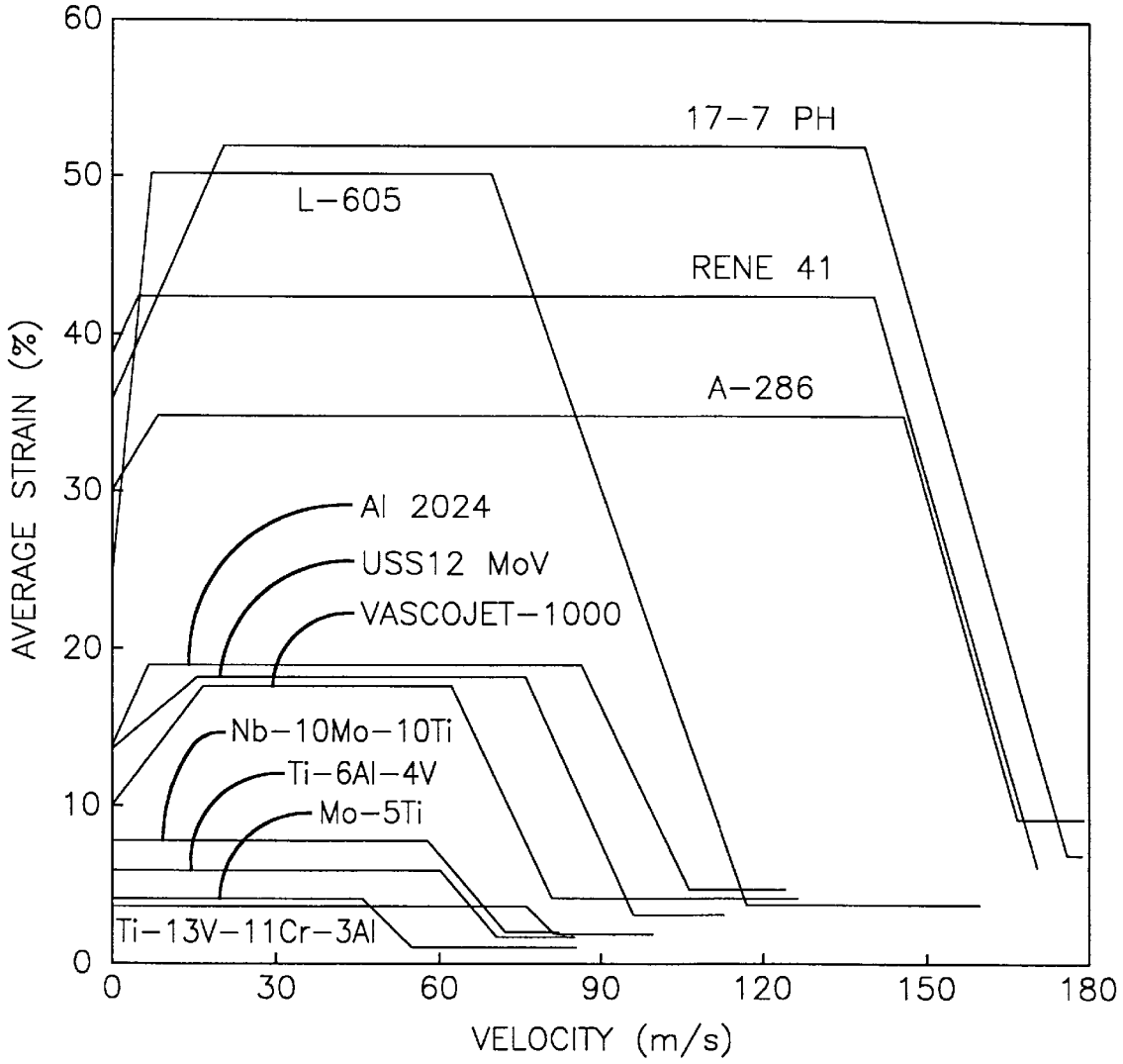
FIG. 11 shows a graph of average strain vs. pole velocity for electro-hydraulic dome expansion.

FIG. 9 shows hybrid matched tool-electromagnetic forming apparatus 90 including capacitor bank 91, inner ram 92, outer ram 93 with blank holder and die 94 (on press bolster 100. Stage 1 punch 95 partially forms work piece 96 leaving one or more portions partially formed. The actuator coils of the present invention, such as 97, powered by coaxial power distribution lines 99, may then be applied to fill out the remaining portions (indicated by voids such as 98), to reach the final desired shape of the work piece. Similarly, a quasi static, fluid pressure process with an electrical discharge in the fluid at the end of the pressure cycle to form the sharp corners and bends could represent another embodiment of the hybrid method of making difficult parts.

Industrial Applicability

Actuators of the present invention may find application in many industries that involve the formation of shaped metal pieces, such as in the making of parts for the automobile industry and the boating industry. Other applications may be found in the making of specially shaped parts in a wide variety of other industries as well.

Example of Applicability of the Inventions to Automotive Part Forming

If it is accepted as a primary motivation that the automotive industry is committed to reducing the weight of passenger automobiles by the extensive use of aluminum, then the specific character of the problem can be defined and potential solutions investigated.

For example any forming method proposed must be basically capable of the production rates common for current practice [Du Bois 1996, Henry 1995]. This production rate requirement is a severe restriction for two of the three processes which can extend the forming limits of aluminum beyond matched tools forming. These two are fluid pressure forming, described previously and super-plastic forming, which has been omitted for reasons stated previously. Conversely, the high velocity, pulsed electric power methods, described previously, operate on a much shorter time scale than matched tool stamping while providing extended forming limits. However, with the exception of axisymmetric clinching, the electric pulse energy methods are not used by auto makers since no one has yet provided a means to apply it efficiently to large, high production parts.

On the other hand, fluid pressure forming is marginally employed by the auto industry. Its use has been principally restricted to experimental and special low production of aluminum parts. In such applications, the tooling cost saving provided by the single surface tools is no longer minor in comparison to the production rate penalty. In addition, cycle time in fluid pressure forming is related to the peek pressure requirements and might be improved by combination with a pulse energy method. Not to be neglected is the capital cost of new press machines which would be required by the adopting of a fluid pressure forming method to produce aluminum parts. A hybrid method based principally on conventional matched tools would likely not require extensive replacement of the present, installed, press machines. However, unless aluminum alloys are developed that have the plastic strain behaviors comparable to draw steels, conventional matched tool forming will need to be abandoned or integrated with another method to meet the forming performance goals required to efficiently mass produce aluminum auto bodies.

Combined Quasi-Static and Dynamic Forming: Hybrid Methods

The present invention provides a well-designed combination of high velocity forming integrated with a quasi-static conventional forming process to meet the requirements for a reliable, cost effective method for the mass production of aluminum auto body and other commercial parts.

Figure 12:
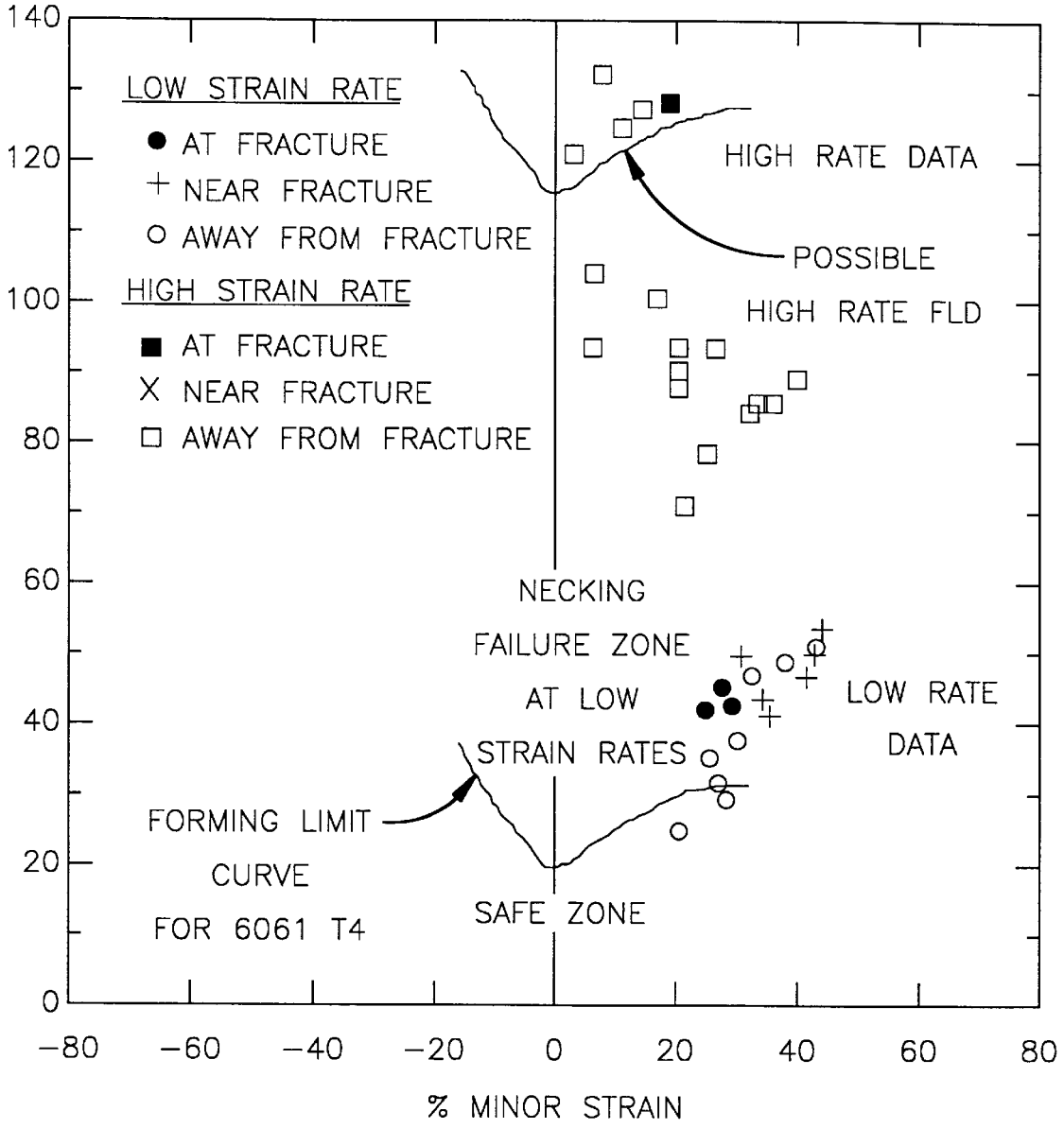
FIG. 12 shows a graph of Forming Limit Diagram with HRF data.
Figure 13:
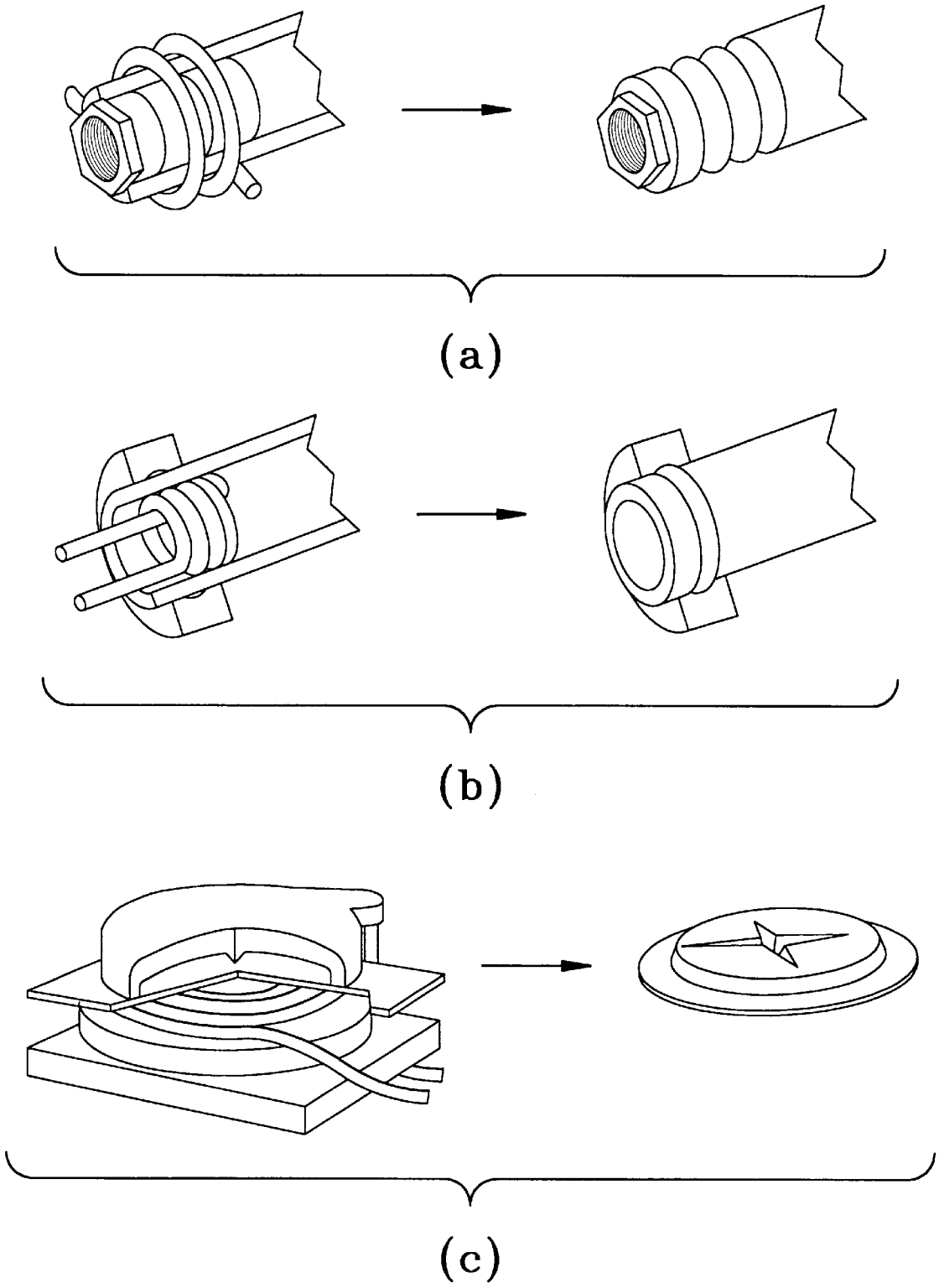
FIG. 13 shows drawings illustrating electromagnetic forming coils for small parts (a) tube compression (b) tube expansion and (c) flat sheet or pan forming.
Figure 14:
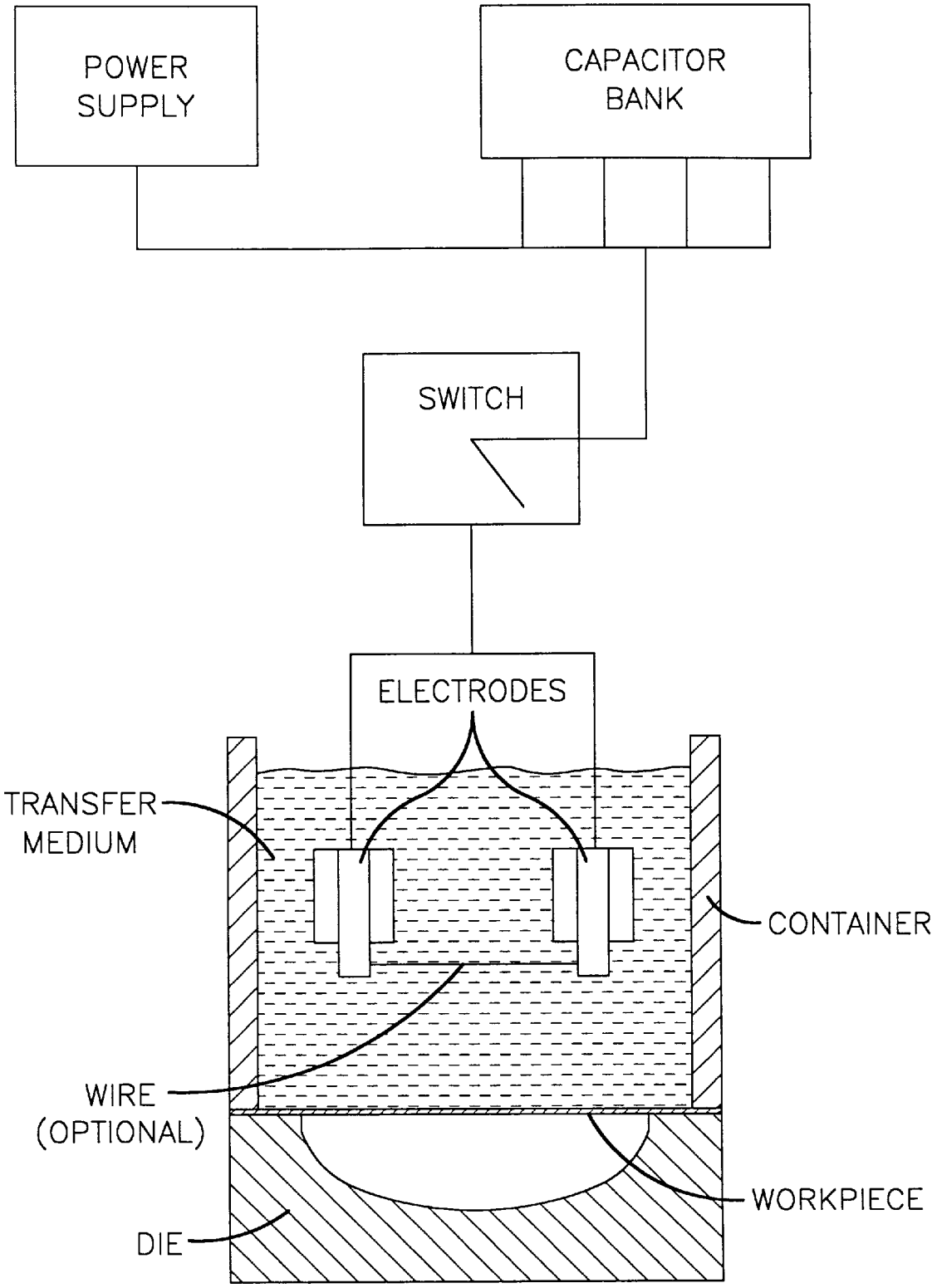
FIG. 14 shows a schematic drawing illustrating submerged arc discharge (electro-hydraulic) sheet forming.
Figure 15:
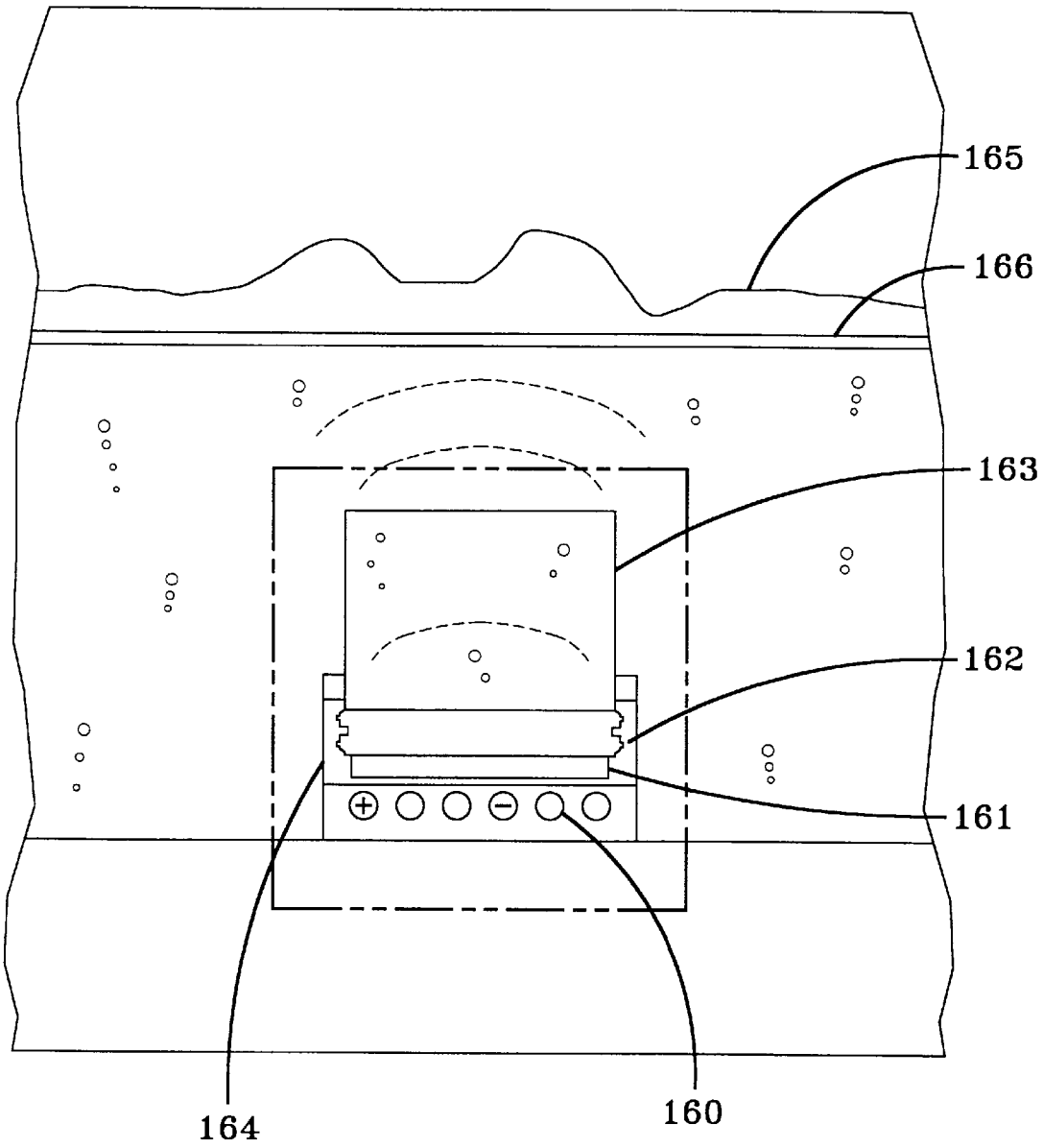
FIG. 15 shows a schematic drawing illustrating an electromagnetically driven, hydraulic shock tube assembly.

There is ample evidence in the literature, as reported previously, that support the claim of extended plasticity, for many alloys, at deformation velocities above 50 m/sec. Support for reduced springback and wrinkling at high deformation velocities can also be found [ASTME 1964, Maha 1996]. The literature also reports on the problems involved in producing large deep shells exclusively by a high velocity, electric pulse energy process. Due to the existence of an upper deformation velocity limit (see FIG. 12) and practical limits strength of tooling materials and capacitor bank size, the power pulses cannot be made arbitrary large in order to affect deformation over larger part areas. For example, if a very large single pulse were used, the sheet deformation velocity nearest the pulse generator would likely exceed the upper limit causing the local sheet ductility to fall off sharply. The use of an array of pulse generators to provide lower peak power per individual event and more uniform distribution of deformation forces is an obvious variation of the straight high rate forming concept. However, the actual methods of implementation and effective control of such pulse generator arrays is not obvious. In any case, the probability is still high that the forming of the larger parts by high power pulses would involve multiple sequential discharges which will obviously tend to lengthen the total cycle time. In addition, the form tools used in a straight high power pulse forming process requires a greater shock resistance capacity which generally means more massive construction. This is especially true for the electro-hydraulic discharge process. Using the high power pulses only for final forming and only at the local areas of the part which require it, reduces the overall shock resistance requirements of the tools and subsequently, the construction costs.

In order to reduce the discharge energy requirements for large parts, either multiple discharges were used or simple pre-forms were made by conventional quasi-static methods and the complex features and final sizing accomplished by high velocity methods [ASTME, 1964]. High velocity processes generally exhibit sheet stretching over draw-in during part generation. The result can be undesirable thickness variation in deep shell geometries. The inertial forces generated by the mass of the sheet in the blank holder area, outside the energy pulse zone, increase the resistance to draw-in. Concurrently the sliding friction between the work piece sheet and the blank holder surface is reduced due to the increase in the draw-in velocity. For simple axisymmetric type part geometries, these conflicting effects can counteract, resulting in very similar draw-in performance for both high and low velocity processes [Kaplan, and Kulkarni 1972]. However, sheet draw-in is more consistent and predictable and thus can be more finely controlled in a low velocity process.

The potential benefits from the combination of the complementary attributes of static and dynamic forming methods are clear, providing that the attributes are, in practice, additive.

Figure 16:
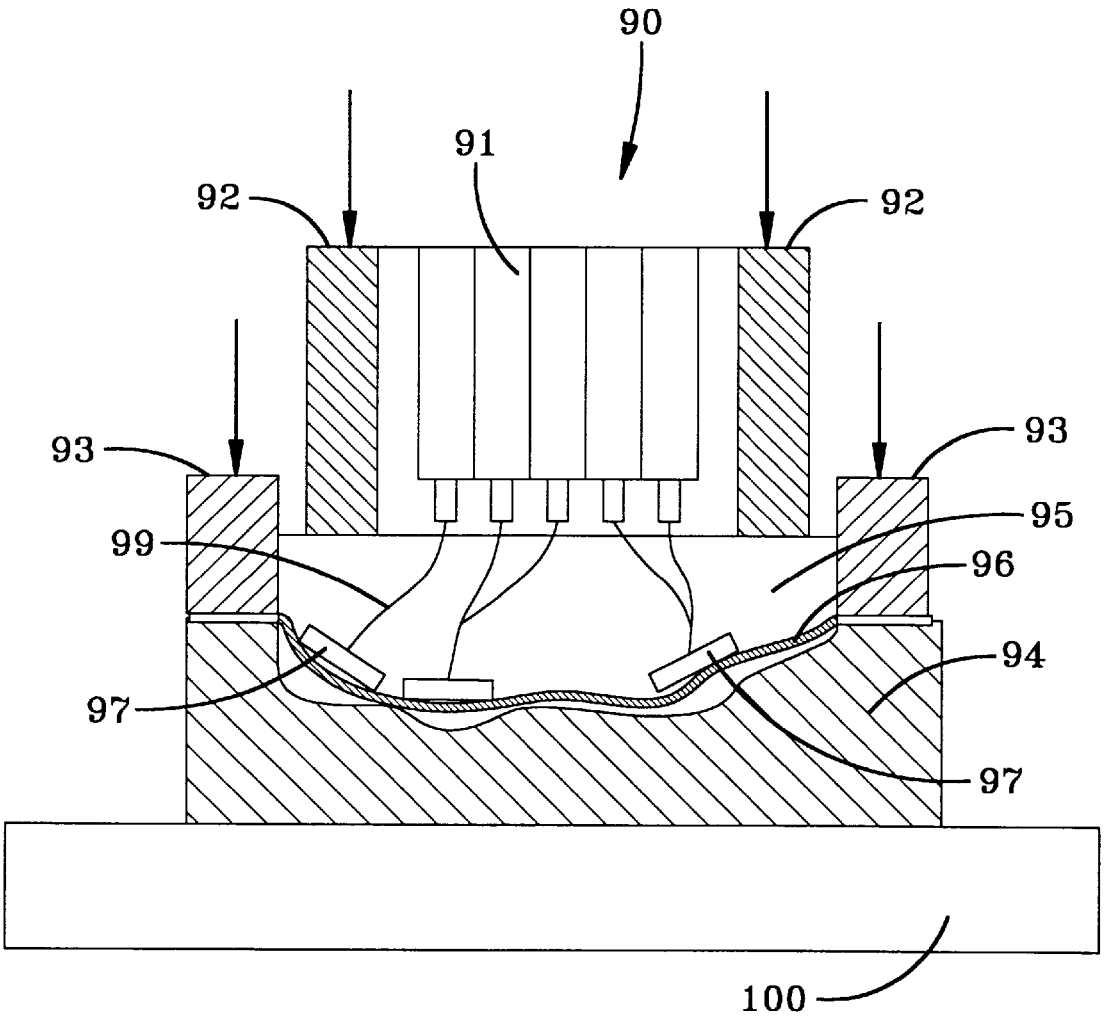
FIG. 16 shows a schematic drawing illustrating a Matched Tool-Electro-Magnetic ("MT-EM") apparatus, in accordance with one embodiment of the present invention.

Another possible hybrid process is the combination of conventional matched tool stretch-draw forming with localized electromagnetic pulse forming. In this hybrid forming process, the part would be preformed, to some optimum extent by the conventional draw-in and stretch action of the match tooling. Final forming of tight corners, sharper details and sizing would be accomplished by electromagnetic repulsion forces generated at the required areas of the part by a set of electromagnetic coils embedded in the tool halves. This hybrid method will be referred to as Matched Tool-Electro-Magnetic and will be abbreviated as MT-EM, in accordance with one embodiment of the present invention. A concept schematic of a MT-EM process system is shown FIG. 16.

A embodiment of the present invention is the combination of a quasi-static fluid pressure process with localized shock events generated by electro-magnetically driven shock wave tube devises instead of electric arc discharges. Since there is some evidence that shock tubes are more efficient than arc discharges in diaphragm expansion, a hybrid method using electromagnetic shock tubes may be more commercially viable than one using arc discharges [Vafiadakis et al, 1964]. This hybrid forming method of the present invention concept could be technically considered a combination of the fluid pressure, electro-hydraulic and electromagnetic processes. However its sheet forming characteristics should be quite similar to FP-EH forming although its system and energy requirements will differ. It will therefore not be given a separate name here and will be lumped with FP-EH for the remainder of this discussion.

There are no fundamental reasons to dismiss any of these hybrid sheet forming concepts. Moreover, these three process concepts are by no means exhaustive, only the more obvious combinations.

One of the common central principles of these embodiments of the present invention is the combination of a relatively low power process to generate the bulk of the sheet deformation with localized high power pulses which provide the final forming, where required. The gross effect can be viewed as combining a pre-form step and a final form step into a single operation with additional process design freedom provided by virtue of the different physical processes. At a more specific level, a hybrid forming process should be able to demonstrate increased forming capability of auto body size parts with localized hyperplastic effects while avoiding the problems attendant to large energy, high power pulse events.

Advantages of Different Hybrid Methods of the Present Invention

The hybrid process of the present invention which combines a quasi-static Fluid Pressure forming method with multiple, distributed, Electro-Hydraulic discharges (FP-EH) has, by several measures, the greatest general performance potential. In terms of broadness of application, a FP-EH process can be used on many different types of sheet materials. For example, it is not restricted to materials which are good electrical conductors as is required by the electromagnetic forming process. The nature of the event (submerged arc discharge) allows it to be located further from the sheet and with less precision then the coils of a electromagnetic process. FP-EH requires only one form tool (usually the female die). The electrode/bridge wire assemblies in a FP-EH system would be part of the press machine and not integrated into the tool as will be the coils of a Matched Tool-Electromagnetic (MT-EM) hybrid process. The fact that each MT-EM application requires a unique set of coils further increases the general complexity and cost of the process tooling of MT-EM over FP-EH. Further, MT-EM requires a pair of form tool surfaces compared to the one for the FP-EH process. Finally, the precision with which the work piece conforms to the coil face effects the magnetic pulse pressure generated and hence the forming energy efficiency. The repulsive sheet driving force drops rapidly ($\sim 1/R^4$) as the sheet is moved away from the coil surface since the pressure on the sheet is proportional to the square of the flux density, B, which in turn, diminishes as the inverse of the squared distance from the current element [Plonus, 1978]. In contrast, the pressure pulse forming effectiveness of an electro-hydraulic discharge diminishes only as the inverse of the distance squared from the discharge, ($\sim 1/R^2$) [Caggiano et al 1963] thus, much less rapidly with sheet deflection. The slower attenuation of available forming pressure makes the use of sequential discharges more practical in FP-EH than MT-EM processes. In fact, a series of smaller discharges in place of a single event of much higher energy was reported to be the preferred method for producing large parts [Cadwell, 1968]. Although the FP-EH process concept has several advantages for broad application over MT-EM, it also has several significantly greater practical application hurdles to overcome.

The principle development hurdle for the FP-EH process is that it cannot be easily implemented in the types of press machines existing in the auto industry. Providing the quasi-static, fluid pressure pre-form stage requires a significant amount of specialized hydraulic machine components. Moreover, the structure of many conventional presses, currently in use, may prove too light. The structural loads, at even the lower forming pressure range, when applied over the plan area of auto body panels, can be tremendously high. A tooling system which attempted a self-contained conversion of large double acting conventional presses to fluid pressure forming was patented but demonstrated only very limited success due to pressure induced structural deflection. [Hydro-Stretch 1990, Henry, 1991]. The requirement of a specialized press machine for the FP-EH process represents a significant economic road block to acceptance by industry in the near term, although it remains technically feasible.

Another technical hurdle to the development of a FP-EH process is the modeling of multiple interacting discharge events and their effect on deformation of the part sheet. This topic has not been investigated to any significant extent. Rinehart and Pearson [1963] briefly discusses the topic with respect to multiple synchronized charges for explosive forming. They suggest the use of superposition principles in the analysis of multiple charges in under water explosive forming were the shock pressures are less than 69 MPa (10000 psi.). A robust design method for FP-EH would require a more thorough knowledge of multiple interacting events. However, modeling even a single EH discharge event is not trivial. The electro-hydraulic discharge event begins with the complex physics involved with the generation of the high temperature (5000–10000 K) plasma kernel of the arc path. Within a few micro seconds the expanding plasma generates shock waves whose propagation, reflection, refraction and interferences cannot be neglected in order to accurately predict the process actions. Thus FP-EH employs generally more complex and harder to model physical phenomena than MT-EM with electromagnetic pulse events. Moreover, the simple existence of the intervening liquid medium required to transfer the deformation energy in the electro-hydraulic event, adds to the potential variability and complexity of the FP-EH process.

The MT-EM process may not have the broader applicability of the FP-EH process but, for several reasons, is a better choice for an initial hybrid process development. First, the MT-EM process can be implemented using conventional mechanical or hydraulic, single or double acting presses. In principle, only minor alterations to existing presses themselves should be required for retrofitting. The lack of a liquid medium to transfer the deformation energy to the part not only reduces the overall complexity of the system, it also eliminates the maintenance overhead of an additional hydraulic system.

The reduced development advantage of MT-EM over FP-EH is exemplified by the requirements for electrode assemblies of a FP-EH process. High energy arcs can quickly erode electrode tips which in turn change the pressure pulse characteristics of the discharge. Electrode problems accounted for a good deal of the trouble encountered with the old EH machines. It was found that variations in the location arc at end of the coaxial "spark plug" electrode used in one of the early systems could cause unacceptable variations in the parts. Moreover, the spark plugs required rebuilding after only 100 discharges. The systems which used bridge wires to initiate the arc had much better repeatability but the wires required manual installation before each discharge. [Daughtery 1995, Fronabarger 1995, Bennetts 1995].

Another point is that, at least for axisymmetric geometries, electromagnetic forming has been more fully development in terms of application, tooling and coil design [Belyy, et al 1988, Gilbert and Lawrence, 1969.]. This more organized knowledge, some available in handbook form, provides additional motivation for developing the MT-EM process. Further, electromagnetic forming developed a non-aerospace, industrial niche in axisymmetric swaging. This small commercial market supported continued work on metal deformation behavior using electromagnetic pulse energy after the military aerospace efforts ceased. Although still incomplete, this existing body of knowledge is also more current than electro-hydraulic discharge forming [Daehn et al,1995]. Thus the literature of EM forming provides a slightly higher level to start the development a hybrid process.

Technical Issues Involved in Practicing MT-EM Forming

The hyperplasticity effect of high velocity deformation is fairly well documented and the fundamental mechanism model of inertial stabilization has not been seriously challenged [Wood, 1963, Bruno, 1968, Balanethiram and Daehn, 1992].

This fundamental phenomena that hybrid sheet forming processes will be utilizing to realize extended plasticity will be described here in greater detail to support the description of the sheet coupon tests to follow.

Figure 17A:
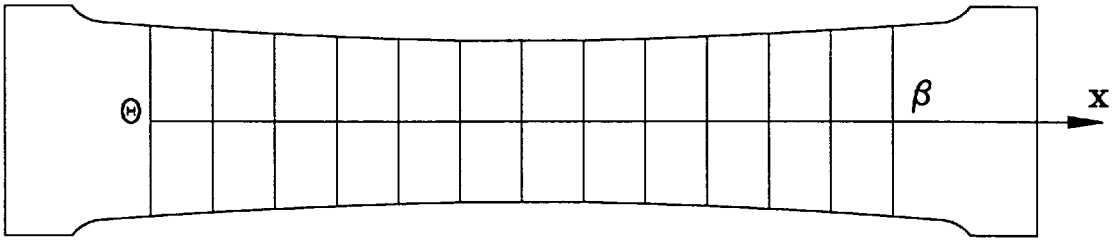
FIG. 17 shows models illustrating one dimensional ridged-plastic, dynamic finite element analysis of a uniaxial tension and ring expansion test specimens.
Figure 17B:
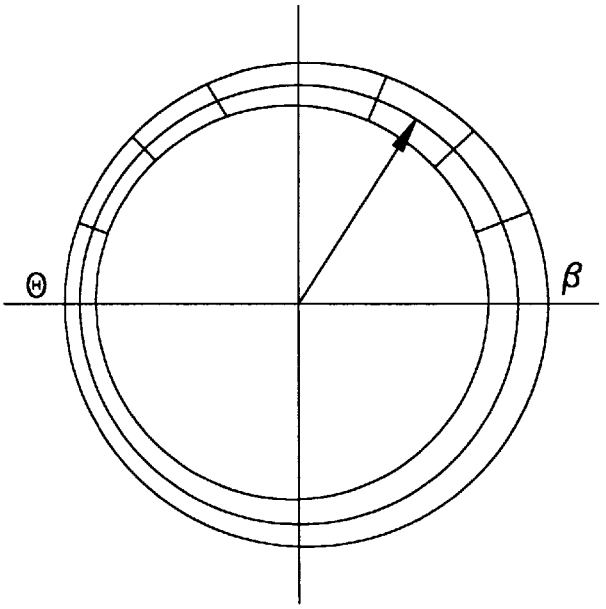

The inertial effect of the sheet "particle" mass which provides a force resisting the localization of strain as a necking plastic flow instability tries to form. Hu and Daehn [1] extended the understanding of the phenomena by means of a simple and rather elegant one dimensional ridged-plastic, dynamic finite element analysis of a uniaxial tension and ring expansion test specimens (FIG. 17). The essence of the analysis formulation was simply the inclusion of a elemental mass and acceleration term in the nodal force balance (eq. 1.1 below) which added to the internal nodal force terms obtained from the derivative of the plastic work of the element with respect to the nodal displacements (eq. 1.2 below).

$$M_i\ddot{u}_i + F_i = 0 \tag{1.1}$$

$$F_i = \frac{\partial W}{\partial u_i} = L\sum_{\kappa=\alpha}^{\kappa=\alpha+1} A_\kappa \sigma_\kappa \frac{\partial \varepsilon_\kappa}{\partial u_i} \tag{1.2}$$

$$\sigma_\kappa = k\varepsilon_\kappa^n \dot{\varepsilon}_\kappa^m \tag{1.3}$$

Equation 1.3 is the power law of the rigid-plastic, Holloman type constitutive relationship used in their analysis. Although thermal effects due to rapid plastic stains were ignored a 1% taper in the specimen geometry was included to provide a defect like inhomegeneity. In the above equations, M is the element mass, u is the displacement (axial or circumferential), Ak is the initial cross-sectional area of the element, L is initial element length. The results of this simple one dimensional model illustrated the basic effect of mass inertia on the extended ductility at high deformation velocities. FIG. 18 shows the graphical results presented by Hu and Daehn, most pertinent to the present invention.

FIG. 18 illustrates that the influence of inertia is less as n and m becomes large but contributes to extending ductility for any fixed "n" or "m" as seen by the increase of the dynamic to static strain ratio with increasing velocity. This simple model also predicts a strong coupling between total strain at failure an deformation velocity.

The inertia effect macroscopically resembles the ductility enhancing effect of strain rate hardening which is one reason that high velocity forming is suited to the working of stain rate insensitive, aluminum alloys. To qualitatively describe the suppression of localized neck formation by inertial effects as predicted by the Hu and Daehn model, consider the following. Initially the velocity distribution of material elements in uniaxial extension varies linearly from the crosshead input velocity to zero at the fixed end of the sample. As a neck starts to form, the velocity distribution approaches a step function as the material velocity between the neck and the fixed end goes to zero while the specimen material between the neck area and the crosshead assume the crosshead velocity. In order to accommodate the velocity discontinuity the material in the necking region must experience an increasingly large acceleration. The force required to accelerate the mass of a material element outward from the neck area must be transmitted though the material outside of the necking region, thus the necking tendency is diffused. This effect is, of course, always present but only significant at high deformation velocities.

The results from the simple, one dimensional model cited above, included minor geometry variations which indicates that the inertial drag suppression of necking is not critically sensitive to sheet flaws or thinning. However, variations in sheet hardness was not addressed in that model or in any other articles reviewed. Information on the effects of these parameters on the maximum attainable strains in hybrid forming is of interest.

From the preceding, one may expect that inertial effects at high deformation velocities will only extend plastic behavior of sheet materials whose dominant failure mode is necking. Metals which exhibit little or no necking before fracture at low velocities are not expected to show a significant increase in ductility at high velocities unless there is phenomena other than inertial drag forces at work. The direct effect of this prediction to the present work is that the fully hard aluminum alloys are not expected to perform as well as a solutionized or a lightly worked condition. In the case of hybrid forming, the inertial drag model of neck suppression will thus be confounded by the various levels and distributions of pre-strain introduced into the sheet material during the quasi static initial forming stage of the process. In most cases, the pre-strain will introduce work hardening into the material. The work hardening thus introduced will, in general be non-uniformly distributed across the initial-form part. In addition, variation in sheet thickness could be considerable. The extent of the variations in sheet hardness and thickness will, in practice, depend heavily on the geometry of the initial-form. A variety of experiments were conducted to elucidate the relationship between the level and distribution of pre-existing strain and subsequent material strength variations and the amount of additional useful plasticity that can be obtained under high velocity deformation conditions.

In addition, the foregoing indicates that one should correlate inertial controlled plasticity effects with deformation velocity rather than strain rate especially for comparisons between different geometries. The simple reason is that deformation velocity varies with gage length which means that high strain rates can generated by low deformation velocities if the initial gage length is small enough. The tendency to equate high strain rates with high deformation velocities in the literature is due to the fact that nearly all researchers are conducting investigations with identical specimen geometry for which strain rate and deformation velocity are uniquely related.

The plastic behavior of any metal is temperature sensitive at to some extent. If local work sheet temperatures become high enough during forming to cause thermal softening, then neck formation can be promoted due to the subsequent strength variation in the load path. The particular case of aluminum, the deleterious effect of thermal softening is, at least partially, offset by the fact that the strain rate hardening effect ("m" in the simple power law model,) increases with increasing temperature. The MT-EH process can induce a considerable amount of electrical joule heating as well as adiabatic heating due to dynamic plastic deformation. Sheet temperature, local to the discharge event in space and time is a process variable of interest and importance to the prediction of the MT-EM performance. The transient time-temperature data local to the forming pulse is difficult to measure directly due the micro-second time scale of the event alone. However, changes in sheet hardness is a process variable more directly related to plastic flow which can be measured easily. Care must be exercised however in the use of superficial sheet hardness due to the confounded effects of adiabatic and joule heating with the temperature induced increase in strain rate hardening of aluminum. A simple analytic model of adiabatic joule heating can be employed to obtain an upper bound of the sheet temperature in the eddy current path. The induced eddy-current in the sheet can be estimated from the measured work coil current-time history. Obviously, the numerical simulation of the high velocity event, to be discussed later, will need to provide an accurate estimate of the sheet temperature distribution to accurately model the over all process.

The data of principle importance to the assessment of the MT-EM process are the failure strain levels, distributions, and deformation velocity for the aluminum alloy sheet material acceptable for auto body use. The present investigation will be restriction the two basic aluminum alloy types, precipitation hardening and non-precipitation hardening. The specific alloys chosen are 6111-T4 and 5754 These alloys are both currently used in auto body applications. The fundamental metallurgical differences between these aluminum alloys will result in some performance variations in the MT-EM process. The variations are expected to be in rough proportion to static measured ductility and should not confuse the resulting assessment of the MT-EM process for all similar alloys. Further, if the extended dynamic plasticity effect is largely an inertial effect, then it is reasonable to expect that static-dynamic strain relationships should be found to be applicable to whole alloy groups.

The high velocity sheet forming performance cited in the literature is almost entirely for fully dynamic deformations starting from flat blanks or uniform tubes. The state of initial cold work for these cases were at least uniform and often close to zero. The material cold work condition in a hybrid process after the quasi static forming stage will definitely be non-uniform to some extent. Depending on the part geometry and static process, the cold work condition could vary widely.

The early high velocity forming literature provides considerable information on static strengths of certain alloys after dynamic, high rate, forming which has been nicely summarized by A. A. Ezra in the last chapter of his "Principles and Practices of Explosive Metalworking", [1973]. The chief concern of the aerospace researchers of that time was to determine if the high rate forming processes degraded the structural properties of their alloys. Extended plasticity was recognized but less of a concern since multiple forming cycles with intermediate annealing operations are common practice in aerospace fabricating. Therefore, the literature contains quasi static stress-strain data after dynamic pre-straining for certain aerospace alloys. Nothing was found concerning the reverse sequence of deformations. By the path dependency of plastic deformations, it would not be expected that the combined effect of static and dynamic deformations of a sheet material is symmetric or independent of application sequence. From the data currently available it would be reasonable to expect that, assuming modest initial stage strains, that a static-dynamic sequence would produce greater elongation than a dynamic-static. Interestingly, the data summarized by Ezra, [Ezra1971], shows that a dynamic-static process, in comparison to a straight quasi-static process, will reduce the total elongation for mild steels and increases it for both 5052-0 and 5456-0 aluminum. The material test results reviewed by Ezra warn against too broad a generalization of the forming performance from hybrid forming experiments with any particular metal type to another.

Based upon the Examples given herein the experimental results will provide predictive understanding of the relation between initial cold work and allowable final strains for process design purposes. How the process designer divides up the total strain required to form a desired part feature between the static and dynamic regimes determines the part shape at the end of the quasi-static forming stage and the subsequent pulse energy required.

A significant enhancement has been demonstrated, the basics of which are discussed herein. With this knowledge in hand, one of ordinary skill will be able to design specific apparatus and practice methods in accordance with the present inventions.

Conventional matched tool forming, is itself such a complex process that analytic models have been developed for only simple axisymmetric geometries and those that can be accurately represented in one or two spatial dimensions. The sheet is generally assumed to behave as a simple membrane with bending corrections possibly included. There are a number of texts covering these analytic methods such as references[Hosford and Cadell, Mielnik 1991]. Luckily the past ten years have seen a good deal of effort spent in the development of computer codes and microprocessors which are demonstrating impressive capabilities in the modeling of the conventional low velocity deep shell sheet forming processes. The design of a MT-EM in accordance with the present invention typically will employ such computer codes and microprocessors to assist in defining the best obtainable pre-form part geometry. Ideally, such computer codes and microprocessors will allow one to measure, assess and control full dynamic, electromagnetic and thermodynamic characteristics, as well as material constitutive relations capable of accurately predicting local necking and fracture. A preferred numerical modeling tool should be capable of simulating the entire MT-EM process for the designer. Although the ideal unified MT-EM simulation code is not presently commercially available, there are codes that can model separate aspects of the process.

It should not be assumed that hybrid forming process and MT-EM in particular can only be applied if powerful simulation tools are available. If this were the case then the commercial viability of the hybrid processes would be quite questionable despite any extended forming capacity. In fact it is quite unnecessary that a means of approximating the requirements of a MT-EM system exist and be outlined. A system which requires a computer simulation before anything can be known about its gross size and energy requirements is typically untenable. Such approximate design calculations are available and can suffice to produce a functioning system without substantial additional experimentation.

The final consideration in the development of a MT-EH process concerns the physical system design. The requirements of the electromagnetic pulse coils must be combined with those of the forming tool with which it/they cooperate or in which it/they are imbedded. The fatigue strength of the tool material must be sufficient to withstand the reaction forces generated by the coil pulses over the production life of the tool. Since, the electrical conductivity of the tool material effect the energy efficiency of the coil, standard iron and steel matched tool materials may not be optimum for MT-EM tools. The coils themselves must structurally absorb internal magnetic pressure, often of similar magnitude to the forming pulse. A means of replacing damaged coils with minimum down time must be considered the same as for the high wear insert sections/components of conventional tools. The replacement of coils during the production life requires reliable electrical connectors capable of peak currents of one half million amps or more. Any arcing in coil connections causes rapid deterioration at the connection interface leading to catastrophic failure in a few cycles.

Alterations to existing press machines will be minimal, which is one advantage of MT-EM over the other hybrid methods, as stated above. As an issue much subordinate to the forming performance and tool design aspects, press machine alterations will be discussed in only broad terms. The press machine must accommodate the energy storage capacitor sub-system either entirely or at least the ingress of the pulse power cables. Stamping plant floor space is generally at a premium which indicates that the capacitors, charging, control and pulse energy distribution will preferably be integrated into the press machine volume. Typically, the power systems for such retrofits can be accommodated in a home freezer size box next to an existing press.

Safety of a new industrial process is an issue to be addressed at the fundamental level early, in the development cycle. The main components of the safety issue of the MT-EM process concern the high containment of the high power electrical pulses, possible high velocity debris, eye damage from arcs at connection failures and noise levels. None of the major safety concerns represent conditions or phenomena new to manufacturing or the automobile industry in particular. These hazards all currently exist in many manufacturing environments and standard practices are in place to deal with each one. The design and safety issues involve in the development of MT-EM forming will be described briefly herein.

Application Design and Trials of the MT-EM Process of the Present Invention

Introduction

In order to elucidate the MT-EM process of the present invention, two demonstration trials involving actual, full size automotive body panels were undertaken. Attempting full scale applications allows one to test practical design methods and to provide preview and feed-back to process development on real application problems. The inherent simplification of a system when scaled to convenient laboratory size can inadvertently mask real application problems. A prime example is in the estimation of the process energy requirements. Arbitrarily constructed laboratory test system can generally be designed small enough that the equipment capacity becomes a non-issue and serious weakness in the estimation method can be glossed over. Similar arguments can be proffered for the design of the driver coils and electrical bus work. Ideas which seem to work fine at a few kilo joules and kilo amperes can literally come apart at much higher energy and current levels. In particular, direct experience was desired concerning the design of full scale work coils operated at near limit energy levels and their integration into the match tooling.

Two major deviations from standard automotive stamping practice were accommodated for these full-scale trials. First, there was no attempt to install the MT-EM process into a press machine. The pre-forms were stamped out and transferred to tools containing the work coils were the EM phase was performed as a second operation. Second, the tools used for the EM phase were not made of a malleable grade of cast iron, standard for production tools. Except for the imbedded coils, the trial tools were made from a special iron filled plastic material recently developed for prototype stamping tools. This material is referred to by the acronym Stamp, and is commercially available from ITT Industries. The deviations from what might be considered standard stamping practice conditions are not deemed to affect the applicability of the trial experiences to the application of the apparatus and methods of the present invention to actual MT-EM automotive parts forming.

The full scale trial part problems were chosen by a group of engineers from the major American automobile manufacturers and consisted of a hood feature line and a door inner panel lock face. The two parts and the sections of those parts chosen for MT-EM application were considered to span the geometries most troublesome to currently produce in aluminum by the conventional matched tool method. The hood feature line trial was the less ambitious of the two and was undertaken first.

General design considerations

Simple applications utilizing relatively inexpensive tooling may not require a high degree of process optimization at the design stage in any case. To arrive at a good initial design point and to predict at least a lower bound on the energy requirements of an application, a good pencil and paper design method is needed. Ideally, the method is simple enough that an unprogrammed hand calculator is sufficient to conduct a few preliminary design iterations and accurate enough to render the results dependable, if only as upper or lower bounds. Approximate design methods for the quasi-static, conventional matched tool forming portion of the MT-EM process have been available for many years. These methods will not be discussed here but can be found in many texts books on metal forming such as those by W. F. Hosford and E. M. Mielnik [Hosford and Caddell, 1981] [Mielnik, 1991].

Only a brief experience with the design space of EM portion of MT-EM applications is required to recognize that there actually are no time invariant factors in the process except mass. Even the simple inductively coupled RLC circuit used in the present invention becomes quite complicated when the inductance capacitance and resistance are all taken as time dependent variables. Additionally, the deformation mechanics of the work piece during the EM phase are complicated by the fact that temperature effects are present and the inertial terms of the force balance equations are significant, even dominant. However, assuming constant circuit parameters does allow coarse predictions of the system response using simplified geometries and energy balances.

The simplifying assumption which underlies the method must be kept in mind. Adding insupportable layers of sophistication in an attempt to improve the accuracy should be avoided. A computer simulation method should be employed when the detail and accuracy of the preliminary design methods are insufficient.

Two questions that must be addressed early in any new application design are: "Is the general level of plastic deformation required to finish the feature from the pre-form shape available through EM pulse forming ?" and "How much energy will be required from the capacitor bank?" The first question is best answered by previous experience with the alloy of the part in question. As a very general rule of thumb, the total useful strain available to the MT-EM process is about 50% greater than the quasi-static limit strain for the alloys commonly used for stamped parts. The distribution of the strain will be dictated to an appreciable extent by the geometry of the coil and the eddy current density. The second question is, of course, related to the first in that the plastic work is part of the energy required from the bank. However it is usually the smallest fraction. Both of the questions will lead back to a new pre-form design iteration if the answers lie beyond the capabilities of EM forming. The assessment of the EM energy required will quickly becomes the prime issue of the early stage of an MT-EM process design. To address this question, the simple geometry and energy method outlined below was developed. The method was generally based on others applied to axisymmetric parts presented in the literature [Bruno, 1968] [Gilbert & Lawrence, 1969][Baines et al, 1965][Al-Hassani et al, 1974] [Belyy I. V., et al, 1996]. However, nowhere in the literature was found a method directly applicable to the MT-EM conditions or presented as a clear step by step procedure.

To apply the following method of estimating EM energy requirements, some preliminary information is require. It is required to have in hand:

1) Part feature pre-form and final shape.
2) An estimate of the strain level in the pre-form.
3) The material data of the part sheet.
4) The geometry and material properties of a preliminary coil design.
5) The geometry and material properties of the coil-bank connection.
6) The electrical properties of the surrounding tool material.
7) The effective resistance and inductance of the capacitor bank up to the coil lead connection bus.

The basis of the method is the first law of thermodynamics edited for this problem. The energy audit, for the capacitor bank system during discharge, can be written as:

$$\Delta E_{Bank}=\Delta E_{Inductive}+\Delta E_{Resistive}+\Delta E_{radiative} \quad 5.1a$$

For frequencies below 500 kHz, the radiation energy can be ignored [Terman, 1947]. A simplifying assumption used for this analysis is that the majority of the work done and energy expended occurs within the first current cycle. This assumption is common in the literature and is also supported by the high speed array camera images of the coupon expansion tests using the methods of the present invention. Accepting the truncation approximation, the energy terms can be expanded as follows for first current cycle of the discharge:

$$\Delta E_B = \frac{1}{2}C_B(V_0^2 - V_T^2) = \frac{1}{2}L_e\bar{I}_B^2 + R_e\bar{I}_B^2 T \quad 5.1b$$

where $C_B$=effective bank capacitance $\bar{I}_B$=effective bank current $L_e$=effective system inductance $R_e$=effective system resistance $V_0$=capacitor charge voltage $V_T$=capacitor voltage after time T T=period of $\bar{I}_B$ Once the system is assembled the effective system parameters can be calculated directly from measured current-time data. In order to estimate $\Delta E_B$ before building the system, the parameters of 5.1 b can only be approximated. The accuracy and completeness of the parameter estimations, along with the time invariant assumption, limit the predicted bank energy such that, even with care, significant error can be expected. However, this level of accuracy can be sufficient in the initial process design stage. The real value of such a rough model lie more in assessing relative merits of competing designs than accurate predictions.

The estimation of $L_e$ and $R_e$ proceeds by expanding the parameters into their major constituent parts for separate evaluation. The effective system parameters are constructed as:

$$L_e=L_B+L_c+L_l \quad 5.2$$

$$R_e=R_B+R_c+R_l+R_p \quad 5.3$$

where the subscripts B, C and l stand for bank, coil and leads. The coil induction will include the effect of the coupling with the work piece and therefore indirectly also includes the work piece resistance effect. Work piece resistance generates and additional energy loss term due to eddy currents which increases the effective resistance of the system as seen by the bank. This proximity resistance is represented by the p subscript term. It is important to keep the parameters for the bank-coil connecting leads separate from the coil since the leads are not affected by the presence of the work piece and can be a major source of hidden inefficiency if not properly designed. It will be assumed the parameters of the capacitor bank including the bus are known from shunted tests. What remains is to estimate the coil and lead parameters by methods consistent with the required accuracy of the bank energy prediction. The sequence of the following calculation steps are not critical as long as the prerequisite values are available.

Step 1: Estimate the coil and lead inductance:

Given the initial design geometry and material of the coil and leads, the formulas found in Grover [Grover,] or other older electrical engineering handbooks can be applied. Curved coils (not doubled back) can be flattened and the inductance of more complicated branching geometries can be assembled as series or parallel combinations of simpler geometries. Unless specified otherwise, the inductance calculated by these formula are for isolated coils and transmission lines. The effect of the work piece and any surrounding conductive, non magnetic, material will be to lower the inductance of the coil as seen by the bank. Close proximity of ferromagnetic material will have a smaller effect, but tends to increase the inductance of the coil. In either case, the effect is fairly small after a few centimeters and is therefore any change in coil inductance is chiefly due to the presence of the worksheet. Unless the leads are closely surrounded by a metal duct or conduit, their open inductance value can be used. Texts and handbooks such as Grover provide methods for calculating the mutual inductance of the surrounding metal bodies and net effect on the coil or bus inductance. However, these calculations can become quite tedious and much better results can be obtained from commercial electromagnetic analysis programs with similar levels of effort.

Two other options are available for finding component inductance values. First, the flat plan of the coil work face can be translated from the design to a thin sheet of metal with electrical properties similar to the proposed coil. The inductance of this flat coil mock-up can be measured while covered by a plastic or paper layer and metal sheet simulating the work piece. The inductance measurement instrument used must be able to measure in the micro henry range and supply an excitation signal of approximately the same frequency as expected from the completed system. If the coil is easily to prototype, more accurate results can be obtained if not constrained by the accuracy of the induction meter.

A simpler method is to use existing data from several coil face geometries and sizes that are candidates for the general type of EM which have been mocked-up and measured as described above. Examination of data generated from an inductance test for a mock-up similar in plan to the door trial coil as a general class of the trial parts, show that the ratio of covered to open inductance, for intermediate frequencies around 10 k Hz, is approximately 0.25 for open inductance of 2.0 micro henry or less. The ratio drops to about 0.12 for open inductance of about 8.0 micro henry. Using the open coil inductance and the bank capacitance and the frequency relation $$\omega_0 = 1/\sqrt{LC_B},$$

the best ratio can be quickly found. Using eq. 5.2, the estimated system inductance, $L_e$, can now be assembled and the system undamped frequency, required for the next step, can be calculated.

Step 2: Estimate the coil, lead and proximity resistance.

With the system undamped frequency, $\omega_0$ approximating the actual damped frequency, $\omega_d$, the coil and leads skin depth of the current can be estimated with eq. 5.5 which is the same as 3.17 but in terms of resistivity ρ.

$$\delta = \sqrt{\frac{2\rho}{\mu_0\omega}} \qquad 5.5$$

The resistance of the coil are calculated by the standard conductor resistance equation $$R = \frac{\rho l}{A_e} \qquad 5.6$$

were l is the conductor length and $A_e$ is the effective conductor cross sectional area given by the product of cross section perimeter and the skin depth. Note that eq. 5.6 gives good estimates for conductor cross section aspect ratios <2. At higher aspect ratios 5.6 will under estimate the conductor resistance since the current will not be evenly distributed around the conductor perimeter. In wide thin conductors, the current will concentrate at the farthest edges of the conductor so as to minimize the number of magnetic flux lines encircling the current [Terman, 1947]. Just as for the inductance estimations, the resistance of the more complicated branched coils such as a 3-Bar or multi-element leads, the effective component resistance is formulated as series of parallel combinations of sub elements. The general form for combining resistive (or inductive) elements can be found in any elementary text on electric circuits and is provided here for completeness.

$$\frac{1}{R_e} = \sum_1^n \frac{1}{R_1} + \frac{1}{R_2} + \ldots + \frac{1}{R_n} \qquad \text{Parallel}$$

$$R_e = \sum_1^n R_1 + R_2 + \ldots + R_n \qquad \text{Series}$$

Proximity resistance is the increase in effective system resistance seen by the bank, due to the energy supplied to resistance heating of the work piece. The power loss per unit area of surface with conductance, σ, and incident magnetic field, $H_s$, is given by Stoll [Stoll, 1974] as $$P = \frac{H_s^2}{2\sigma\delta}$$

which can be written in terms of flux density, $B_i$, and eddy current area $A_e$ and related to part of the effective resistance by the coil current.

$$R_p = \left(\frac{B_i^2}{2\mu}\right)\left(\frac{A_e}{\mu\sigma\delta}\right)\frac{1}{I_c^2} \quad 5.7$$

Where σ is the conductance of the work piece $I_c$ is the coil current generating the eddy current through $B_i$ in area $A_e$. If the work piece is within a few millimeters of the coil face $A_e$ can be approximated by the area of the coil elements facing the work piece. Except for branched coils like a 3-Bar, the coil current is the same as the bank current. This system resistance term will generally be small in comparison with the others and can therefore often be neglected, at least initially. If this term is included its assessment will be more direct when the required flux and current are determined.

Step 3: Estimation of the system effective current $\bar{I}_B$

The estimation of $\bar{I}_B$ is the key to this method since it is the common factor in the inductive and resistive energy groups. Estimation of $\bar{I}_B$ requires quantities calculated in four sub steps to be acquired first.

Step 3a: Estimation of the plastic work required

Given the initial pre-form geometry and the final desired part shape, the energy needed for plastic deformation can be estimated using:

$$E_s = A_c t \int_{\varepsilon_0}^{\varepsilon_f} \bar{\sigma} d\bar{\varepsilon} \quad 5.8$$

Where proportional loading and uniform condition, such as plane strain is assumed. The full details of choosing a constitutive equation, determining the limits of integration etc. are available in any good text on metal forming. In many cases, a plane strain condition can be assumed and the final strain level can be approximated by using a simple change in line length, ignoring redundant work.

A constitutive equation which is simple, fairly accurate, includes prestrain and whose constants, n and K, are available for many alloys of interest is given by:

$$\bar{\sigma}=K(\varepsilon_0+\bar{\varepsilon})^n \quad 5.9$$

If the plane strain condition is assumed, the strain energy can be written as:

$$E_s = \frac{\sqrt{3}}{2}\frac{A_c t K}{(n+1)}\left[\left(\varepsilon_0 + \frac{2}{\sqrt{3}}\varepsilon\right)^{n+1}\right]_0^{\varepsilon_f} \quad 5.10$$

Equation 5.9 will produce acceptable results if the required strain is rather small, less than static failure strain. However, EM forming will often be used to produce plastic deformations beyond the static failure strain where eq. 5.9 and 5.10 are not defined. Applying eq. 5.9 in such cases will likely seriously over estimate the plastic work. One reason for the over estimation is that the energy levels required to obtain the high plastic strains will likely induce local current heating with a corresponding reduction in flow stress. A solution to this problem might be to use a constitutive equation, such as the Johnson-Cook relation, $$\sigma = (\sigma_0 + B\varepsilon^n)\left(1 + C\ln\frac{\dot{\varepsilon}}{\dot{\varepsilon}_0}\right)[1-(T^*)^m],$$

which accounts for thermal effects and larger strains [Johnson,1983]. The attended complexity involved with using such relations would however violate the simplicity tenet set down for this pencil and paper analysis. The development of constitutive relations for plastic flow in the EM regime may be further explored. For these reasons the purpose of this rough model may best be served by using an elementary, ideal plastic relation for assessing plastic work. Assuming ideal plastic behavior eq. 5.7 becomes $$E_s = A_c t\bar{\sigma}\int_{\varepsilon_0}^{\varepsilon_f} d\bar{\varepsilon} = A_c t\bar{\sigma}[\bar{\varepsilon}]_{\varepsilon_i}^{\varepsilon_f} \quad 5.8b$$

Determining a proper value for constant flow stress is an obvious source of additional error. In the absence of material data, the average of the yield and ultimate strengths might be used to take rough account of the thermal softening.

Step 3b: Determination of the kinetic energy desired for work piece.

Free form coupon test data indicated that for ductile aluminum alloy, a velocity of about 200. m/sec. will be sufficient to ensure the benefits of inertial suppression of local necking. The kinetic energy is approximated by considering the deforming sheet area as a free body, ignoring the restraining forces of the tensile stress in the sheet along the boundaries of the deformation area. This approximation assumes the energy in the work piece at any time during deformation is the superposition of kinetic and strain energies. The boundary is defined as the contour line representing some arbitrarily small iso-strain. This contour line will usually be close to the perimeter of the coil. The kinetic energy term is then given using the coil face area, $A_c$, the sheet density, D, and thickness $t_s$, by the familiar relation:

$$E_k = \frac{1}{2}mv^2 = \frac{1}{2}DA_c t_s v^2 \quad 5.11$$

During deformation, after the acceleration period, the kinetic energy is transferred into plastic work. If the acceleration is large, the period is short and the strain produced during it will be small. The magnetic energy absorption of the work piece can then be considered as a serial transfer process of magnetic field energy to kinetic energy which is dissipated by plastic work and other non-conservative terms (which are ignored). This implies a constant mechanical energy term such that;

$$E_M=E_k+E_s=\text{constant}$$

Accepting this analysis provides a means to determine minimum work piece velocity.

$$v = \sqrt{\frac{2E_s}{m}} \quad 5.12$$

From experience it is seen that velocity should not be less than 100 m/sec to maintain a minimum level of neck stabilization.

Step 3c: Calculation of the acceleration distance from the magnetic pressure.

The total energy of the work piece at any time during deformation, $E_s+E_k$, must be supplied by the magnetic field generated by the coil. Initially the magnetic field or flux is confined, by the opposing field of the eddy currents, to the stand-off volume between the work sheet and the coil. This compression of the magnetic flux generates a pressure, analogous to a fluid pressure but acting only on the sheet and the coil. The magnetic pressure is define as:

$$P_m = \frac{1}{2\mu_0}(B_i^2 - B_o^2) \quad 5.13a$$

where $B_i$ and $B_o$ is the flux density on the coil and opposite side of the sheet. $B_o$ can be determined if the penetration of the magnetic field into the sheet is known. The differential equation which describes the diffusion of a magnetic field into a conductor has the same form as heat diffusion (the Laplace equation); the form of the solution is therefore also the same. The instantaneous value of magnetic field in the sheet at depth y as a function of the surface value, skin depth (δ), frequency is, from a derivation by Stoll [Stoll, 1974] as; $H=H_s e^{-|y|/\delta} \cos(\omega\tau-|y|/\delta)$. This equation indicates that the magnetic flux density, B, ($B=\mu H$) in the sheet has a logarithmic decay and lags the coil side surface by $|y|/\delta$ radians. If the skin depth is equal a fourth of the sheet thickness the flux magnitude will be less than 2% of the coil side. However, this condition will seldom be met when forming thin gage sheets with large coils. Fortunately because the flux density appears as a square term in 5.11 a, fairly high flux leakage can be accepted. A 25% flux leakage through the sheet will reduce $P_m$ by only about 6%. If it is desired to take leakage into account a estimated leakage ratio, can be included such that $B_o=\eta B_i$ and $\eta \cong e^{-t/\delta}$ so that the magnetic pressure becomes:

$$P_m = \frac{1-\eta^2}{2\mu_0}B_i^2 \quad 5.13b$$

$P_m$ can also be defined in terms of the force require to accelerate the work piece to the chosen kinetic energy velocity, v, and a selected interval.

For a heuristic argument, it is noted that experimental evidence in free forming indicates that the usual EM event scenario is a rise to peak velocity deceleration period. During deceleration, the remaining kinetic energy is dissipated into plastic work, gas compression and heat. If the work piece strikes a die face, there will be additional losses due to impact. In this first approximation of required bank energy, gas compression, deformation heating and die impact are considered negligible. Assuming uniform acceleration over the first 1/n current cycle, $$a = \frac{v}{\tau} = \frac{vn\omega_d}{2\pi},$$

fixes the required magnetic pressure in terms of velocity v, sheet thickness $t_s$, sheet density, D and damped frequency at:

$$P_m = \frac{ma}{A_c} = \frac{t_s D n \omega_d v}{2\pi} \quad 5.14$$

The magnetic pressure acting on the sheet during the deformation represents the energy that the coil is feeding into the sheet which is required to be equal to the kinetic and strain energy terms. The form of this relation is analogous to that for an ideal gas:

$$E_s + E_k = P_m \Delta V = \frac{1-\eta^2}{2\mu_0}B_i^2 \Delta V \quad 5.15$$

where ΔV is the volume swept out by the sheet while $P_m$ is acting. However, the coil must first fill the stand-off gap volume $V_g$, with flux to generate $P_m$ initially. The energy density of a magnetic field is given by $$e = \frac{1}{2}\mu_0 H^2, \text{ but } H = \frac{B}{\mu_0}$$

so that magnetic energy in the initial gap is:

$$E_g = \frac{1}{2\mu_0}B_i^2 V_g \quad 5.16$$

Therefore, the portion of the coil flux energy $E_c^t$, used to generate the velocity and strain of the work piece is the sum of the initial gap energy plus the "flow work" of the sheet displacement $$E_c' = \frac{1}{2\mu_0}B_i^2 V_g + \frac{1-\eta^2}{2\mu_0}B_i^2 \Delta V \quad 5.17$$

By combining eq. 5.15 , 5.16 and 5.17 to eliminate the common terms gives a relationship between coil energy and system parameters.

$$E_c' = \frac{D t_s n \omega_d v}{2\pi(1-\eta^2)} V_g + E_M \quad 5.18$$

Note that eq. 5.16 estimates only the fraction of the total coil energy that is generating the pressure on the sheet. The remainder is contained in the rest of the magnetic field surrounding the coil. Total energy of an inductor can be found if the product of magnetic field and differential volume is integrated over the volume that the field occupies, $$E_c = \frac{1}{2}\int\int_V\int \frac{1}{\mu} B dV.$$

The field volume integral can be broken into the sum of the work gap volume and the remainder.

$$E_c = \frac{1}{2}\int\int_{V_g}\int \frac{1}{\mu} B dV + \frac{1}{2}\int\int_{V-V_g}\int \frac{1}{\mu} B dV \quad 5.19$$

The coil field fraction $K_c$, is the ratio of the field energy supplied to the work piece to the total energy of the coil during the first cycle which can be written as:

$$\frac{1}{K_c} = 1 + \frac{\int\int_{V-V_g}\int \frac{1}{\mu} B dV}{\int\int_{V_g}\int \frac{1}{\mu} B dV} \quad 5.20$$

5.18 simply states that if the work piece completely surrounds the coil all the coil energy can be used. However, for most sheet forming not more than half the field can be applied in which case the coil field energy will be twice that given by eq. 5.16 so that the total required coil energy is estimated by $$E_c = \frac{1}{K_c}\left[\frac{Dt_s n\omega_d v}{2\pi(1-\eta^2)}V_g + E_M\right] \quad 5.21$$

Step 4: Assembly of the estimate the energy required from capacitor bank.

With $E_c$ and $L_c$ the effective discharge current, $\bar{I}_B$, can be calculated using the inductor energy relation.

$$\bar{I}_B = \sqrt{\frac{2E_c}{L_c}} \quad 5.22$$

$\bar{I}_B$ is the same for all elements in the circuit so that the estimated bank energy is given by:

$$\Delta E_B = \frac{1}{2}(L_B + L_c + L_l)\bar{I}_B^2 + (R_B + R_c + R_l + R_p)\bar{I}_B^2 T \quad 5.23a$$

where $T = \frac{2\pi}{\omega_d}$.

To assess the eddy current resistance losses a value for $R_p$, is required. However, it will be more accurate to isolate the eddy current resistive energy term and to limit it to the acceleration period so that;

$$E_p = R_p \bar{I}_B^2 \frac{T}{n}.$$

Redefining it using equations 5.7, 5.13b and 5.14 produces equations 5.23b and 5.24.

$$\Delta E_B = \frac{1}{2}(L_B + L_c + L_l)\bar{I}_B^2 + (R_B + R_c + R_l)\bar{I}_B^2 T + E_p \quad 5.23b$$

$$E_p = \frac{Dt_s\omega_d v}{2\pi(1-\eta^2)}\frac{A_e}{\mu\sigma\delta}T \quad 5.24$$

If careful assessments are made of the component values of 5.23, the predicted energy required should be a lower bound due to the truncation of the current to a single cycle. This estimate should be dependable enough to help in initial design decisions, especially if used as a comparative measure for evaluating alternative coil and lead designs. Users should keep clearly in mind the simplifying approximations of this analysis:

Constant lumped parameters

Heuristically chosen acceleration period and minimum velocity

Uniform acceleration and plastic strain

Constant temperature

Truncation to a single cycle

The EM forming energy prediction method presented above was applied to the automobile hood and door inner part feature trials. The details of the part feature geometry, process and tooling design and trial results will be presented in sections. For discussion of the estimation method only, selected results of the analysis with comparisons to data taken during the trials are presented here. Table 5.2 summarizes the predicted and measured system response characteristics. Both parts were fabricated from 1.0 mm thick 611 1-T4 alloy. The capacitor bank parameters used, including the bus system, measured at 10 kJ discharge are:

Magneform Capacitor Bank Parameters

Capacitance=9.6E-4 farads

Inductance=1.36E-7 henry

Resistance=2.26E-3 ohms

TABLE 5.2

EM Forming Parameters For Bank Energy Estimate

| Part[Par] | $L_c$, H | $L_1$, H | $R_c$, 1/2 | $R_l$, 1/2 | $K_c$ | η | n | ϵ | $A_c$, $m^2$ | $V_g$, $m^3$ |
|---|---|---|---|---|---|---|---|---|---|---|
| Hood | 1.00E-7 | 5.9E-8 | 6.20E-4 | 1.57E-4 | 0.5 | 0.36 | 4 | 0.05 | 1.12E-2 | 1.12E-5 |
| Door a* | 1.93E-7 | 2.59E-7 | 1.06E-3 | 4.2E-4 | 0.5 | 0.36 | 2 | 0.25 | 4.06E-2 | 4.06E-5 |
| Door b1 | 1.04E-7 | 2.28E-7 | 4.43E-4 | 4.2E-4 | 0.5 | 0.36 | 4 | 0.21 | 1.74E-2 | 1.74E-5 |
| Door b2 | 1.50E-7 | 1.22E-7 | 9.0E-4 | 2.0E-4 | 0.5 | 0.36 | 4 | 0.21 | 1.74E-2 | 1.74E-5 |

TABLE 5.3

Comparison Of Calculated And Measured Responses

| Part | value type | $\omega_d$, rad/sec | R/2L rad/sec | $\Delta E_B$ joules | $I_B$ amps |
|---|---|---|---|---|---|
| Hood | calc. | 58600. | 5150. | 16800. | 187000 |
| | actual | 59800. | 5070. | 27000.* | 313700 |
| | % error | −2.0 | 1.6 | −37. | −40 |
| door I | calc. | 41800. | 3150. | 68400. | 275000. |
| | actual | 43000 | 4190. | 43200.+ | 188700. |
| | % error | −2.8 | −25. | 58. | 45.7 |
| door IIa | calc. | 47060. | 3327. | 33000. | 225000. |
| | actual | NA | NA | 48000.+ | NA |
| | % error | NA | NA | 31.+ | NA |
| door IIb | calc. | 50500 | 4090. | 22600. | 187000. |
| | actual | 46200. | 7896. | 24000.+ | 199000. |
| | % error | 9. | −48. | −6 | −6. |

+ limited die strike; * hard die strike

To add some clarification to the data in Table 5.3, it should be noted that the hood shown indications of significant impact velocity in much of the forming area which would require energy not accounted for in the analysis. At a discharge level of 18 kJ, the hood feature was substantially formed with much less impact indicated. The error between the prediction and the 18 kJ test is −7% for energy and −6% for rms current.

The door I preform geometry inner panel did not under go the 0.25 true plane strain that was calculated by line length change between the pre-form and desired geometries. The analysis assumes only stretching occurs during deformation. Even minor amounts of draw-in from surrounding material will reduce the strain levels in the EM forming area. Draw-in was evident in the door inner trials which reduced the measured strain to an average of approximately 0.16. The predicted bank energy required for this level of uniform plane strain is 41 kJ which reduces the predicted error to −5% for energy and 12% for rms current.

Door IIa and IIb used different coil designs with the same preform geometry. Coil B1 was a 3-bar while IIb was a 2 turn with the same face area of IIa. Three bar coils have lower efficiency which is clear from the results listed in Table 5.3. Moreover, the method is considerably farther off in predicting the required energy in this case than for the hood. One consideration is that in the case of the hood, the metal requiring the most strain was covered more completely by the high pressure area generated by the coil which is not true for the door 3-bar coil. However, this condition is more nearly met by the IIa coil design and might therefore account for the better prediction. The method may have produced better results if closer attention was given to assessing the value of the coil ratio K, which describes the fraction of the total coil field energy that is transferred to the work piece.

In addition to providing an estimate of bank energy and its general distribution in the system, this method provides a means of assessing the internal impulse forces in coil and the coil reaction against its support structure once the system current is estimated. For example, if the coil bar cross section are round or some what square, the force generated between coil elements can be roughly estimated by using the relation for the force per unit length, l, generated between parallel current filaments $I_1$ and $I_2$, d length units apart given by:

$$\frac{F}{l} = \frac{\mu_0 I_1 I_2}{2\pi d} \qquad 5.25$$

Of course, if the coil bars are rectangular and close together, 5.25 will give a very poor estimate of the force between them. More accurate relationships for various cross section geometries can be found in older texts and handbooks of electric power engineering such as Grover [Grover, 1947].

The energy estimation method presented here is intended only as a tool to aid in the early stages of a MT-EM process design. Like any other tool it has limitations which can be accepted and possibly improved if clearly understood. In addition the results available with such a tool are dependent, to some extent on the skill of the user. The real value of such approximations lie in their use in comparing competing design ideas. Additionally, estimation methods often aid in the generation of new ideas from which solutions follow.

Full Scale MT-EM Trials

Initial coupon tests indicated a synergistic effect increasing limit plastic strain levels was possible in combining quasi-static and high velocity forming methods for aluminum alloy stamping. Experimentation with coil geometries and materials produced results that further supported the expectation of success at full auto body panel size parts.

Automobile Hood Feature Line Extension Trial

Alloy 6111-T4 hoods were in production at the time of the trial. The original design intention was that the valley creases would run from each side of the wind screen, down the hood and around the nose to each side of the grill insert. During the prototype phase of production tool development, the valley crease could not be run to the grill area without producing wrinkles in the hood nose. The problem was correctly identified as bucking caused by unsupported compression of the material as the tool attempts to shorten the line length at the bottom of the crease traversing the hood nose. The object of this trial was to design and build an EM tool which could extend the crease valley feature line(s) around the nose of the hood as originally intended. The extended feature valley crease could not exhibit buckling or restrict marks where the extended feature blended with the first form area.

The amount of plastic strain required to complete the hood crease was only a few percent. The fact that the sheet could not be supported by tool surfaces during compression was the problem to be solved with EM pulse forming. Various options for constraining the high pressure area of the magnetic field over the narrow path of the valley crease were considered. High magnetic pressure outboard of the crease area would likely leave a impact mark in the sheet similar to a restrike mark in matched tools. The solution arrived at was the 3-bar coil concept. The 3-bar coil concept was subsequently also used in coupon tests. The coils for the hood and coupon tests are similar electrically in that the center bar carries the total current and the each of the two outer bars return half the total current. The 3-bar coil configuration is not as energy efficient as a single turn coil consisting of the outer bars of the coil only. However the 3-bar design is well suited to forming very high aspect ratio features which are not very deep. A simple straight, flat, trial coil, 4.75 cm×30.00 cm was built of rectangular yellow brass bar stock and tested to validate the fundamental concept. The coil was pulsed against a flat sheet 6111-T4, (8.0 cm×35.0 cm×0.08 cm) at 12. kJ, backup by a 2.5 cm thick sheet of neoprene (60 durometer) about twice as wide as the test sheet. The result was a bead the same width as the center bar (1.0 cm), formed in the sheet the same length as the center bar, approximately 0.5 cm high and having a nearly parabolic cross section. The sheet outboard of the bead had a slight dihedral away from the bead but no wrinkles. A question remained as to how well a 3-bar would form a feature similar to the hood crease around a radius like the nose curvature of the hood. Since the 3-bar design was inexpensive and easily made from bar stock, a second trial coil fixture was built and tested. The second three bar coil, 4.75 cm wide by 92.0 cm long was constructed with a 15 cm radius through a 120 degree bend at the mid-point. A first trial coil was prepared with a test bead sheet and the second, mounted in a two half, plywood fixture, also with a test sheet. The top half of the second coil fixture carried a plastic die insert to form the test sheets against. Either stretch or compression beads could be produced by interchanging the coil and the die insert from the male half to the female.

The results of the 3-bar trial coil tests provided an empirical basis for the design of the hood crease feature coil along with an expectation of its efficiency. Geometrically, the hood coil was quite similar to the curved trial coil with a few notable exceptions. First, the hood coil was not planely curved. Second, it was not level across the bars in cross section. The coil face needed to carry the same contours as the hood valley crease area to be reformed within approximately 1.0 mm to maintain good magnetic field coupling. Last, the hood coil needed to be structurally self sufficient capable of resisting the internal forces generated during operation with minimal reliance on containment by tool material in which it was embedded. This last condition was supported by the trial coil tests which indicated loss of efficiency when surrounded too closely by a contiguous, conducting, support form material such as steel or aluminum. Conversely, epoxies and other polymers in heavy section had alone, neither adequate stiffness or toughness to contain the internal coil impulse forces attendant with the estimated pulse energy levels.

Figure 19A:
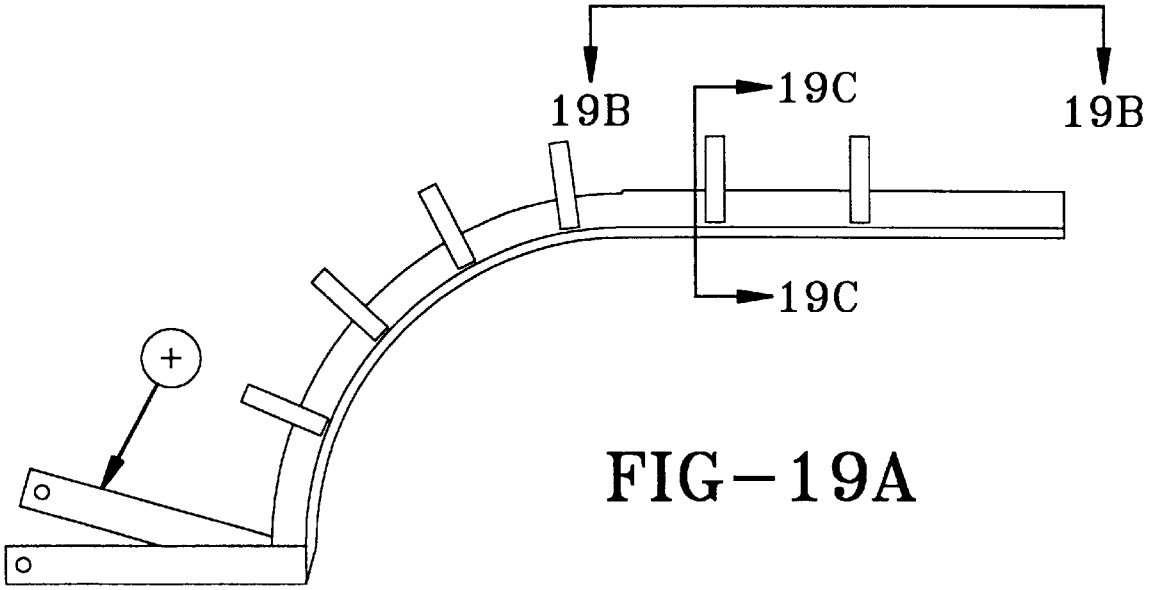
FIGS. 19*a*, 19*b* and 19*c* is an approximate schematic of the geometry of a electromagnetic actuator coil used in accordance with one embodiment of the present invention.
Figure 19B:
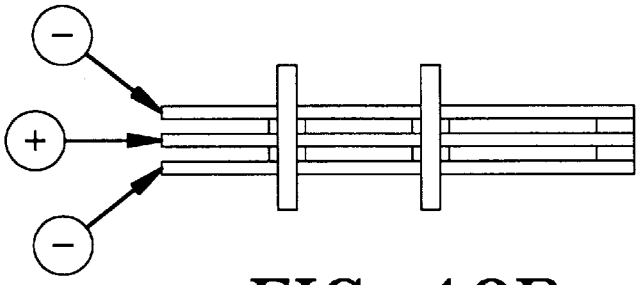
Figure 19C:
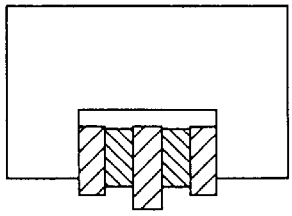

FIGS. 19*a*, 19*b* and 19*c* show an approximate schematic of the geometry of the hood coil. Contact between the outer bars through the steel clamps was allowed since the outer bars are at very nearly the same potential. Since the steel clamps were thin and parallel to the magnetic field they developed very little eddy current and therefore did not reduce the coil force on the hood. Using the simple energy analysis presented above, the peak coil current were estimated and applied to determining peak internal forces of the coil. It is these forces which size the clamping plates or tie rods used to maintain structural integrity of the coil. As reported earlier, a principal structural design rule for MT-EM coils is sufficient strength to handle discharge forces independent of the surrounding tool material. The peak current was predicted to be 264000 amperes by the method presented in the previous section. Internal forces of the coil, tending to spread the coil bars apart, at peak current were estimated at 210 kN. Steel clamps were designed so that the span strength of the coil bars matched the load capacity of the clamps. The arrangement and size of the clamps shown in FIGS. 19*a*, 19*b* and 19*c* resulted from the analysis of coil current and forces with an additional safety margin provided by the tooling material.

The finished EM tools with the imbedded coil used for the EM restrike of the hood feature are made from the new, iron filled castable product which is a room temperature cured, epoxy like material. This material is currently being used in place of low melt temperature zinc alloys such as Kirksite for prototype and short run production. Cost of producing MT-EM tools for auto body parts using the new iron filled epoxy is significantly lower than alternative constructions including the soft zinc metals. Additional advantages of the material are that eddy currents are arrested due to the small particle size of the iron filler while the mass, is about 70% that of iron. Mass is a desirable property in MT-EM tools as it supplements the tool material stiffness in providing local resistance to deflection at high work piece impact velocities. Greater detail of the construction process for these castable MT-EM tools will be given in the section describing the door inner panel trial.

The automobile hood trial demonstrates that the apparatus and methods of the present invention allows sheet metals to be compressed without wrinkling, permits a formed panel to be restruck from an original/precursor shape to a final shape.

The automobile door trial demonstrates that the apparatus and method of the present invention allows one to extend the forming limits of such metals as aluminum by forming a softened corner (i.e. approximately 4"×4"), and that the EM forming may be used to finish the shape with higher strains.

These trials demonstrate that the apparatus and methods of the present invention may be made commercially viable in the formation of actual commercial metal parts.

With respect to the example of the automobile hood mock-up it was found that the subject shape could be achieved with a 3-bar coil which was both robust and simple to manufacture. A feature of about 40" in length could be formed at about 12 kJ. It was also shown that a bead could be made in compression.

The 3-bar copper, wrapped coil was fabricated to conform to the hood contour and had internal clamps to react to forces on the coil during operation(see FIG. 25) The coil was embedded in General Motors STAMP metal/polyester composite, as was the balance of the top and lower die. Over 30 discharges on a single embedded coil could be done without damage. The portion(s) of the mold requiring the EM coil preferably was cut out to form cassettes that allowed iterative try-out and proofing, as well as modification and maintenance. In some applications the same cassette space could be provided with cassettes having different coil numbers, variations and arrangements for restriking.

Vacuum ports were provided on the top tool (the side that defines the sheet shape). With vacuum grease a vacuum of about 20 torr could be obtained.

Figure 20:
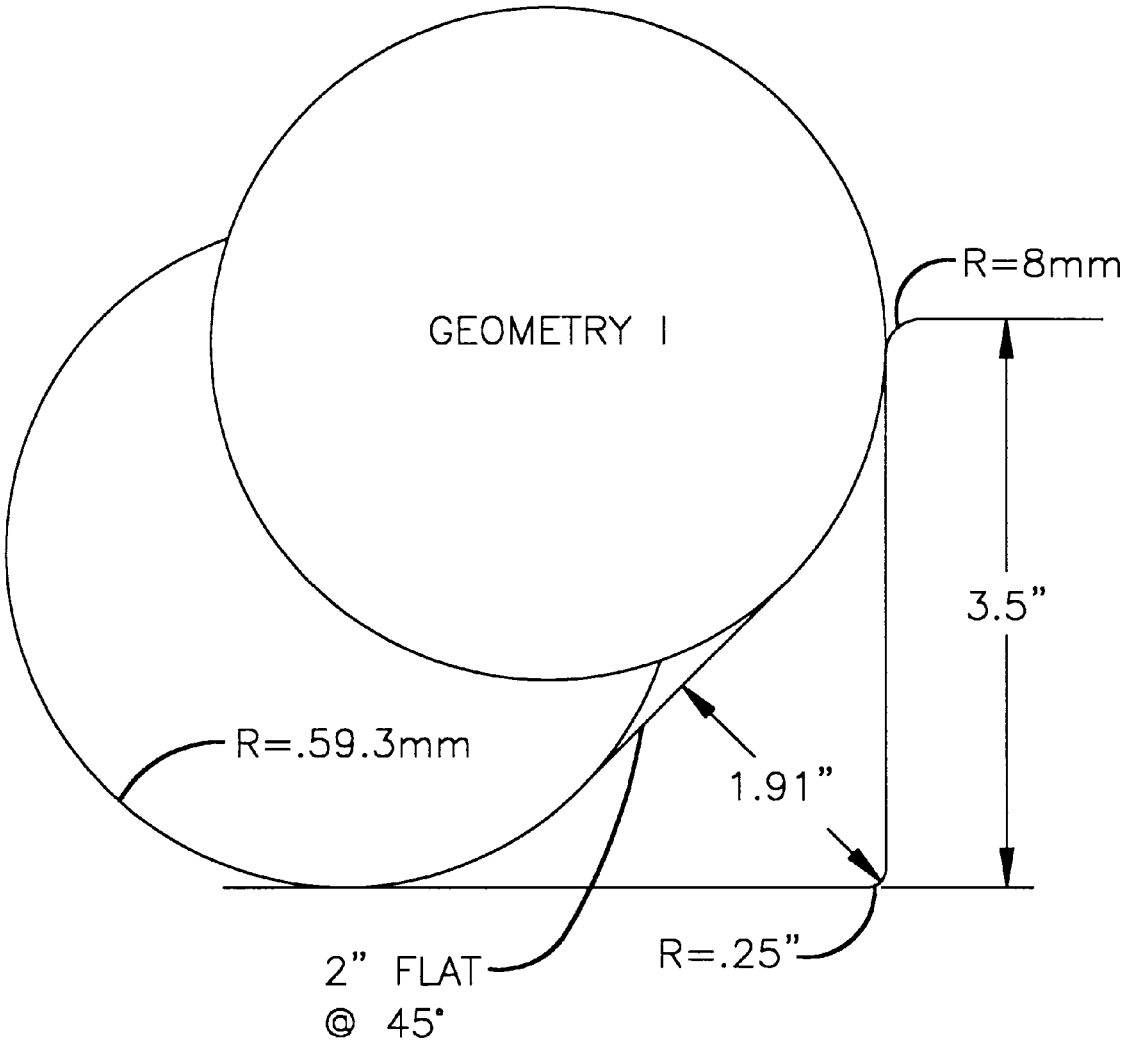
FIG. 20 shows a graphic representation of an automobile geometry that may be produced in accordance with the present invention.

With respect to the automobile door trial, a geometry such as that shown in FIG. 20 could be produced by locking the panel fully and forming the angled hinge face. This precursor shape was then reformed electromagnetically. This geometry was formed using only about 35 kJ.

High velocity forming after traditional forming can provide significantly enhanced total strains (about 30% in plane strain). Also, high levels of quasi-static pre-strain maximize total available strain. Thermal softening was found to be an unexpected source of reduction in strain.

Thermal notching could be mitigated by protecting the work piece from heat with a copper driver foil. A good coil design, preferably one avoiding notches normal to stretch direction, and uniform current density, also reduced thermal notching. The use of 5000 series aluminum may less subject to such problems.

The use of intermittent EM pulses during die forming or other mechanical forming is shown to be useful in distributing strain in the forming process.

Figure 21:
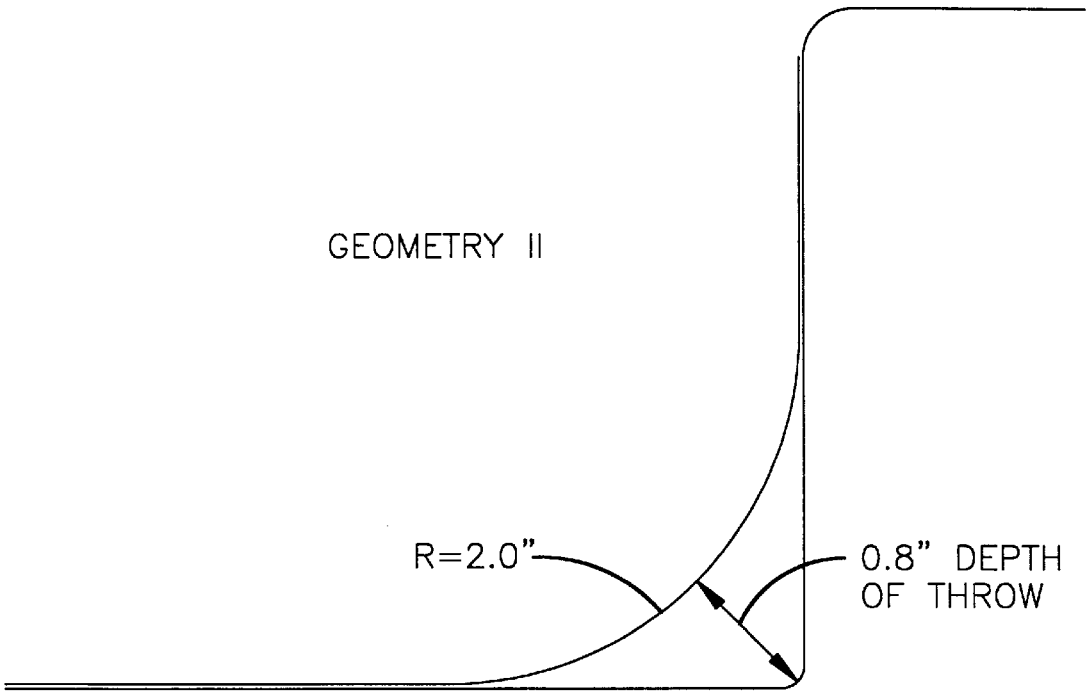
FIG. 21 shows a graphic representation of an automobile geometry that may be produced in accordance with the present invention.

The geometry of FIG. 21 was found to be simpler to form as compared to that in FIG. 20. A 3-bar coil was used to form this geometry. Due to the relatively high lead inductance and low coil efficiency, this panel could not be taken to failure at energies over 40 kJ, but significant forming was obtained.

Figure 22:
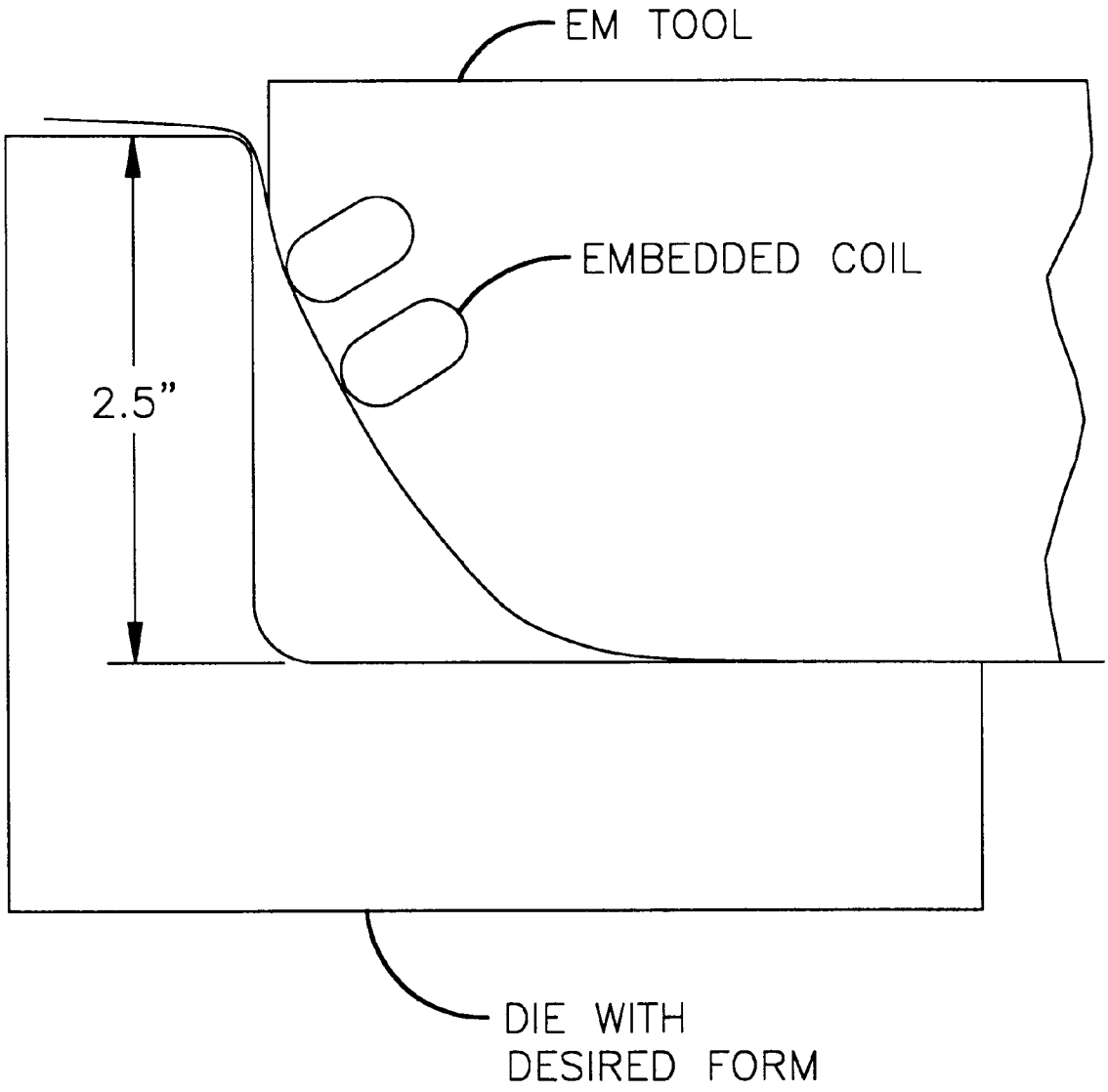
FIG. 22 shows a schematic representation of a mold body in accordance with the present invention.

The corner of a J-car door inner, whose hinge face was largely formed traditionally, is softened to avoid tearing, and EM forming is used to finish the shape, as shown in the schematics in FIG. 22. FIG. 22 shows where an embedded coil may be supplied as a cassette.

Figure 23:
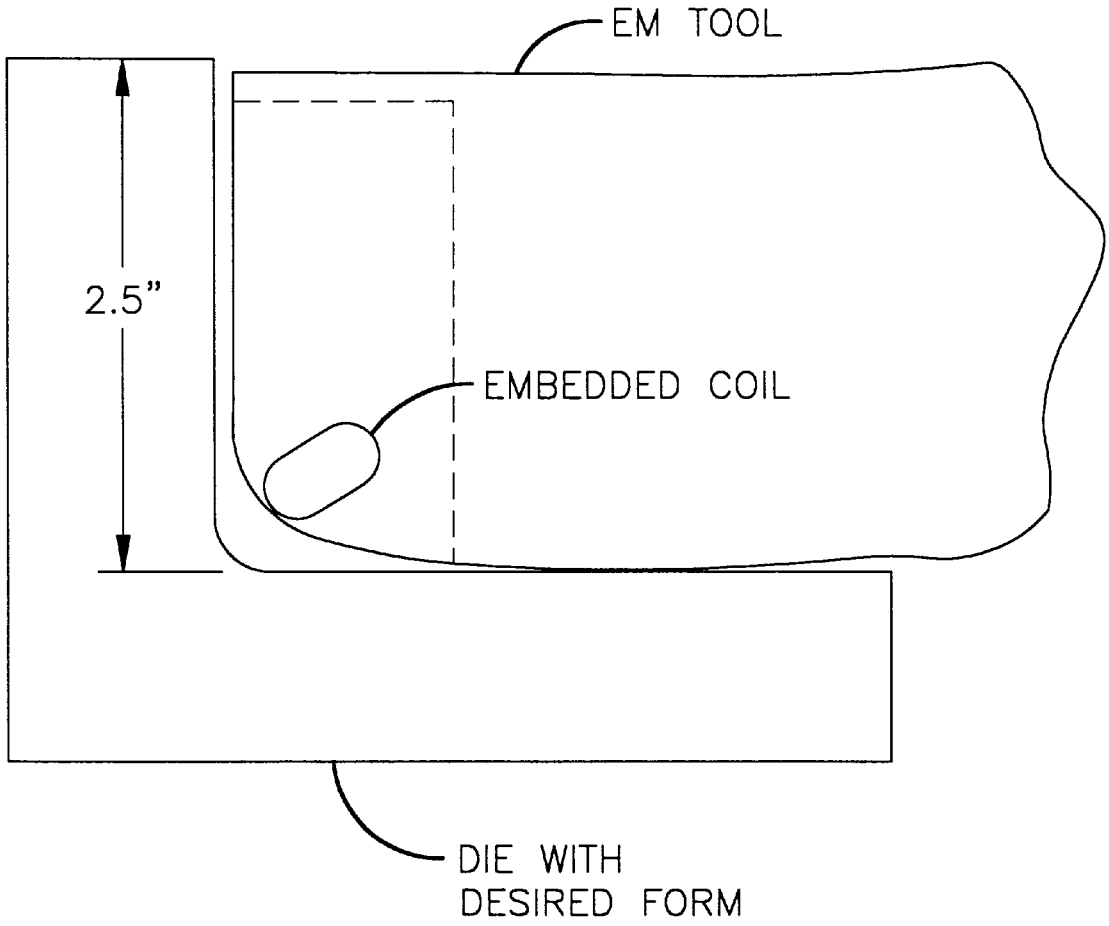
FIG. 23 shows a schematic representation of a mold body in accordance with the present invention.
Figure 24:
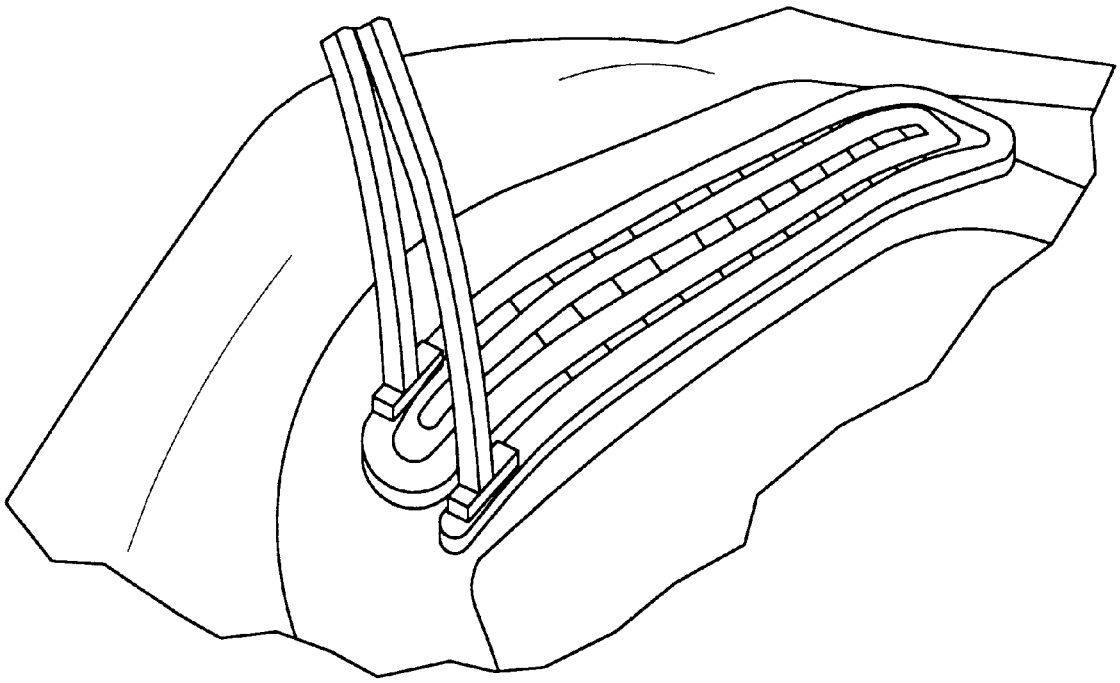

FIG. 23 shows an EM forming coil as it resides behind a mold face which is adapted to form a metal sheet into a precursor shape followed by finishing with EM forming. FIG. 24 shows an operator holding a cassette, containing an EM forming coil, that fits into the balance of a correspondingly shaped portion of a mold body. as it resides behind a mold face which is adapted to form a metal sheet into a precursor shape followed by finishing with EM forming.

Figure 25:
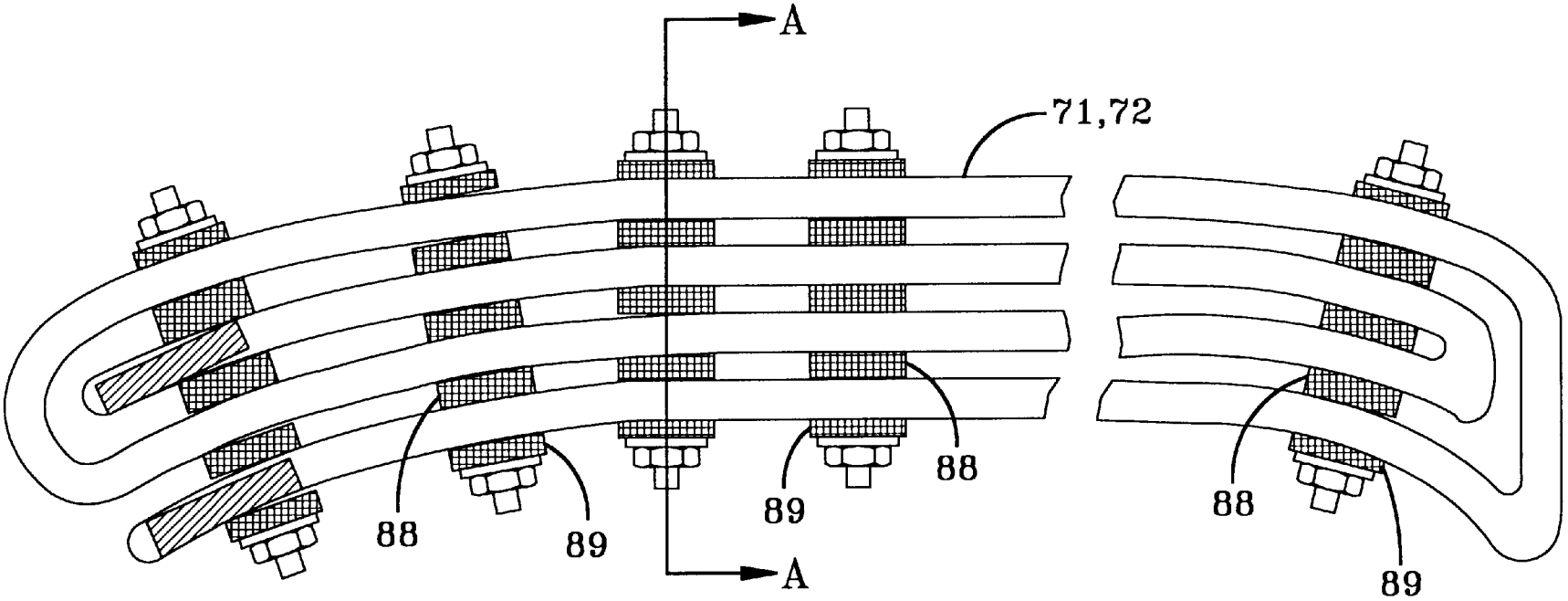
FIG. 25 shows a plan view of an electromagnetic actuator coil used in accordance with the present invention.

FIG. 25 shows a plan view of an electromagnetic actuator coil used in accordance with the present invention. FIG. 25 shows coil body 26

Figure 26:
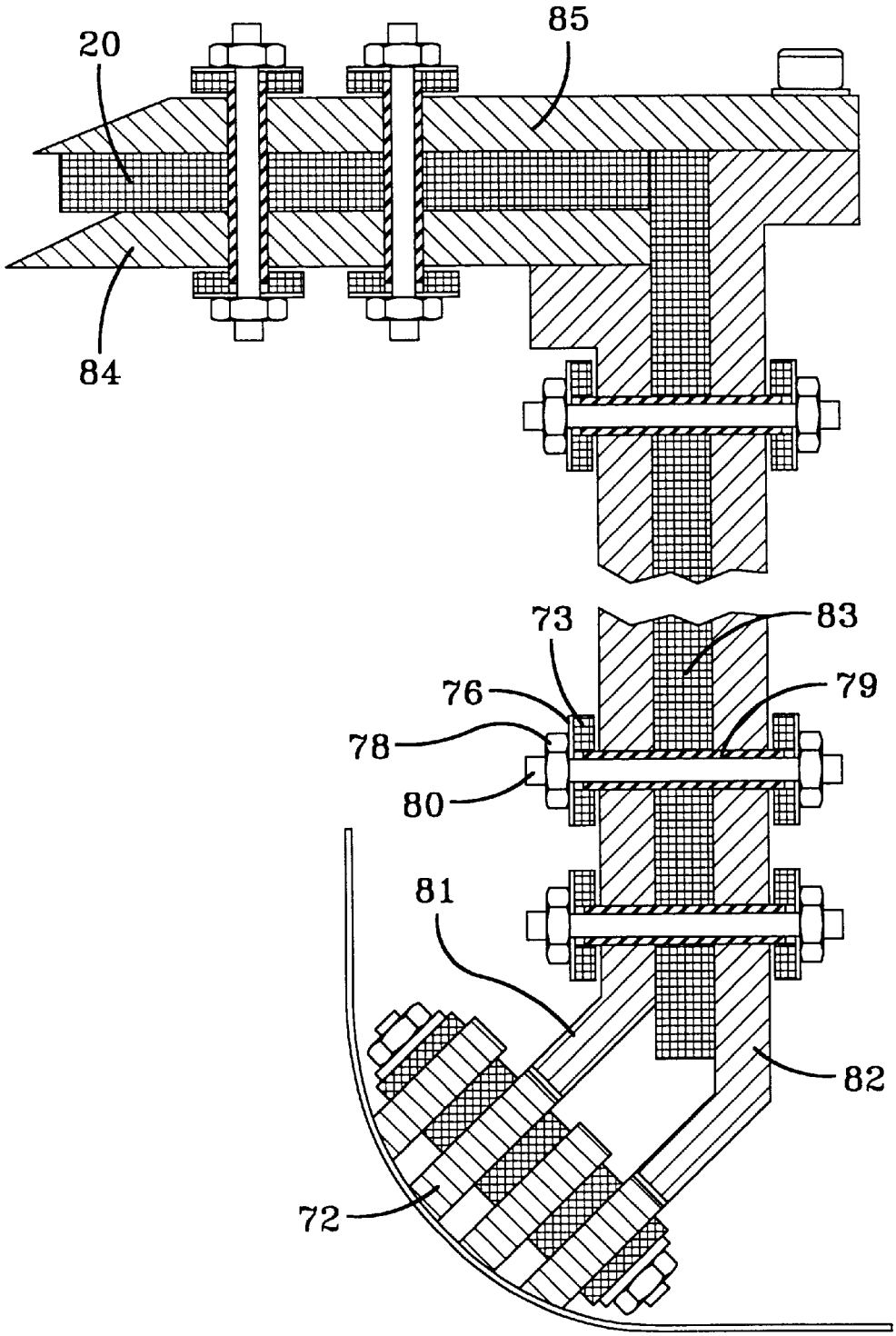
FIG. 26 is a sectioned elevational view of an electromagnetic actuator coil with inner and outer coil leads.

FIG. 26 is a sectioned elevational view of an electromagnetic actuator coil with inner and outer coil leads.

Figure 27:
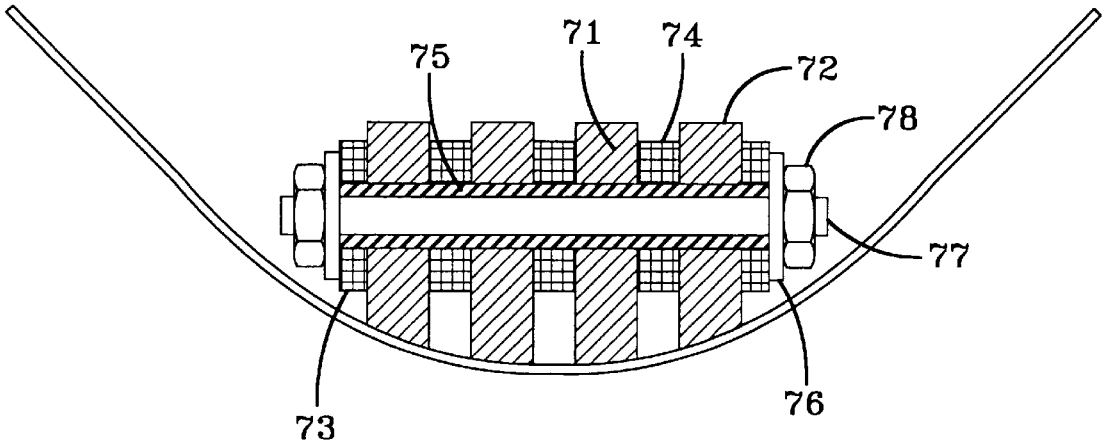
FIG. 27 is a sectioned view of the electromagnetic actuator coil along A—A of FIG. 25.

FIG. 27 is a sectioned view of the electromagnetic actuator coil along A—A of FIG. 25.

FIGS. 25, 26 and 27 show coil body 71 bearing coil body insulating tape 72. Also shown are flat outer insulating spacer 73 and flat inner insulating spacer 74; and curved outer insulating spacer 89 and flat inner insulating spacer 88.

FIG. 26 also shows outer coil lead 81 and inner coil lead 82, and corresponding negative bus lead 84 and positive bus lead 84. Also shown is coil lead insulator plate 83 and bus lead insulator plate. There is also a short tie rod insulator sleeve 79 and washer 76 which, together with hex nut 78, hold short tie rod 80 in short tie rod insulator sleeve 79. FIG. 26 also shows bus lead insulator plate 90.

FIG. 27 shows washer 76 and hex nut 78 holding long tie rod 77 in long tie rod insulator sleeve 75, with flat inner insulating spacers 74 between portions of the coil body 72, and flat outer insulating spacers 73 between portions of the coil body 72 and the washer 76 and hex nut 78.

Figure 28:
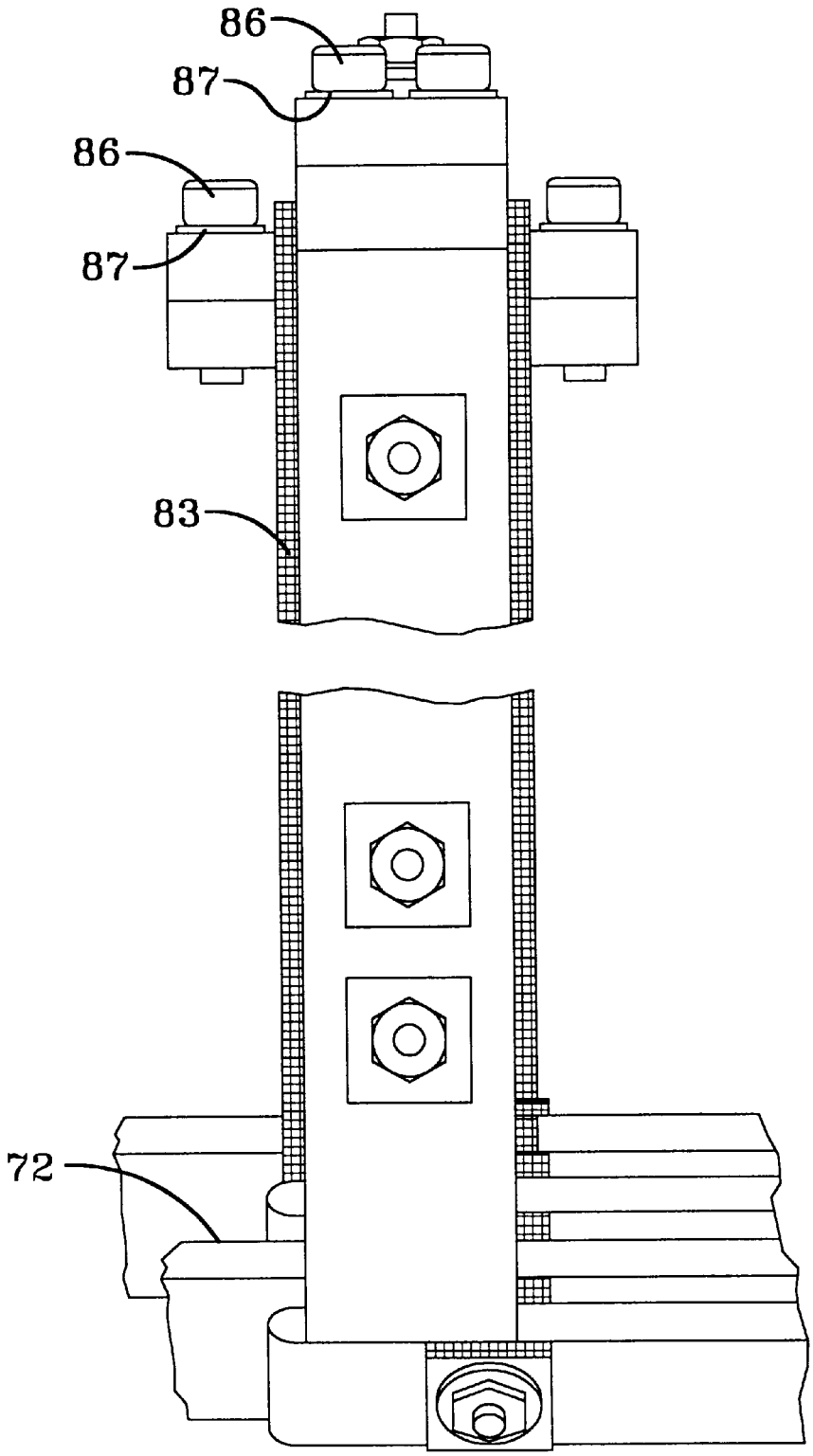
FIG. 28 shows a side elevational view of the coil, lead and bus assembly shown in FIG. 26.

FIG. 28 shows a side elevational view of the coil, lead and bus assembly shown in FIG. 26, showing coil body 72, coil lead insulator plate 83, 0.25-20 NC×0.88 soc hd scr 86 and 0.25 hard washer 87.

In view of the foregoing disclosure, it will be within the ability of one of ordinary skill in the art to make modifications to the present invention, such as through equivalent alternative mechanical arrangements and/or the integration or separation of component parts, without departing from the spirit of the invention as reflected in the appended claims.

What is claimed is:

1. A mold body portion for forming a metal work piece into a target shape, said mold body portion comprising:

a mold body portion having a mold side and a back side; said mold body portion comprising a resinous material and comprising at least one electromagnetic actuator imbedded in said resinous material, said at least one electromagnetic actuator having a non-planar, non-axisymetrical configuration.

2. A mold body portion according to claim 1 wherein said resinous material comprises metallic flakes imbedded therein.

3. A mold body portion according to claim 1 wherein said at least one electromagnetic actuator comprises opposing members, and a restraint across said opposing members adapted to resist movement of said opposing members when said electromagnetic actuator is supplied with current.

4. A mold body portion according to claim 3 wherein said restraint comprises a clamp.

5. A mold for forming a metal work piece into a target shape, said mold comprising:

(a) a male mold portion having a mold side and a back side;

(b) a female mold portion having a mold side and a back side;

said mold side of male mold portion and said mold side of female mold portion adapted to mate incompletely so as to deform a work piece disposed therebetween into a precursor shape, so as to leave at least one precursor area of said work piece to be finally formed;

(c) at least one of said mold portions comprising a resinous material and comprising at least one electromagnetic actuator imbedded in said resinous material, so as to be capable of further forming said at least one precursor area, said at least one electromagnetic actuator having a non-planar, non-axisymetrical configuration.

6. A mold according to claim 5 wherein said resinous material comprises metallic flakes imbedded therein.

7. A mold according to claim 5 wherein said at least one electromagnetic actuator comprises opposing members, and a restraint across said opposing members adapted to resist movement of said opposing members when said electromagnetic actuator is supplied with current.

8. A mold according to claim 7 wherein said restraint comprises a clamp.

* * * * *

UNITED STATES PATENT AND TRADEMARK OFFICE

CERTIFICATE OF CORRECTION

PATENT NO. : 6,050,120
DATED : April 18, 2000
INVENTOR(S) : Glenn S. Daehn et al.

It is certified that error appears in the above-identified patent and that said Letters Patent is hereby corrected as shown below:

Column 15,
Line 59, please delete the word "a" and insert the word -- an --.

Column 26,
Line 14, please delete the word "a" and insert the word -- an --.

Column 32,
Line 7, please delete the word "require" and insert the word -- required --.

Column 40,
Line 9, please delete the words "in sections" and insert the word -- below --.
Line 34, after TABLE 5.2, please insert the words -- *pre-form and coil geometry: a=stretch form 2 turn, b1=draw-in 3-bar, b2=draw-in 2 turn --.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*